US007187329B2

(12) United States Patent
Okado

(10) Patent No.: US 7,187,329 B2
(45) Date of Patent: Mar. 6, 2007

(54) ANTENNA, DIELECTRIC SUBSTRATE FOR ANTENNA, AND WIRELESS COMMUNICATION CARD

(75) Inventor: Hironori Okado, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 10/536,456

(22) PCT Filed: Jul. 14, 2003

(86) PCT No.: PCT/JP03/08919

§ 371 (c)(1),
(2), (4) Date: Jun. 2, 2005

(87) PCT Pub. No.: WO2004/049505

PCT Pub. Date: Jun. 10, 2004

(65) Prior Publication Data

US 2005/0248487 A1 Nov. 10, 2005

(30) Foreign Application Priority Data

Nov. 27, 2002 (JP) ..... 2002-343290
Mar. 4, 2003 (JP) ..... 2003-056740

(51) Int. Cl.
*H01Q 1/38* (2006.01)
*H01Q 13/10* (2006.01)
*H01Q 1/48* (2006.01)

(52) U.S. Cl. ..... 343/700 MS; 343/767; 343/846

(58) Field of Classification Search ..... 343/700 MS, 343/767, 846
See application file for complete search history.

(56) References Cited

U.S. PATENT DOCUMENTS 4,083,046 A 4/1978 Kaloi ..... 343/700 MS
4,151,531 A 4/1979 Kaloi ..... 343/700 MS (Continued)

FOREIGN PATENT DOCUMENTS

EP 831548 A2 3/1998

(Continued)

OTHER PUBLICATIONS

U.S. Appl. No. 10/654,432, filed Sep. 4, 2003, Okado.

(Continued)

*Primary Examiner*—Shih-Chao Chen
(74) *Attorney, Agent, or Firm*—Oliff & Berridge, PLC

(57) ABSTRACT

An antenna of this invention has a ground pattern and a planar element having a cut-out portion from an edge portion farthest from a feed position toward the ground pattern side, and the ground pattern and the planar element are juxtaposed with each other. By providing the cut-out portion, the miniaturization can be realized and current paths to obtain radiation in the low frequency range can be secured. In addition, because the planar element and the ground element are juxtaposed with each other, the volume necessary for the implementation is reduced, and it becomes easy to control the antenna characteristic, particularly, the impedance characteristic, thereby the broad bandwidth can be achieved.

1 Claim, 31 Drawing Sheets

U.S. PATENT DOCUMENTS

| | | | | |
|---|---|---|---|---|
| 4,151,532 | A | 4/1979 | Kaloi | 343/700 MS |
| 4,500,887 | A | 2/1985 | Nester | 343/700 MS |
| 4,605,012 | A | 8/1986 | Ringeisen et al. | 607/155 |
| 4,605,933 | A | 8/1986 | Butscher | 343/700 MS |
| 4,843,403 | A | 6/1989 | Lalezari et al. | |
| 4,853,704 | A | 8/1989 | Diaz et al. | |
| 5,255,002 | A | 10/1993 | Day | 343/713 |
| 5,521,606 | A | 5/1996 | Iijima et al. | 343/713 |
| 5,532,707 | A | 7/1996 | Klinger et al. | 343/793 |
| 5,847,682 | A | 12/1998 | Ke | 343/752 |
| 5,872,546 | A | 2/1999 | Ihara et al. | 343/795 |
| 6,008,770 | A | 12/1999 | Sugawara | |
| 6,046,703 | A | 4/2000 | Wang et al. | 343/795 |
| 6,097,345 | A | 8/2000 | Walton | 343/769 |
| 6,133,879 | A | 10/2000 | Grangeat et al. | 343/700 MS |
| 6,157,344 | A | 12/2000 | Bateman et al. | 343/700 MS |
| 6,232,925 | B1 | 5/2001 | Fujikawa | 343/702 |
| 6,249,254 | B1 | 6/2001 | Bateman et al. | 343/700 MS |
| 6,259,416 | B1 | 7/2001 | Qi et al. | 343/767 |
| 6,329,950 | B1 | 12/2001 | Harrell et al. | 343/700 MS |
| 6,351,246 | B1 | 2/2002 | McCorkle | 343/795 |
| 6,452,548 | B2 | 9/2002 | Nagumo et al. | 343/700 MS |
| 6,515,626 | B2 | 2/2003 | Bark et al. | 343/700 MS |
| 6,603,429 | B1 | 8/2003 | Bancroft et al. | 343/700 MS |
| 6,661,380 | B1 * | 12/2003 | Bancroft et al. | 343/700 MS |
| 6,664,926 | B1 * | 12/2003 | Zinanti et al. | 343/700 MS |
| 6,707,427 | B2 | 3/2004 | Konishi et al. | 343/700 MS |
| 6,720,924 | B2 | 4/2004 | Tomomatsu et al. | 343/700 MS |
| 6,747,600 | B2 | 6/2004 | Wong et al. | 343/700 MS |
| 6,747,605 | B2 | 6/2004 | Lebaric et al. | 343/795 |
| 6,762,723 | B2 | 7/2004 | Nallo et al. | 343/700 MS |
| 6,768,461 | B2 | 7/2004 | Huebner et al. | 343/700 MS |
| 2002/0015000 | A1 | 2/2002 | Reece et al. | 343/795 |
| 2002/0026586 | A1 | 2/2002 | Ito | 713/183 |
| 2002/0122010 | A1 | 9/2002 | McCorkle | 343/767 |
| 2003/0020668 | A1 | 1/2003 | Peterson | 343/846 |
| 2003/0034920 | A1 | 2/2003 | Lee | 343/700 MS |
| 2003/0156064 | A1 | 8/2003 | Bancroft et al. | 343/700 MS |

FOREIGN PATENT DOCUMENTS

| | | |
|---|---|---|
| EP | 1 198 027 A1 | 4/2002 |
| JP | 31-709 | 1/1921 |
| JP | A 55-4109 | 1/1980 |
| JP | A 56-037702 | 4/1981 |
| JP | A 57-142003 | 9/1982 |
| JP | A 63-275204 | 11/1988 |
| JP | A 02-023702 | 1/1990 |
| JP | A 05-063425 | 3/1993 |
| JP | U 5-82122 | 5/1993 |
| JP | U 5-76109 | 10/1993 |
| JP | A 6-291530 | 10/1994 |
| JP | U 3008389 | 12/1994 |
| JP | A 8-213820 | 8/1996 |
| JP | A 9-223921 | 8/1997 |
| JP | A 11-27026 | 1/1999 |
| JP | A 11-330846 | 11/1999 |
| JP | A 2000-183789 | 6/2000 |
| JP | A 2001-156532 | 6/2001 |
| JP | A 2001-203521 | 7/2001 |
| JP | A 2001-203529 | 7/2001 |
| JP | A 2001-217632 | 8/2001 |
| JP | A 2001-217636 | 8/2001 |
| JP | A 2002-100915 | 4/2002 |
| JP | A 2002-171126 | 6/2002 |
| JP | A 2002-190706 | 7/2002 |
| JP | A 2002-252515 | 9/2002 |
| JP | A 2002-319811 | 10/2002 |

OTHER PUBLICATIONS

U.S. Appl. No. 10/655,304, filed Sep. 5, 2003, Okado.

U.S. Appl. No. 10/657,108, filed Sep. 9, 2003, Okado.

U.S. Appl. No. 10/667,347, filed Sep. 23, 2003, Okado.

Honda et al., "Improved Input Impedance of Circular Disc Monopole Antenna," Spring National Convention of The Institute of Electronics, Information and Communication Engineers, pp. 2-131, 1992.

Ihara et al., "Broadband Characteristics of Semi-Circular Antenna Combined with Linear Element," General Convention of The Institute of Electronics, Information and Communication Engineers, pp. 77, 1996.

Ihara et al., "A Small Broadband Antenna with Rounded Semi-Circular Element," Society Conference of The Institute of Electronics, Information and Communication Engineers, pp. 78, 1996.

Honda, "Wideband Monopole Antenna of Circular Disc," ITBJ Technical Report, vol. 15, No. 59, pp. 25-30, Oct. 1991.

Kraus; "Antennas" 2nd edition 1988; McGraw-Hill; pp. 723-725.

Electronic Information Communication Institution; "Antenna Engineering Handbook"; Oct. 1980; p. 128.

Kraus; "Antennas" 2nd edition 1988; McGraw-Hill; pp. 346-347.

* cited by examiner dBi

| PLANE | POLARIZED ELECTROMAGNETIC RADIATION | FREQUENCY(GHz) | |
|---|---|---|---|
| | | 2.45 | 5.4 |
| YZ | V | −7.1 | −9.9 |
| | H | −2.2 | −0.8 |
| XZ | V | 0.6 | −3.7 |
| | H | −8.2 | −7.2 |
| XY | V | −14.5 | −12.8 |
| | H | −2.1 | −0.7 |
| TOTAL AVERAGE | | −3.4 | −3.9 |

ANTENNA, DIELECTRIC SUBSTRATE FOR ANTENNA, AND WIRELESS COMMUNICATION CARD

TECHNICAL FIELD

This application is a 371 of PCT/JP03/08919 filed on Jul. 14, 2003.

This invention relates to a dual bandwidth antenna technique and broadband antenna technique.

BACKGROUND TECHNOLOGY

For example, JP-A-57-142003 (Patent Document 1) discloses the following antennas. That is, it discloses a monopole antenna in which a flat-plate type radiation element 3001 having a disc shape is erected vertically to an earth plate or the ground 3002 as shown in FIGS. 45A and 45B. This monopole antenna is designed so that a high-frequency power source 3004 and the radiation element 3001 are connected to each other through a power feeder 3003 and the height of the top portion of the radiation element 3001 is set to a quarter wavelength. Furthermore, it also discloses a monopole antenna in which a flat-plate type radiation element 3005 whose upper peripheral edge portion has a shape extending along a predetermined parabola is erected vertically to an earth plate or the ground 3002 as shown in FIGS. 45C and 45D. Still furthermore, it discloses a dipole antenna in which two radiation elements 3001 of the monopole antenna shown in FIGS. 45A and 45B are symmetrically arranged as shown in FIG. 45E. Still furthermore, it discloses a dipole antenna in which two radiation elements 3005 of the monopole antenna shown in FIGS. 45C and 45D are symmetrically arranged as shown in FIG. 45F.

In addition, JP-A-55-4109 (Patent Document 2) discloses the following antennas, for example. That is, a sheet-type elliptical antenna 3006 is erected vertically to a refection surface 3007 so that the major axis thereof is parallel to the reflection surface 3007, and power supply is carried out through a coaxial power feeder 3008, as shown in FIG. 45G. Moreover, FIG. 45H shows an example where the antenna is configured as a dipole. In the case of the dipole type, the sheet-type elliptical antennas 3006*a* are arranged on the same plane so that the minor axes thereof are located on the same line, and a slight gap is disposed so that a balanced feeder 3009 is connected to both the antennas.

Besides, a monopole antenna as shown in FIG. 45J is disclosed in "B-77: BROADBAND CHARACTERISTICS OF SEMI-CIRCULAR ANTENNA COMBINED WITH LINEAR ELEMENT", Taisuke Ihara, Makoto Kijima and Koichi Tsunekawa, pp77 General Convention of The Institute of Electronics, Information and Communication Engineers, 1996 (hereinafter referred to as "non-patent document 1"). As shown in FIG. 45J, a semicircular element 3010 is erected vertically to an earth plate 3011, and the nearest point of the arc of the element 3010 to the earth plate 3011 serves as a feed portion 3012. The non-patent document 1 shows that the frequency fL at which the radius of the circle almost corresponds to a quarter wavelength is the lower limit. Furthermore, it also describes an example where an element 3013 achieved by forming a cut-out portion in the element 3010 shown in FIG. 45J is erected vertically to the earth plate 3011 as shown in FIG. 45K, and that little difference exists in VSWR (Voltage Standing Wave Ratio) characteristic between the monopole antenna shown in FIG. 45J and the monopole antenna shown in FIG. 45K. Furthermore, it also discloses an example where an element 3014, which is formed by connecting an element 3014*a*, which resonates at fL or less and has a meander monopole structure, to an element with the cut-out portion as shown in FIG. 45K, is erected vertically to the earth plate 3011 as shown in FIG. 45L. Incidentally, the element 3014*a* is disposed to be accommodated in the cut-out portion. Incidentally, in connection with the non-patent document 1, disc type monopole antennas are described in "B-131 IMPROVED INPUT IMPEDANCE OF CIRCULAR DISC MONOPOLE ANTENNA", Satoshi Honda, Yuken Ito, Hajime Seki and Yoshio Jinbo, 2-131, SPRING NATIONAL CONVENTION of The Institute of Electronics, Information and Communication Engineers, 1992 (hereinafter referred to as "non-patent document 2"), and "WIDEBAND MONOPOLE ANTENNA OF CIRCULAR DISC", Satoshi Honda, Yuken Ito, Yoshio Jinbo and Hajime Seiki, Vol. 15, No. 59, pp. 25–30, Oct. 24, 1991 in "TECHNICAL REPORTS OF THE INSTITUTE OF TELEVISION" (hereinafter referred to as "non-patent document 3").

The antennas described above pertain to a monopole antenna in which a flat-plate conductor having various shapes is erected vertically to the ground surface, and a symmetric dipole antenna using two flat-plate conductors having the same shape.

Besides, U.S. Pat. No. 6,351,246 (Patent Document 3) discloses a symmetric dipole antenna having a special shape as shown in FIG. 46. That is, a ground element 3103 is provided between conductive balance elements 3101 and 3102, and terminals 3104 and 3105, which are lowest portions of the balance element 3101 and 3102, are connected to the coaxial cables 3106 and 3107. Negative step voltage is supplied to the balance element 3101 via the coaxial cable 3106 and terminal 3104. On the other hand, positive step voltage is supplied to the balance element 3102 via the coaxial cable 3107 and terminal 3105. In this antenna 3100, though the distance between the ground element 3103 and the balance element 3101 or 3102 is gradually increased from the terminal 3104 or 3105 toward the outside, it is necessary to input different signals as described above to the balance elements 3101 and 3102, and in order to obtain desired characteristics, it is necessary to always use three elements, that is, the balance element 3101 and 3102 and the ground element 3103.

In addition, FIG. 47 shows a glass antenna device for an automobile telephone disclosed in JP-A-8-213820 (Patent document 4). In FIG. 47, a fan-shaped radiation pattern 3203 and a rectangular ground pattern 3204 are formed on a window glass 3202, a feed point A is connected to the core wire 3205*a* of a coaxial cable 3205, and a ground point B is connected to the outer conductor 3205*b* of the coaxial cable 3205. In this Patent document 4, the shape of the radiation pattern 3203 may be an isosceles triangular shape or a polygonal shape. Moreover, the shape of the radiation pattern 3203 may be a shape in which a shape similar to the fan shape, the isosceles triangular shape or the polygonal shape is respectively removed from the inside thereof. Furthermore, there is a description that the rectangle may be removed from the inside of the ground pattern 3204.

Furthermore, US-A-2002-122010A1 (Patent Document 5) discloses an antenna 3300 in which a tapered clearance area 3303 and a driven element 3302 whose feed point 3305 is connected to a transmission line 3304 are provided within a ground element 3301 as shown in FIG. 48. Incidentally, the gap between the ground element 3301 and the driven element 3302 is largest at the opposite side to the feed point 3305 on the driven element 3302, and the gap therebetween is smallest in the neighborhood of the feed point 3305. The driven element 3302 is equipped with a concavity at the opposite side to the feed point 3305 of the driven element 3302. The concavity itself is opposite to the ground element 3301, and it serves as means for adjusting the gap between the driven element 3302 and the ground element 3301. Incidentally, it discloses a shape without any concavities.

Besides, JP-A-2001-203521 (Patent document 6) discloses a microstrip patch antenna 3400 as shown in FIG. 49. The microstrip patch antenna 3400 is such that a ground plane 3404, a microstrip patch 3402, and a triangular pad (feed conductor) 3403 connected to the microstrip patch 3402 are formed of conductive metal on a dielectric substrate 3401. Incidentally, the microstrip patch 3402 is fed from a feed point 3405 through the triangular pad 3403 as a feed conductor. Although not shown, from the operation principle of the microstrip antenna, the microstrip patch antenna 3400 as shown in FIG. 49 is not suitably operated unless the ground is disposed opposite to the dielectric substrate 3401. Besides, since the area of the ground plane 3404 is very small, it is not conceivable that the ground plane functions as a radiant element. Further, in the microstrip antenna, a current flowing in the radiation conductor is not a direct radiation source, and in FIG. 49, a current flowing in the triangular pad 3403 and the microstrip patch 3402 does not serve as a direct radiation source. Besides, a reception frequency bandwidth of the microstrip patch antenna 3400 disclosed in the patent document 6 is as narrow as 200 MHz with respect to the center frequency of 1.8 GHz, the triangular pad 3403 does not function as the radiation conductor, and it is conceivable that the microstrip patch 3402 is a radiation conductor of a single frequency (1.8 GHz). As stated above, the microstrip patch antenna 3400 shown in FIG. 49 is a microstrip antenna and is not a monopole antenna in which a current flowing in the radiation conductor contributes to radiation. Besides, it is not a traveling-wave antenna in which the wide bandwidth is realized by continuously changing a current path flowing in a radiation conductor. Further, since the reception frequency bandwidth is single, it is not a dual band antenna.

Thus, although there are various antennas, the size of the conventional vertical mount type monopole antenna becomes large. In addition, vertically erecting the radiation conductor against the ground surface makes control of the distance between the radiation conductor and the ground surface difficult, and accordingly makes control of the antenna characteristics difficult. Furthermore, as for the conventional symmetric dipole antenna, because the two radiation conductors having the same shape are used, it is difficult to control the distance between the radiation conductors and to control the antenna characteristics. Still furthermore, as described above, even if a cut-out portion is provided for the radiation conductor of the vertical mount type monopole antenna, the improvement of the VSWR characteristic is not achieved. In addition, although the antenna shown in FIG. 45L resonates at frequencies lower than fL because of the element 3014*a*, and multiple resonances are achieved, the VSWR characteristic at frequencies lower than fL is poor, and the antenna characteristics presently required for the dual band antenna are not realized. Incidentally, in the patent documents 1 and 2, and non-patent documents 1 to 3, there is no description and suggestion for working the shape of the ground surface.

Besides, the special symmetric dipole antenna described in the patent document 3 has a problem on the implementation, in which a lot of elements and two kinds of signals, which are supplied to the elements, must be prepared. In addition, the ground pattern 3103 is opposite to the balance element 3101 and 3102, but the sides of the ground element 3103, which are opposite to the balance element 3101 and 3102, are straight lines. On the other hand, a side portion of the balance elements 3101 and 3102, which are opposite to the ground element 3103, is almost straight, too. Accordingly, the change of the distance between the ground element 3103 and the balance element 3101 or 3102 is straight.

In addition, in the glass antenna device for the automobile telephone in the patent document 4, the distance between the radiation pattern and the ground pattern straightly changes. Because the adjustment of the distance cannot be carried without change of the angle of the fan, the fine adjustment is impossible. Furthermore, although there is a description for removing the inside of the ground pattern, there is no disclosure as to processing an external form of the ground pattern to adjust the distance with the radiation pattern. Moreover, there is no disclosure for providing a cut-out.

In addition, though the antenna described in the patent document 5 aims at miniaturization, the structure that the driven element is provided within the ground element cannot achieve the sufficient miniaturization. Furthermore, if the driven element is surrounded by the ground element, the space between the ground element and the driven element should be large because the coupling between the ground element and the driven element becomes too strong. This prevents from the miniaturization of the antenna. Incidentally, the shape of the ground element does not have a tapered shape with respect to the driven element.

Further, with respect to the microstrip antenna disclosed in the patent document 6, although the shape appears to be such that both the triangular pad and the microstrip patch contribute to radiation, the triangular pad does not serve as the radiation conductor, but is merely the feed conductor. Thus, this antenna is the antenna in which the reception frequency bandwidth is single, and is not the dual band antenna.

Patent document 1
JP-A-57-142003
Patent document 2
JP-A-55-4109
Patent document 3
U.S. Pat. No. 6,351,246
Patent document 4
JP-A-8-213820
Patent document 5
USPA2002-1220101A1
Patent document 6
JP-A-2001-203521
Non-patent document 1
"B-77: BROADBAND CHARACTERISTICS OF SEMI-CIRCULAR ANTENNA COMBINED WITH LINEAR ELEMENT", Taisuke Ihara, Makoto Kijima and Koichi Tsunekawa, pp77 General Convention of The Institute of Electronics, Information and Communication Engineers, 1996
Non-patent document 2
"B-131 IMPROVED INPUT IMPEDANCE OF CIRCULAR DISC MONOPOLE ANTENNA", Satoshi Honda, Yuken Ito, Hajime Seki and Yoshio Jinbo, 2-131, SPRING NATIONAL CONVENTION of The Institute of Electronics, Information and Communication Engineers, 1992
Non-patent document 3
"WIDEBAND MONOPOLE ANTENNA OF CIRCULAR DISC", Satoshi Honda, Yuken Ito, Yoshio Jinbo and Hajime Seiki, Vol. 15, No. 59, pp. 25–30, Oct. 24, 1991 in "TECHNICAL REPORTS OF THE INSTITUTE OF TELEVISION"

SUMMARY OF THE INVENTION

In view of the foregoing problems, an object of the present invention is to provide an antenna having a novel shape that can be miniaturized and widened in bandwidth, a dielectric substrate for the antenna concerned, and a wireless communication card using the antenna concerned.

Furthermore, another object of the present invention is to provide an antenna having a novel shape that can be miniaturized and make it easy to control the antenna characteristic, a dielectric substrate for the antenna concerned, and a wireless communication card using the antenna concerned.

Still another object of the present invention is to provide an antenna having a novel shape that can be miniaturized and improved in characteristic in a low frequency range, a dielectric substrate for the antenna concerned, and a wireless communication card using the antenna concerned.

Besides, another object of this invention is to provide a dual band antenna having a novel shape, which enables miniaturization and has sufficient antenna characteristics, and a dielectric substrate for the dual band antenna.

An antenna according to a first aspect of the present invention comprises a ground pattern and a planar element that is fed, and whose cut-out portion is formed from an edge portion farthest from a feed position toward a ground pattern side, and the ground pattern and the planar element are juxtaposed with each other. By providing the cut-out portion, the miniaturization can be enabled, and a current path to obtain radiation in the low frequency range can be secured. In the conventional technique in which the radiation conductor is vertically erected to the ground surface, the antenna characteristic could not be controlled by the cut-out portion. However, according to this invention, the antenna characteristic can be controlled. Furthermore, since the ground pattern and the planar element are juxtaposed with each other, the mount volume of the antenna can be reduced, the antenna characteristic, particularly the impedance characteristic, can be easily controlled, and the wide bandwidth can be achieved.

Besides, the aforementioned planar element may be disposed so that an edge portion other than the cut-out portion provided in the planar element is opposite to the ground pattern. Because a section of the ground pattern and a section of the planar element are separated from each other, the miniaturization of the antenna can be facilitated. Furthermore, because other parts can be mounted on the ground pattern if the section of the ground pattern and the section of the planar element are separated from each other, the miniaturization can be enhanced also as a whole.

Furthermore, the aforementioned ground pattern may be formed without fully surrounding the edge portion of the planar element so that an opening is formed against at least part of an edge portion including the cut-out portion, of the planar element.

Incidentally, the cut-out portion may be designed to have a rectangular shape. However, the cut-out portion may be designed to have other shapes. Furthermore, the cut-out portion may be formed symmetrically with respect to a line passing through the feed position of the planar element.

Moreover, the aforementioned planar element may be designed to have such a shape that a bottom side thereof is opposite to the ground pattern, lateral sides thereof is provided vertically or substantially vertically to the bottom side and a top side thereof is equipped with the cut-out portion. Furthermore, both the corners of the bottom side may be splayed.

Furthermore, at least one of the planar element and the ground pattern may have a portion that causes to continuously vary the distance there between. Thus, the antenna characteristic, particularly the impedance characteristic, can be easily controlled and the bandwidth can be widened.

Furthermore, at least a part of the edge of the planar element, which is opposite to the ground pattern, may be designed to be curved.

Still furthermore, the planar element may be formed on the dielectric substrate. The further miniaturization is enhanced.

Incidentally, it can be said that the ground pattern and the planar element or the dielectric substrate are not opposite each other, and both the planes thereof are parallel or substantially parallel to each other. In addition, it can be said that the ground pattern and the planar element or the dielectric substrate are not completely overlapped with each other and both the planes thereof are parallel or substantially parallel to each other.

An antenna dielectric substrate according to a second aspect of the present invention has a layer formed of a dielectric material, and a layer containing a conductor having a cut-out portion formed from an edge portion nearest to a first side surface of the antenna dielectric substrate toward a second side surface opposite to the first side surface. By using such the dielectric substrate, a compact-size antenna having a wide bandwidth, particularly, having an excellent characteristic in a low frequency range, can be realized.

Incidentally, the cut-out portion may be designed in a rectangular shape. However, the shape of the cut-out portion may be other shape. Furthermore, the cut-out portion may be designed to have a symmetrical shape with respect to a line passing through the feed point of the conductor.

In addition, the aforementioned conductor may be designed to have such a shape that the side thereof nearest to the second side surface is a bottom side, lateral sides thereof are provided vertically or substantially vertically to the bottom side and the top side nearest to the first side surface is equipped with the cut-out portion. Incidentally, both the corners of the bottom side may be splayed.

In addition, the edge portion of the conductor, which is nearest to the second side surface, may have a portion, which continuously varies the distance with the second side surface. Furthermore, the conductor may have a connection portion to be connected to an electrode provided on at least the second side surface.

An antenna according to a third aspect of the invention comprises a planar element that is fed; and a ground pattern being juxtaposed with the planar element, and by trimming the ground pattern, a continuous varying portion making a distance between the planar element continuously vary and the ground pattern is provided. By providing the continuous varying portion, it is possible to appropriately adjust the coupling degree with the antenna element, thereby it is possible to widen the bandwidth.

An antenna according to a fourth aspect of the invention comprises a planar element that is fed; and a ground pattern being juxtaposed with the planar element, and the ground pattern has a tapered shape against a feed position of the planar element. Thus, by providing the tapered shape, it is possible to appropriately adjust the coupling degree with the antenna element, thereby it is possible to widen the bandwidth.

In addition, the tapered shape may be composed of any one of segments, curved lines being convex upwardly, and curved lines being convex downwardly. This is because the tapered shape is formed in accordance with the shape of the planar element and/or the desired characteristic.

Furthermore, the tapered shape may be designed to have a symmetrical shape with respect to a line passing through the feed position of the planar element. Moreover, it is also possible to form a concavity to accommodate a portion for feeding to the feed position of the planar element at a tip of the tapered shape.

In addition, the aforementioned planar element may be formed in or on a dielectric substrate, and the ground pattern may be formed in or on a resin board, and the dielectric substrate may be mounted on the resin board. When the planar element is formed in or on the dielectric substrate, the size of the antenna can be further miniaturized. Incidentally, when the planar element substrate is formed in or on the dielectric substrate, the coupling with the ground pattern becomes strong. However, by adopting the tapered shape, it is possible to appropriately adjust the coupling degree, thereby the wide bandwidth can be achieved.

Furthermore, the aforementioned planar element may have a cut-out portion formed from an edge portion farthest from the feed position toward the ground pattern side. Even in a case where the planar element is miniaturized, by forming the cut-out portion, the length of the current path on the planar element is sufficiently secured, thereby the bandwidth is widened in a low frequency side.

In addition, the aforementioned planar element may have a shape in which a bottom side thereof is opposite to the ground pattern, and lateral sides thereof are provided vertically or substantially vertically to the bottom side and the cut-out portion is provided in a top side thereof. Though there is a limit of the miniaturization as to the planar element in order to secure the characteristic of the low frequency range, the miniaturization and the wide bandwidth are enabled if the above-described structure of the planar element is adopted. Incidentally, at that time, the tapered shape of the ground pattern enables to wholly enhance the impedance characteristics.

In addition, the dielectric substrate on which the planar element is formed may be mounted at an upper end on the resin board, and the ground pattern may be formed to have a region extending toward at least either of a right side and a left side of the dielectric substrate. By providing such a region for the ground pattern, the bandwidth in the low frequency side can be widened.

Furthermore, the dielectric substrate on which the planar element is formed may be mounted at least either of a right upper end and a left upper end on the resin board, and the ground pattern may be formed to have a region extending toward an opposite side to a side in which the dielectric substrate is mounted.

An antenna according to a fifth aspect of this invention comprises: a dielectric substrate on which a planar element is integrated formed; and a board on which the dielectric substrate is mounted, and in or on which a ground pattern is formed to be juxtaposed with the dielectric substrate, and the ground pattern has a tapered shape with respect to a feed position of the planar element, and the planar element has a cut-out portion formed from an edge portion farthest from the feed position toward a side of the juxtaposed ground pattern.

In addition, the dielectric substrate may be mounted on an upper end on the board, and the ground pattern may be formed to provide a region extending toward at least either of the left and right of the dielectric substrate. Furthermore, two dielectric substrates may be respectively disposed on a right upper end on the board, and on a left upper end on the board with a distance of a quarter wavelength, and the ground pattern may have a region to separate the two dielectric substrates.

A wireless communication card according to a sixth aspect of this invention comprises: a dielectric substrate on which a planar element is formed; a board on which the dielectric substrate is mounted, and in or on which a ground pattern juxtaposed with the dielectric substrate is formed, and a tapered shape is formed in the ground pattern against a feed position of the planar element, and the cut-out portion is provided for the planar element from an edge portion farthest from the feed position toward the juxtaposed ground pattern side.

An antenna according to a seventh aspect of the invention comprises a ground pattern; and a planar element that is fed and whose edge portion opposite to the ground pattern has a continuous varying portion that makes a distance with the ground pattern vary and is composed of at least either one of a curved line and line segments which are connected while their inclinations are changed stepwise, and the ground pattern are juxtaposed with the planar element without fully surrounding the edge portion of the planar element.

Incidentally, at the aforementioned continuous varying portion, the distance with the ground pattern may be gradually increased as being farther away from the feed position of the planar element. Besides, at least a part of the aforementioned continuous varying portion may be composed of an arc.

Moreover, at least a part of the edge portion of the aforementioned planar element, which is other than the continuous varying portion, may be formed so as to be opposite to the ground pattern side.

Furthermore, the aforementioned ground pattern may be formed so as to have an opening for at least a part of the edge portion of the planar element, which is other than the continuous varying portion. The external form of the ground pattern is adjusted according to various factors; however, the ground pattern may be formed so as not to be directly opposite to at least a part of the edge portion of the planar element, which is other than the continuous varying portion.

In addition, the planar element may have a cut-out portion formed from the edge portion farthest from the feed position of the planar element toward the ground pattern side. This achieves the miniaturization of the planar element and the improvement of the characteristic in the low frequency range.

Incidentally, at least a part of the edge portion of the planar element, which includes the cut-out portion, may be formed at a position that is not opposite to the ground pattern.

In addition, a tapered shape with respect to the feed position of the planar element may be formed for the ground pattern.

Incidentally, the planar element may be symmetric with respect to a straight line passing through the feed position of the planar element. In addition, the distance between the ground pattern and the planar element may be symmetric with respect to the straight line passing the feed position of the planar element.

Furthermore, the planar element may be integrated formed in or on a dielectric substrate and the distance with the ground pattern may be saturated increased at the continuous varying portion as being farther away from the feed position of the planar element.

An antenna according to an eighth aspect of the invention comprises a ground pattern; and a planar element that is fed and whose edge portion opposite to the ground pattern has a continuous varying portion that makes a distance with the ground pattern vary and is composed of at least either one of a curved line and line segments which are connected while their inclinations are changed stepwise, and the ground pattern is disposed without fully surrounding the edge portion of the planar element, and the planar element and the ground pattern are disposed without complete overlap with each other, and respective planes thereof are parallel or substantially parallel to each other.

An antenna according to a ninth aspect of the invention comprises a ground pattern; and a planar element that is fed and whose edge portion opposite to the ground pattern has a continuous varying portion at which a distance with the ground pattern is gradually increased from the feed position, and the ground pattern is juxtaposed with the planar element without fully surrounding the edge portion of the planar element.

An antenna according to a tenth aspect of this invention includes a planar element that is fed at a feed position, and a ground pattern that is juxtaposed with the planar element, and as being farther away from a straight line passing through the feed position, a distance between the planar element and the ground pattern is continuously increased to become saturated.

Besides, a side edge portion of the planar element may be constituted by either one of a curved line and line segments which are connected while their inclinations are changed stepwise, and the planar element may be formed on or inside a dielectric substrate for an antenna.

When the planar element is formed on or inside the dielectric substrate for the antenna, further miniaturization of the antenna becomes possible. However, when the planar element is formed on or inside the dielectric substrate for the antenna, the coupling between the planar element and the ground pattern becomes strong, and the adjustment of the distance between them becomes necessary. Then, the shape of the side edge portion of the planar element is formed as stated above, and the distance between the planar element and the ground pattern is adjusted, so that the coupling degree is optimized, and the wide bandwidth can be realized.

Besides, a side of the ground pattern opposite to the dielectric substrate for the antenna may be constituted by a line segment. This indicates a case where the adjustment of the distance between the planar element and the ground pattern is mainly performed by the shape of the planar element.

Further, the ground pattern may have a tapered shape with respect to the dielectric substrate for the antenna, and the tapered shape may be constituted by line segments.

Furthermore, the planar element may be symmetrical with respect to the straight line passing through the feed position of the planar element.

In addition, the dielectric substrate for the antenna may further include a resonant element connected to an end point of the planar element on the straight line passing through the feed position. By providing the resonant element as stated above, a dual band antenna can be realized.

Besides, the resonant element may be symmetrical with respect to the straight line passing through the feed position of the planar element. Besides, it may be asymmetrical.

In addition, the planar element and the resonant element may be formed in a same layer of the dielectric substrate for the antenna.

Furthermore, the planar element and at least a part of the resonant element may be formed in different layers. By this structure, the dielectric substrate for the antenna can be miniaturized and the antenna can also be miniaturized as a whole.

Besides, when the planar element and the resonant element are projected on a virtual plane parallel to the layers in which the respective elements are formed, the resonant element may be disposed without overlapping with a predetermined region defined beside the planar element projected on the virtual plane. Besides, the resonant element may be disposed without overlapping with at least a region at a planar element side with respect to a half line, which is parallel to the straight line passing through the feed position of the planar element projected on the virtual plane and extends in a feed position direction from a start point that is an end point of the side edge portion of the projected planar element and is a point remoter from the feed position.

By disposing the resonant element as stated above, the characteristics of the planar element and the resonant element can be separately controlled without exerting a bad influence on the characteristic of the planar element.

A dielectric substrate for an antenna according to a eleventh of this invention comprises a dielectric layer, and a layer including a conductive planar element having a side edge portion constituted by either one of a curved line and line segments, which are connected while their inclinations are changed stepwise, and a distance between a side surface closest to a feed position of the planar element among side surfaces of the dielectric substrate for the antenna and the side edge portion is gradually increased to become saturated as being farther away from a straight line passing through the feed position.

Besides, the aforementioned planar element may be symmetrical with respect to the straight line passing through the feed position of the planar element.

Further, the eleventh aspect of this invention may further include a resonant element connected to an end point of the planar element on the straight line passing though the feed position of the planar element.

By providing the resonant element as stated above, a dual band antenna can be realized.

Besides, the resonant element may be symmetrical with respect to the straight line passing through the feed position of the planar element. Besides, it may be asymmetrical.

Further, the planar element and the resonant element may be formed in a same layer of the dielectric substrate.

Besides, the planar element and at least a part of the resonant element may be formed in different layers of the dielectric substrate. By this structure, the dielectric substrate for the antenna can be miniaturized.

Further, when the planar element and the resonant element are projected on a virtual plane parallel to the layers in which the respective elements are formed, the resonant element may be disposed without overlapping with a predetermined region defined beside the planar element projected on the virtual plane. Besides, the resonant element may be disposed without overlapping with at least a region at a planar element side with respect to a half line, which is parallel to the straight line passing through the feed position of the planar element projected on the virtual plane and extends in a feed position direction from a start point that is an end point of the side edge portion of the projected planar element and is a point remoter from the feed position.

By disposing the resonant element as stated above, the characteristics of the planar element and the resonant element can be separately controlled without exerting a bad influence on the characteristic of the planar element.

An antenna according to a twelfth aspect of the present invention comprises a dielectric substrate on which a planar element, which is fed at a feed position, is integrated formed; and a ground pattern that is juxtaposed with the dielectric substrate and has a tapered shape with respect to the feed position, and the planar element has a cut-out portion formed from an edge portion farthest from the feed position toward the ground pattern side.

A wireless communication card according to a thirteenth aspect of the present invention comprises a dielectric substrate on which a planar element, which is fed at a feed position, is integrated formed; and a board on which the dielectric substrate is mounted, and on or in which a ground pattern, which is juxtaposed with the planar element, is formed, and the dielectric substrate is mounted on an edge portion of the board, and the ground pattern has a tapered shape with respect to a feed position of the planar element, and is formed to provide a region extending toward at least either of the left and right of the dielectric substrate, and the planar element has a cut-out portion formed from an edge portion farthest from the feed position toward a side of the juxtaposed ground pattern.

BEST MODE FOR CARRYING OUT THE INVENTION

[Embodiment 1]

Figure 1A:
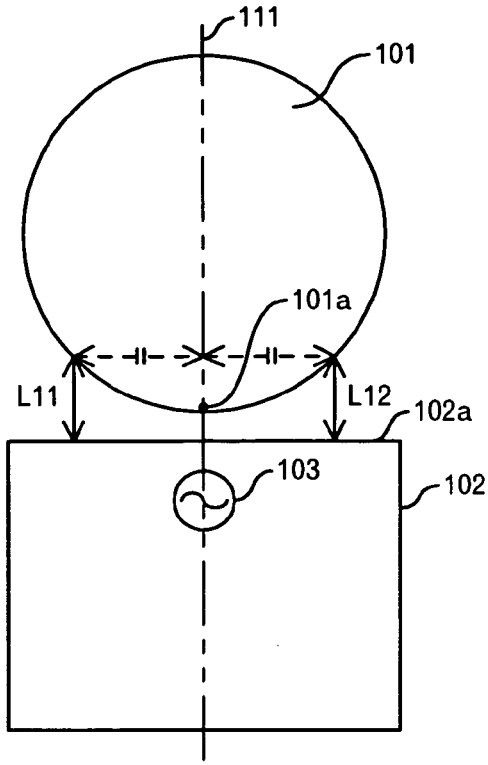
FIG. 1A is a front view showing the structure of an antenna according to a first embodiment.
Figure 1B:
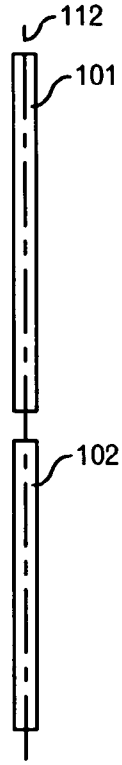
FIG. 1B is a side view of the antenna shown in FIG. 1A.

The structure of an antenna according to a first embodiment of the present invention is shown in FIG. 1A and FIG. 1B. As shown in FIG. 1A, the antenna according to the first embodiment is composed of a planar element 101, which is a circular flat conductor, a ground pattern 102 juxtaposed with the planar element 101, and a high frequency power source 103. The planar element 101 is connected with the high frequency power source 103 at a feed point 101*a*. The feed point 101*a* is located at such a position that the distance between the planar element 101 and the ground pattern 102 is shortest.

Moreover, the planar element 101 and the ground pattern 102 are designed symmetrically with respect to a line 111 passing through the feed point 101*a*. Accordingly, the shortest distance from any point on the arc of the planar element 101 to the ground pattern 102 is also designed to be symmetrical with respect to the line 111. That is, if the distance from the line 111 to each of two points on the arc of the planar element 101 is the same, the shortest distances L11 and L12 from each of the two points on the arc of the planar element 101 to the ground pattern 102 are the same.

In this embodiment, a side 102*a* of the ground pattern 102 opposite to the edge of the planar element 101 is a line. Accordingly, the shortest distance between an arbitrary point on the downward arc of the planar element 101 and the side 102*a* of the ground pattern 102 increases curvedly along the arc as being farther away from the feed point 101*a*.

Moreover, according to this embodiment, the planar element 101 is disposed on the centerline 112 of the ground pattern 102 as shown in FIG. 1B. Accordingly, in this embodiment, the planar element 101 and the ground pattern 102 are located on the same plane. However, they are not necessarily located on the same plane, and they may be disposed so that the planes thereof are parallel or substantially parallel to each other.

Incidentally, in this embodiment, the ground pattern 102 is formed without surrounding the planar element 101, and the antenna is separated into the ground pattern 102 side and the planar element 101 side up and down. That is, though the size of a certain degree is necessary, the ground pattern 102 can be formed regardless of the size of the planar element 101. Further, by providing an electrical insulation layer, other parts can be mounted on the ground pattern 102. Accordingly, the substantial size of the antenna is determined according to the size of the planar element 101. In addition, the upward arc of the planar element 101, which is opposite to the downward arc, is an edge portion that does not directly face the ground pattern 102, and though it depends on the installation place or the like, at least a part of this portion is not surrounded by the ground pattern 102, and is disposed so as to face toward a direction of an opening provided at the ground pattern 102.

Figure 2:
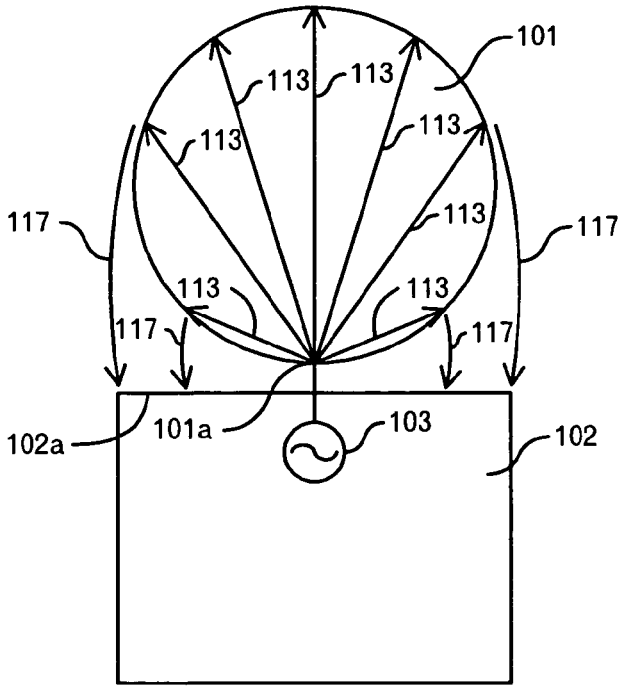
FIG. 2 is a diagram to explain the principle of the operation of the antenna according to the first embodiment.

As for the operation principle of the antenna shown in FIGS. 1A and 1B, each current path 113 spreading radically from a feed point 101*a* to the circumference of the planar element 101 forms a resonance point as shown in FIG. 2. Therefore, continuous resonance characteristics can be achieved, and the bandwidth can be widened. In the case of FIGS. 1A and 1B, since the current path corresponding to the diameter of the planar element 101 is longest, the frequency at which the length of the diameter corresponds to a quarter wavelength is almost equal to the lower limit frequency and such continuous resonance characteristics can be achieved at the lower limit frequency or more. Therefore, electromagnetic coupling 117 due to current flowing on the planar element 101 occurs between the planar element 101 and the ground pattern 102 as shown in FIG. 2. That is, when the frequency is lower, the current path 113 contributing to the radiation erects vertically to a side 102*a* of the ground pattern 102, and coupling with the ground pattern 102 occurs in a wide range. On the other hand, when the frequency is higher, the current path is inclined toward the horizontal direction, so that coupling with the ground pattern 102 occurs in a narrow range. It is considered that the coupling with the ground pattern 102 corresponds to a capacitance component C in an impedance equivalent circuit of an antenna, and the value of the capacitance component C varies in accordance with the degree of inclination of the current path in the high and low frequency ranges. When the value of the capacitance component C varies, it greatly affects the impedance characteristic of the antenna. More specifically, the capacitance component C relates to the distance between the planar element 101 and the ground pattern 102. On the contrary, when the disc is erected vertically to the ground surface, the distance between the ground surface and the disc cannot be minutely controlled. When the planar element 101 is juxtaposed with the ground pattern 102 as shown in FIGS. 1A and 1B, the capacitance component C in the impedance equivalent circuit of the antenna can be changed by altering the shape of the ground pattern 102. Accordingly, the antenna can be designed to achieve a preferable antenna characteristic.

Figure 3:
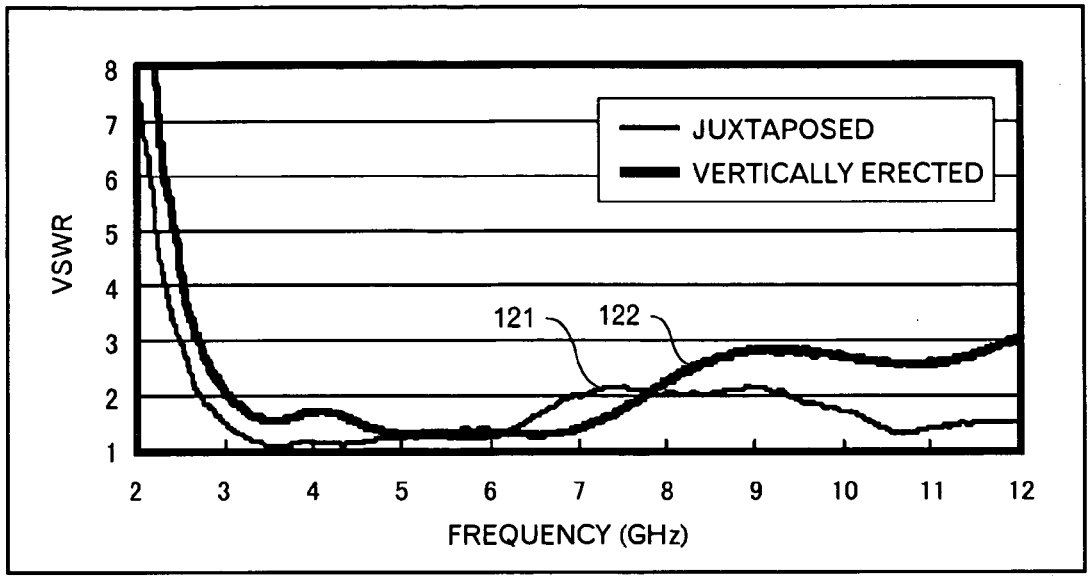
FIG. 3 is a diagram to compare the impedance characteristics of the antenna in the first embodiment of the invention and an antenna according to the background art.

Moreover, comparing with a case where the disc is erected vertically to the ground surface, there is an effect in which the bandwidth can be further widened. FIG. 3 shows a graph of the impedance characteristics in a case where the planar element 101 is erected vertically to the ground surface like the background art, and the impedance characteristics of the antenna according to this embodiment. In FIG. 3, an axis of ordinate represents VSWR, and an axis of abscissa represents the frequency (GHz). Apparently, the value of VSWR in the background art, which is represented by a thick line 122, becomes worse in a high frequency range not less than 8 GHz. On the other hand, though the value of VSWR slightly exceeds 2 at some frequency ranges, the value of VSWR of the antenna according to this embodiment, which is represented by a solid line 121, is less than 2 from about 2.7 GHz to the high frequency range, which is more than 10 GHz, when excluding those rages. Thus, not only the effect in which the distance between the planar element 101 and the ground pattern 102 is easily controlled, but also the effect in which the bandwidth is stably widened can be achieved by the "juxtaposition" of the planar element 101 and the ground pattern 102.

Incidentally, the planar element 101 of this embodiment may be considered as a radiation conductor of a monopole antenna. On the other hand, since the ground pattern 102 of the antenna of this embodiment partially contributes to radiation, the antenna of this embodiment is also considered as a dipole antenna. However, since the dipole antenna normally uses two radiation conductors having the same shape, the antenna of this embodiment may be called as an asymmetrical dipole antenna. Furthermore, the antenna of this embodiment is considered as a traveling wave antenna. Such considerations can be applied to all the embodiments described below.

[Embodiment 2]

Figure 4:
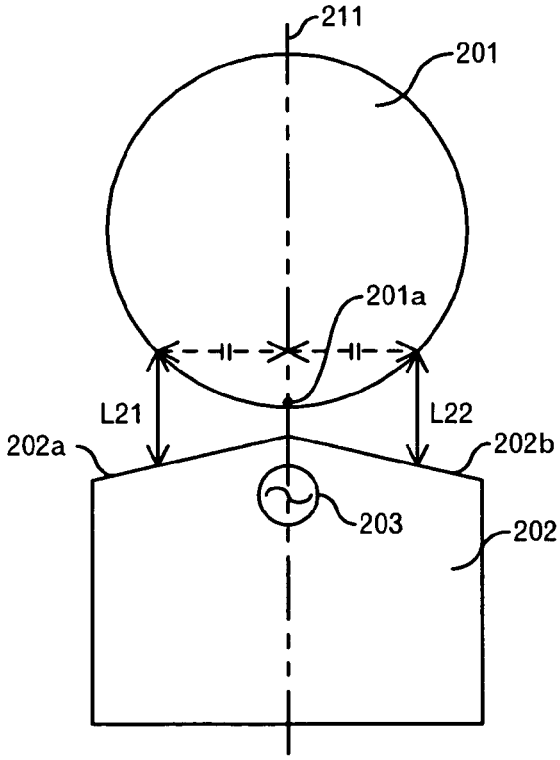
FIG. 4 is a diagram showing the structure of an antenna according to a second embodiment.

The structure of an antenna according to a second embodiment of the present invention is shown in FIG. 4. Similarly to the first embodiment, this antenna is composed of a planar element 201, which is a circular conductive plate, a ground pattern 202 juxtaposed with the planar element 201, and a high frequency power source 203 connected to a feed point 201*a* of the planar element 201. The feed point 201*a* is located at such a position that the distance between the planar element 201 and the ground pattern 202 is shortest.

Besides, the planar element 201 and the ground pattern 202 are symmetrical with respect to a straight line 211 passing through the feed point 201*a*. Furthermore, the length (hereinafter referred to as "distance") of a line segment extending from any point on the arc of the planar element 201 to the ground pattern 202 in parallel with the line 211 is also symmetric with respect to the line 211. That is, if the distances from the straight line 211 are the same, the distances L21 and L22 extending from any point of the arc of the planar element 201 to the ground pattern 202 are the same.

In this embodiment, sides 202*a* and 202*b* of the ground pattern 202, which face the planar element 201, are inclined so that the distance between the planar element 201 and the ground pattern 202 is further gradually increased as being farther away from the straight line 211. That is, at the ground pattern 202, a tapered shape is formed with respect to the feed point 201*a* of the planar element 201. Therefore, the distance between the planar element 201 and the ground pattern 202 is extremely increased more than a curved line defined by the arc. Incidentally, the inclination of the sides 202*a* and 201*b* must be adjusted to obtain the desired antenna characteristic.

Namely, as described in the first embodiment, by changing the distance between the planar element 201 and the ground pattern 202, it is possible to change the capacitance component C in the impedance equivalent circuit of the antenna. As shown in FIG. 4, the gap between the planar element 201 and the ground pattern 202 is widened outwardly, and therefore, the volume of the capacitance component C becomes small as compared with the first embodiment. Accordingly, the inductance component L in the impedance equivalent circuit becomes relatively effective. Thus, by controlling the impedance, the desired antenna characteristic can be obtained. The antenna shown in FIG. 4 also achieves the wide bandwidth.

Also in this embodiment, the ground pattern 202 is formed without surrounding the planar element 201 and the antenna is separated into the ground pattern 202 side and the planar element 201 side up and down. In addition, the upward arc of the planar element 201, which is opposite to the downward arc, is an edge portion that does not directly face the ground pattern 202, and though it depends on the installation place or the like, at least a part of this portion is not surrounded by the ground pattern 202.

In addition, the side structure of the antenna according to this embodiment is almost the same as that shown in FIG. 1B. That is, the planar element 201 and the ground pattern 202 are disposed on the same plane in this embodiment. However, they are not necessarily located on the same plane, and they may be disposed so that the planes thereof are parallel or substantially parallel to each other.

[Embodiment 3]

Figure 5:
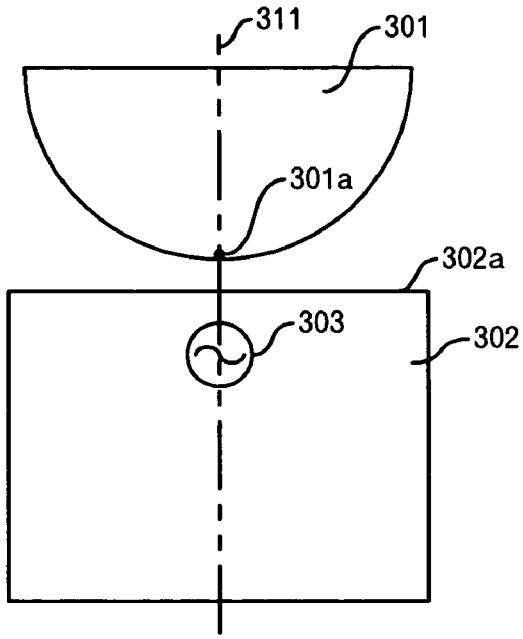
FIG. 5 is a diagram showing the structure of an antenna according to a third embodiment.

The structure of an antenna according to a third embodiment of the present invention is shown in FIG. 5. The antenna according to this embodiment is composed of a planar element 301, which is a semicircular conductive flat plate, a ground pattern 302 juxtaposed with the planar element 301, and a high frequency power source 303 connected with a feed point 301*a* of the planar element 301. The feed point 301*a* is located at a position in which the distance between the planar element 301 and the ground pattern 302 is shortest.

Moreover, the planar element 301 and the ground pattern 302 are designed symmetrically with respect to a line 311 passing through the feed point 301*a*. Accordingly, the shortest distance from any point on the arc of the planar element 301 to the ground pattern 302 is also designed to be symmetrical with respect to the line 311. That is, if the distance from the line 311 to each of two points on the arc of the planar element 301 is the same, the shortest distance from each of the two points on the arc of the planar element 301 to the ground pattern 302 is the same.

In this embodiment, a side 302*a* of the ground pattern 302 opposite to the edge of the planar element 301 is a straight line. Accordingly, the shortest distance between arbitrary point on the arc of the planar element 301 and the side 302*a* of the ground pattern 302 increases curvedly along the arc as being farther away from the feed point 301*a*.

In addition, the side structure of the antenna according to this embodiment is almost the same as that shown in FIG. 1B. That is, the planar element 301 and the ground pattern 302 are located on the same plane in this embodiment. However, they are not necessarily located on the same plane, and they may be disposed so that the planes thereof are parallel or substantially parallel to each other.

Also in this embodiment, the ground pattern 302 is formed without surrounding the planar element 301, and the antenna is separated into the ground pattern 302 side and the planar element 301 side up and down. In addition, the straight line of the planar element 301, which is opposite to the downward arc, is an edge portion that does not directly face the ground pattern 302, and though it depends on the installation place or the like, an opening toward the outside of the antenna is formed at the ground pattern 302 for at least a part of this portion.

The frequency characteristic of the antenna in this embodiment can be controlled by the radius of the planar element 301 and the distance between the planar element 301 and the ground pattern 302. By the radius of the planar element 301, the lower limit frequency is almost determined. Incidentally, similarly to the second embodiment, it is possible to change a form of the ground pattern 302 so as to be tapered. The wide bandwidth is achieved also in this antenna of this embodiment.

[Embodiment 4]

Figure 6:
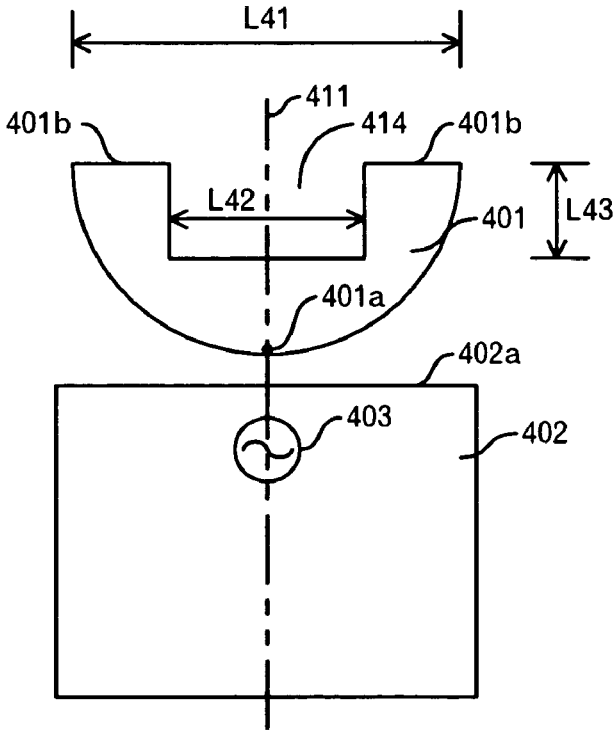
FIG. 6 is a diagram showing the structure of an antenna according to a fourth embodiment.

The structure of an antenna according to a fourth embodiment of the present invention is shown in FIG. 6. The antenna according to this embodiment is composed of a planar element 401 formed of a semicircular conductive flat plate and having a cut-out portion 414, a ground pattern 402 juxtaposed with the planar element 401, and a high-frequency power source 403 connected to a feed point 401*a* of the planar element 401. The diameter L41 of the planar element 401 is set to 20 mm, for example. The aperture L42 of the cut-out portion 414 is set to 10 mm, for example, and the rectangular concavity whose depth is L43 (=5 mm) is formed from the top portion 401*b* (i.e. the edge portion farthest from the feed point 401*a*) of the planar element 401 toward the ground pattern 402 side, for example. The feed point 401*a* is located at such a position that the distance between the planar element 401 and the ground pattern 402 is shortest.

The planar element 401 and the ground pattern 402 are designed symmetrically with respect to a line 411 passing through the feed point 401*a*, and also the cut-out portion 414 is designed to be symmetrical with respect to the line 411. Furthermore, the shortest distance from any point on the arc of the planar element 401 to the ground pattern 402 is also symmetrical with respect to the line 411. That is, if the distance from the line 411 to each of two points on the arc of the planar element 401 is the same, the shortest distance from each of the two points on the arc of the planar element 401 to the ground pattern 402 is the same.

In this embodiment, a side 402*a* of the ground pattern 402 opposite to the edge of the planar element 401 is a line. Accordingly, the shortest distance between an arbitrary point on the arc of the planar element 401 and the side 402*a* of the ground pattern 402 gradually increases curvedly along the arc as being farther away from the feed point 401*a*. That is, the antenna according to this embodiment is equipped with a continuous varying portion at which the distance between the planar element 401 and the ground pattern 402 is continuously varied. By providing such a continuous varying portion, the coupling degree between the planar element 401 and the ground pattern 402 is adjusted. By adjusting the coupling degree, especially, the bandwidth at a high frequency side can be widened.

In addition, the side structure of the antenna according to this embodiment is almost the same as that shown in FIG. 1B, and the planar element 401 is disposed on a centerline of the ground pattern 402. Accordingly, in this embodiment, the planar element 401 and the ground pattern 402 are located on the same plane. However, they are not necessarily located on the same plane, and they may be disposed so that the planes thereof are parallel or substantially parallel to each other.

Furthermore, according to this embodiment, the planar element 401 is disposed so that the edge portion other than the cut-out portion 414 provided in the planar element 401 is opposite to the ground pattern 402. On the contrary, the edge portion at which the cut-out portion 414 is provided does not face the ground pattern 402, and is also not surrounded by the ground pattern 402. That is, since the planar element 401 portion and the ground pattern 402 portion are clearly separated from each other, it is unnecessary to provide an useless area of the ground pattern 402 and the miniaturization is facilitated. In addition, if the ground pattern 402 portion and the planar element 401 portion are separated from each other, other parts can be mounted on the ground pattern 402, thereby the miniaturization can be also enhanced.

Next, the operation principle of the antenna according to this embodiment is considered. Comparing with the first embodiment, since the basic shape of the planar element is changed from the circular shape to the semicircular shape, the length of the current path is shorter than in the case where the circular planar element is used. Though some current paths are longer than the radius of the circle, the frequency at which the length of the radius of the circle corresponds to the quarter wavelength is almost equal to the lower limit frequency. Therefore, there occurs a problem that the characteristic especially in the low frequency range is lowered due to the effect of the miniaturization.

Figure 7:
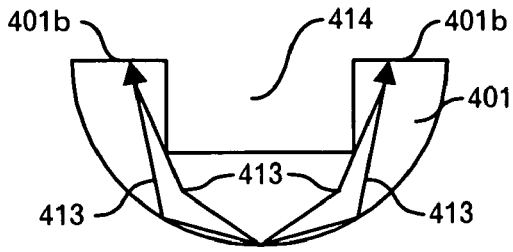
FIG. 7 is a diagram to explain the principle of the operation of the antenna according to the fourth embodiment.

Therefore, by providing the cut-out portion 414 for the planar element 401 like this embodiment, the current is prevented from linearly flowing from the feed point 401*a* to the top portion 401*b* by the cut-out portion 414, and detours around the cut-out portion 414 as shown in FIG. 7. As described above, since the current path 413 is formed so as to detour around the cut-out portion 414, it becomes longer, and the lower limit frequency of the radiation can be lowered. Accordingly, the bandwidth can be widened.

With respect to the antenna of this embodiment, the antenna characteristic can be controlled by the shape of the cut-out portion 414 and the distance between the planar element 401 and the ground pattern 402. However, it has been known that it is impossible to control the antenna characteristic by the cut-out portion in such an antenna that a radiation conductor is erected vertically to the ground surface like the background art (see the non-patent document 1). On the other hand, if the planar element 401 and the ground pattern 402 are juxtaposed with each other like this embodiment, the antenna characteristic can be controlled by the cut-out portion 414.

Figure 8:
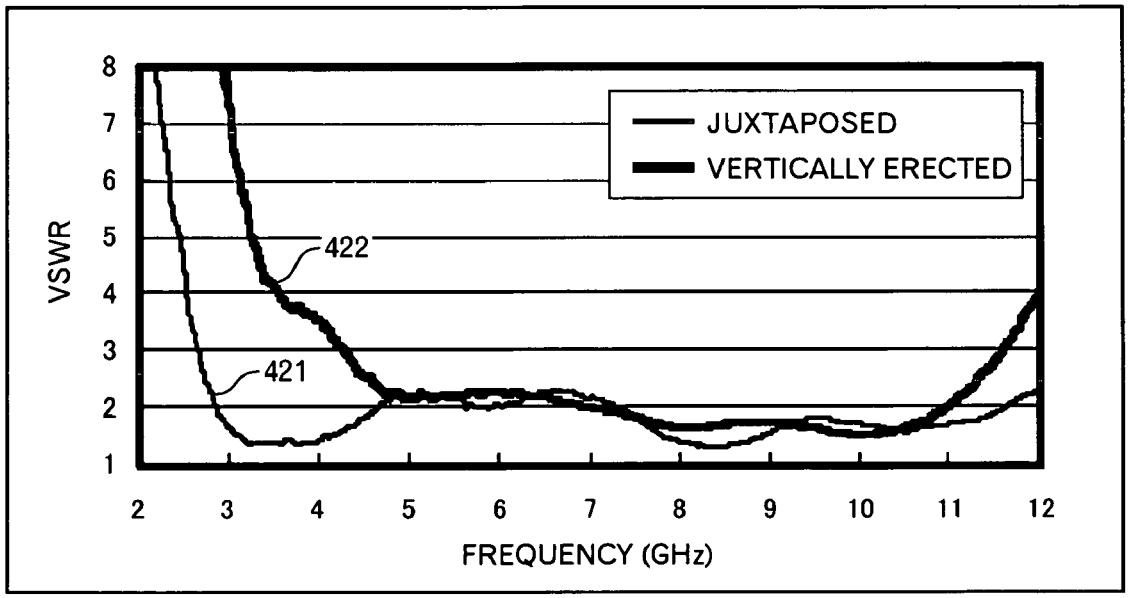
FIG. 8 is a diagram to compare the impedance characteristics of the antenna in the fourth embodiment of the invention and an antenna according to the background art.

FIG. 8 is a graph showing the impedance characteristic when the planar element 401 is erected vertically to the ground surface like the background art, and also the impedance characteristic of the antenna according to this embodiment shown in FIG. 6. In FIG. 8, the axis of ordinate represents VSWR, and the axis of abscissa represents the frequency (GHz). In the frequency characteristic of the antenna according to this embodiment represented by a solid line 421, the value of VSWR becomes less than 2 at a frequency range from about 2.8 GHz to about 5 GHz, and slightly exceeds 2 at a frequency range from about 5 GHz to about 7 GHz, but is almost equal to about 2 at a frequency range from about 7 GHz to about 11 GHz or higher. On the other hand, in the frequency characteristic of the antenna according to the background art represented by a thick line 422, VSWR does not have the same values as this embodiment at frequencies lower than about 5 GHz, and the value of VSWR extremely increases at frequencies higher than 11 GHz. That is, this graph exhibits a remarkable effect of the antenna of this embodiment that the characteristic is more excellent in the low frequency range and the high frequency range.

As described above, there is not only an effect that the distance between the planar element 401 and the ground pattern 402 can be easily controlled, but also an effect that the bandwidth can be stably widened by the "juxtaposition" of the planar element 401 and the ground pattern 402. In addition, the planar element 401 can be miniaturized by the cut-out portion 414.

Incidentally, it is not shown, but the shape of the portion of the ground pattern 402, which is opposite to the planar element 401, may be changed so as to be tapered. It is possible for not only the cut-out portion 414 but also the shape of the top edge portion of the ground pattern 402 to control the antenna characteristic.

Furthermore, the shape of the cut-out portion 414 is not limited to the rectangular shape. For example, an inverted triangular cut-out portion 414 may be used. In this case, the feed point 401*a* and one apex of the inverted triangle are arranged to be located on the line 411. Still furthermore, the cut-out portion 414 may be designed in a trapezoidal shape. In the case of the trapezoid, if the bottom side is designed to be longer than the top side, the detour length at which the current path detours around the cut-out portion 414 is increased. Accordingly, the current path in the planar element 401 can be more increased. The corners of the cut-out portion 414 may be rounded.

[Embodiment 5]

Figure 9:
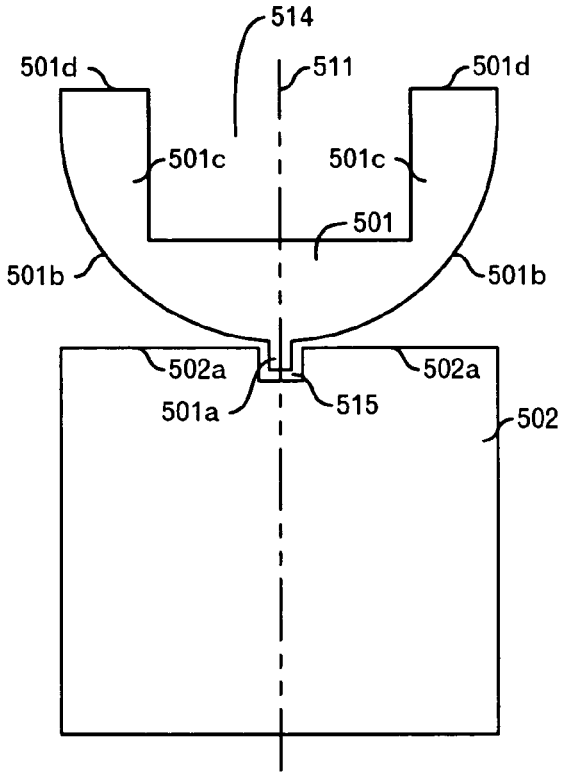
FIG. 9 is a diagram showing the structure of an antenna according to a fifth embodiment.

FIG. 9 shows the structure of an antenna according to a fifth embodiment of the present invention. In this embodiment, an example will be explained in which a planar element 501 which is formed of a semicircular conductive flat plate and is equipped with a cut-out portion 514, and a ground pattern 502 are formed on a printed circuit board (for example, a resin board made of FR-4, Teflon (registered trademark) or the like) having a dielectric constant of 2 to 5.

The antenna according to the fifth embodiment comprises the planar element 501, the ground pattern 502 juxtaposed with the planar element 501, and a high-frequency power source connected to the planar element 501. Incidentally, the high-frequency power source is omitted from the illustration of FIG. 9. The planar element 501 is equipped with a projecting portion 501*a* which is connected to the high-frequency power source and constitutes a feed point, a curved portion 501*b* opposite to aside 502*a* of the ground pattern 502, a rectangular cut-out portion 514 concaved from the top portion 501*d* toward the ground pattern 502, and arm portions 501*c* for securing current paths for low frequencies. The structure of the side is almost the same as FIG. 1B. That is, the planar element 501 and the ground pattern 502 do not completely overlap with each other, and both the planes thereof are parallel or substantially parallel to each other.

The ground pattern 502 is equipped with a recess 515 in which the projecting portion 501*a* of the planar element 501 is accommodated. Accordingly, the side 502*a* opposite to the planar element 501 is not straight, but is divided into two sides. Incidentally, the antenna according to this embodiment is designed to be symmetrical with respect to the line 511 passing through the center of the projecting portion 501*a*, which is the feed position. That is, the cut-out portion 514 is also symmetrical. The distance between the curved line 501*b* of the planar element 501 and the side 502*a* of the ground pattern 502 is gradually increased as being farther away from the line 511.

Also in this embodiment, the ground pattern 502 is formed without surrounding the planar element 501, and the antenna is separated into the ground pattern 502 side and the planar element 501 side up and down, excluding portions of the projecting potion 501*a* and the recess 515. In addition, the cut-out portion 514 and the top portion 501*d* of the planar element 501 are edge portions that is not directly opposite to the ground pattern 502, and though it depends on the installation place or the like, an opening toward the outside of the antenna is formed at the ground pattern 502 for at least a part of this portion.

Incidentally, the shape of the cut-out portion 514 is not limited to the rectangle, and the shape of the cut-out portion as described with respect to the fourth embodiment may be adopted.

Figure 10:
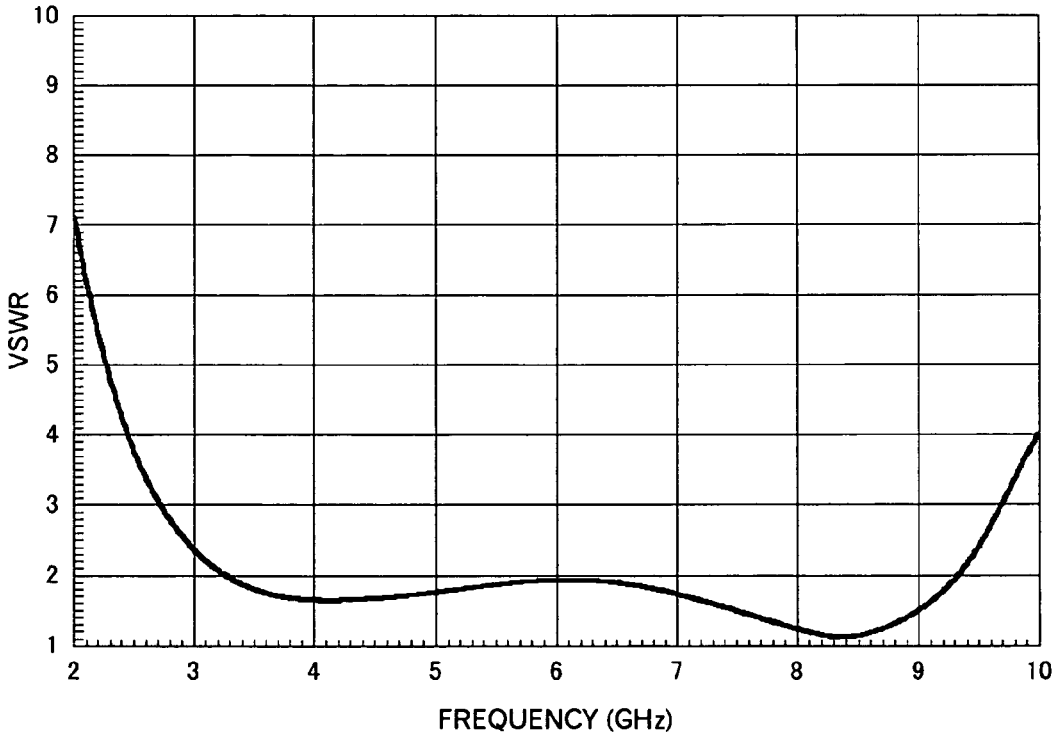
FIG. 10 is a diagram showing the characteristic of an antenna according to the fifth embodiment.

FIG. 10 is a graph showing the impedance characteristic of the antenna according to this embodiment. In FIG. 10, the axis of ordinate represents VSWR and the axis of abscissa represents the frequency (GHz) The frequency range in which VSRW is not more than 2.5 extends from about 2.9 GHz to about 9.5 GHz, and accordingly this embodiment has achieved a wide bandwidth antenna. The value of VSWR approaches 2 at about 6 GHz, however, this is permissible. The frequency at which VSWR becomes 2.5 is an extremely low frequency, which is about 2.9 GHz, because the cut-out portion 514 is provided.

[Embodiment 6]

Figure 11:
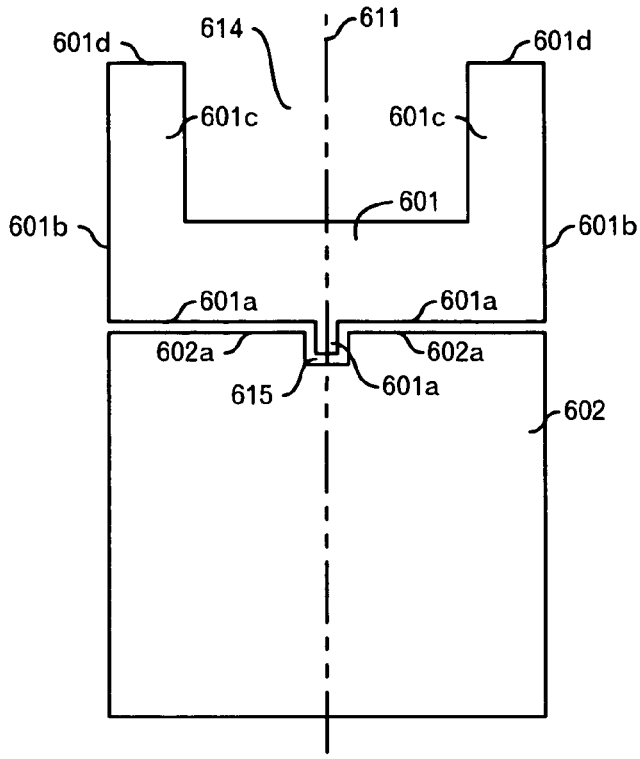
FIG. 11 is a diagram showing the structure of an antenna according to a sixth embodiment.

FIG. 11 shows the structure of an antenna according to a sixth embodiment of the present invention. In this embodiment, an example will be explained in which a planar element 601 which is formed of a rectangular conductive flat plate and equipped with a cut-out portion 614, and a ground pattern 602 are formed on a printed circuit board (a resin board made of FR-4, Teflon (registered trademark) or the like) having a dielectric constant of 2 to 5.

The antenna according to the sixth embodiment comprises the planar element 601, the ground pattern 602 juxtaposed with the planar element 601, and a high-frequency power source connected to the planar element 601. The high-frequency power source is omitted from the illustration of FIG. 11. The planar element 601 is equipped with a projecting portion 601*a* which is connected to the high-frequency power source and constitutes a feed point, a bottom side 601*a* opposite to a side 602*a* of the ground pattern 602, lateral side portions 601*b* connected vertically to the bottom side 601*a*, a rectangular cut-out portion 614 formed by concaving the top portion 601*d* toward the ground pattern 602, and arm portions 601*c* for securing current paths for low frequencies.

The ground pattern 602 is equipped with a recess 615 in which the projecting portion 601*a* of the planar element 601 is accommodated. Accordingly, the side 602*a* opposite to the bottom side 601*a* of the planar element 601 is not straight, but is divided into two sides. The antenna according to this embodiment is symmetrical with respect to a line 611 passing through the center of the projecting portion 601*a*, which is the feed position. Accordingly, the cut-out portion 614 is also symmetrical with respect to the line 611.

Also in this embodiment, the ground pattern 602 is formed without surrounding the planar element 601, and the antenna is separated into the ground pattern 602 side and the planar element 601 side up and down. That is, the ground pattern 602 is formed without surrounding the entire edge portion of the planar element 601 so that an opening is formed for at least a part of the edge portion of the planar element 601, which includes the cut-out portion 614.

Moreover, the structure of the side is almost the same as shown in FIG. 1B. Namely, a plane of the planar element 601 and a plane of the ground pattern 602 are disposed in parallel or substantially in parallel with each other.

Incidentally, the shape of the cut-out portion 614 is not limited to the rectangle. The shape of the cut-out portion described with respect to the fourth embodiment may be adopted.

Figure 12:
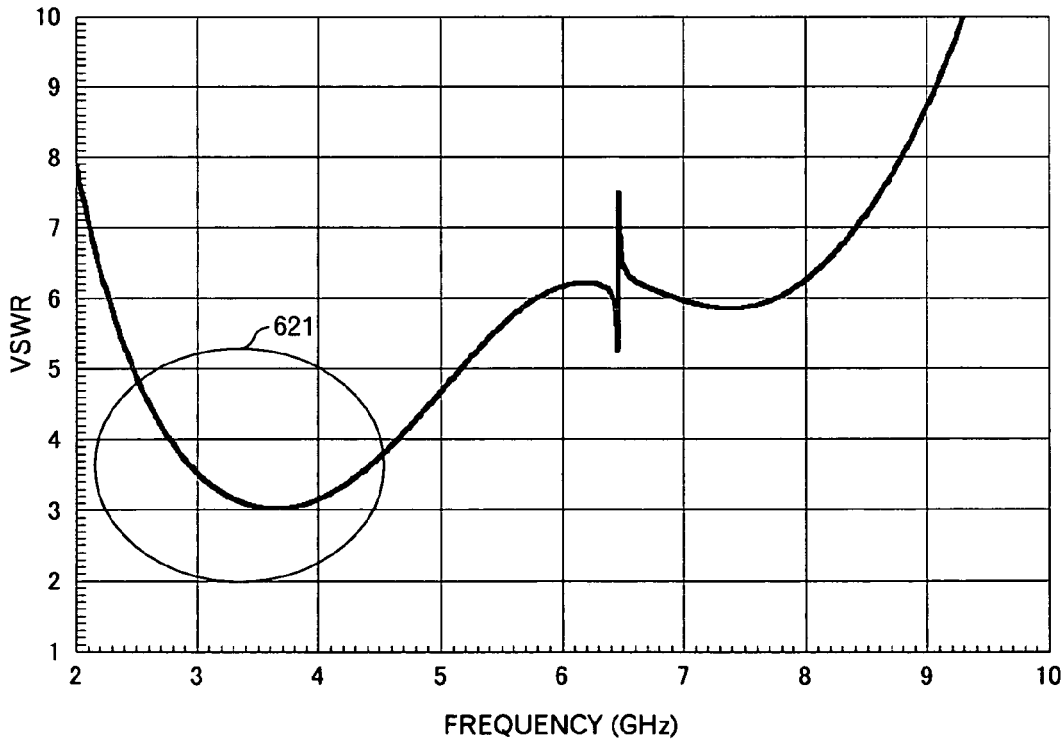
FIG. 12 is a diagram showing the impedance characteristic of the antenna according to the sixth embodiment.

FIG. 12 shows the impedance characteristic of the antenna according to this embodiment. In FIG. 12, the axis of ordinate represents VSWR and the axis of abscissa represents the frequency (GHz) The antenna of this embodiment does not show a preferable characteristic as a whole. This is because the side 602*a* of the ground pattern 602 and the bottom side 601*a* of the planar element 601 are parallel to each other, and accordingly, the impedance adjustment is not carried out. However, the effect due to the cut-out portion 614 appears at a portion surrounded by an ellipsoid 621, and the lowering degree of the VSWR curve is relatively intense.

The ground pattern 602 may be cut so that the side 602*a* of the ground pattern 602 and the bottom side 601*a* of the planar element 601 are not parallel to each other unlike this embodiment, and the gap between the ground pattern 602 and the planar element 601 is continuously shortened from the outside to the feed point 601*a*. Linear or curved cutting may be carried out as a cutting style.

[Embodiment 7]

Figure 13A:
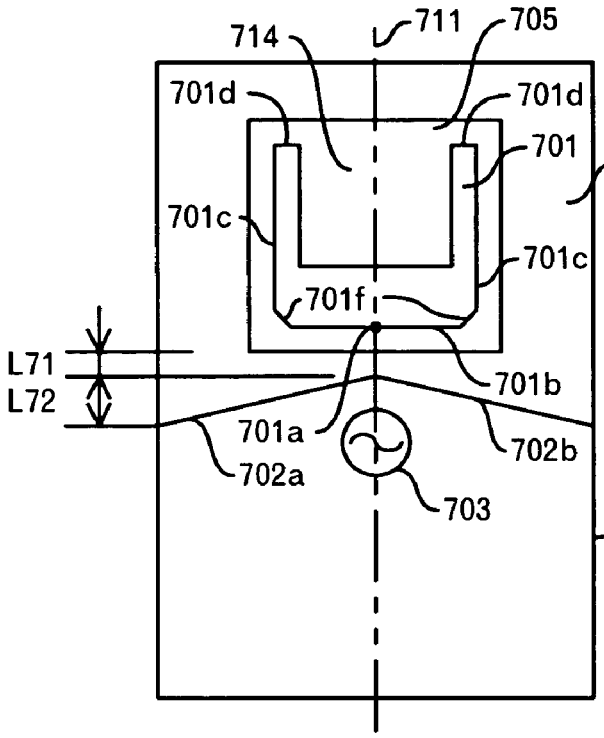
FIG. 13A is a front view showing the structure of an antenna according to a seventh embodiment.
Figure 13B:
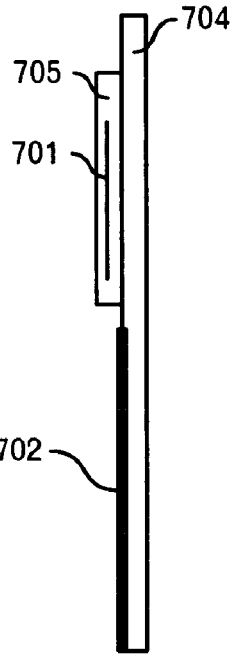
FIG. 13B is a side view of the antenna.

FIGS. 13A and 13B show the structure of an antenna according to a seventh embodiment. The antenna according to the seventh embodiment includes a dielectric substrate 705 that contains a conductive planar element 701 having a cut-out portion 714 therein and has a dielectric constant of about 20, a ground pattern 702 that is juxtaposed with the dielectric substrate 705 so as to make an interval of L71 (=1.0 mm) from the dielectric substrate 705 and is tapered toward a feed point 701*a* of the dielectric substrate 705, a board 704 such as a printed circuit board (a resin board made of FR-4, Teflon (registered trademark) or the like), and a high-frequency power source 703 connected to the feed point 701*a* of the planar element 701. The size of the dielectric substrate 705 is about 8 mm×10 mm×1 mm. In addition, the bottom side 701*b* of the planar element 701 is vertical to the line 711 passing through the feed point 701*a*, and the lateral sides 701*c* of the planar element 701 are parallel to the line 711. The corners of the bottom side 701*b* of the planar element 701 are splayed and equipped with sides 701*f*. The bottom side 701*b* are connected to the lateral sides 701*c* through the sides 701*f*. Moreover, a cut-out portion 714 is provided to the top portion 701*d* of the planar element 701. The cut-out portion 714 is formed by concaving the top in a rectangular shape from the top portion 701*d* toward the ground pattern 702 side. The feed point 701*a* is provided at the intermediate point of the bottom side 701*b*.

In addition, the planar element 701 and the ground pattern 702 are designed to be symmetrical with respect to the line 711 passing through the feed point 701*a*. Accordingly, the cut-out portion 714 is also symmetrical with respect to the line 711. Furthermore, the length (hereinafter referred to as "distance") of a line segment extending from any point on the bottom side 701*b* of the planar element 701 to the ground pattern 702 in parallel with the line 711 is also symmetric with respect to the line 711.

Also in this embodiment, the ground pattern 702 is formed without surrounding the planar element 701 so that the antenna is separated into the ground pattern 702 side and the dielectric substrate 705 side up and down. That is, the ground pattern 702 is formed without surrounding the entire edge portion of the planar element 701 so that an opening is formed for at least a part of the edge portion of the planar element 701, which includes the cut-out portion 714.

FIG. 13B is a side view of the antenna shown in FIG. 13A, and the ground pattern 702 and the dielectric substrate 705 are provided on the board 704. The board 704 and the ground pattern 702 may be integrally formed with each other. Incidentally, in this embodiment, the planar element 701 is formed inside the dielectric substrate 705. That is, the dielectric substrate 705 is formed by laminating ceramic sheets, and the conductive planar element 701 is formed as one layer of the laminate. Accordingly, when the antenna is viewed from the upper side, it is not actually viewed like FIG. 13A. When the planar element 701 is formed in the dielectric substrate 705, the effect of the dielectric material is slightly stronger as compared with the case where the planar element is exposed, so that the antenna can be more miniaturized and reliability and/or resistance to such as rust or the like is enhanced. However, the planar element 701 may be formed on the surface of the dielectric substrate 705. Furthermore, the dielectric constant may be varied, and the dielectric substrate may be formed in a mono-layer or multi-layer structure. If it is formed in the mono-layer structure, the planar element 701 is formed on the dielectric substrate 704. Incidentally, in this embodiment, the plane of the dielectric substrate 705 is arranged in parallel to or substantially in parallel to the plane of the ground pattern 702. This arrangement causes the plane of the planar element 701 contained in one layer of the dielectric substrate 705 to be disposed in parallel to or substantially in parallel to the plane of the ground pattern 702.

When the planar element 701 is formed to be covered by the dielectric substrate 705, the condition of the electromagnetic field around the planar element 701 is varied by the dielectric material. Specifically, since an effect of increasing the density of the electric field in the dielectric material and a wavelength shortening effect can be obtained, the planar element 701 can be miniaturized. Furthermore, the lift-off angle of the current path is varied by these effects, and an inductance component L and a capacitance component C in the impedance equivalent circuit of the antenna are varied. That is, the impedance characteristic is greatly affected. The shape of the planar element 701 and the ground pattern 702 is optimized so that a desired impedance characteristic can be achieved in a desired range in consideration for the effect on the aforementioned impedance characteristic.

In this embodiment, the upper edge portions 702*a* and 702*b* of the ground pattern 702 are downwardly inclined from the intersecting point with the line 711 by a height L72 (=2 to 3 mm) at the side edge portions of the grand pattern 702 in the case where the width of the grand pattern 702 is 20 mm. That is, the ground pattern 702 has a tapered shape formed of upper edge portions 702*a* and 702*b* with respect to the planar element 701. Since the bottom side 701*b* of the planar element 701 is vertical to the line 711, the distance between the bottom side 701*b* of the planar element 701 and the ground pattern 702 is linearly and continuously increased as approaching to the side edge portions. That is, the antenna according to this embodiment is equipped with a continuous varying portion at which the distance between the planar element 701 and the ground pattern 702 is continuously varied. By providing such a continuous varying portion, the coupling degree between the planar element 701 and the ground pattern 702 is adjusted. By adjusting the coupling degree, especially, the bandwidth at a high frequency side can be widened.

Figure 14:
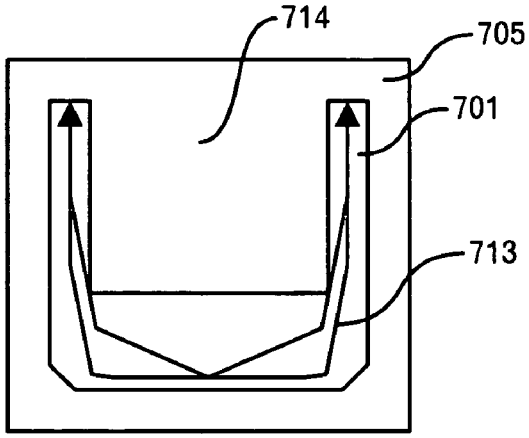
FIG. 14 is a diagram to explain the principle of the operation of the antenna according to the seventh embodiment.

The planar element 701 according to this embodiment is designed to have a shape with a rectangular cut-out portion 714 in order to further enhance miniaturization and secure current paths 713 for achieving a desired frequency bandwidth, as shown in FIG. 14. The antenna characteristic can be adjusted by the shape of the cut-out portion 714.

[Embodiment 8]

Figure 15:
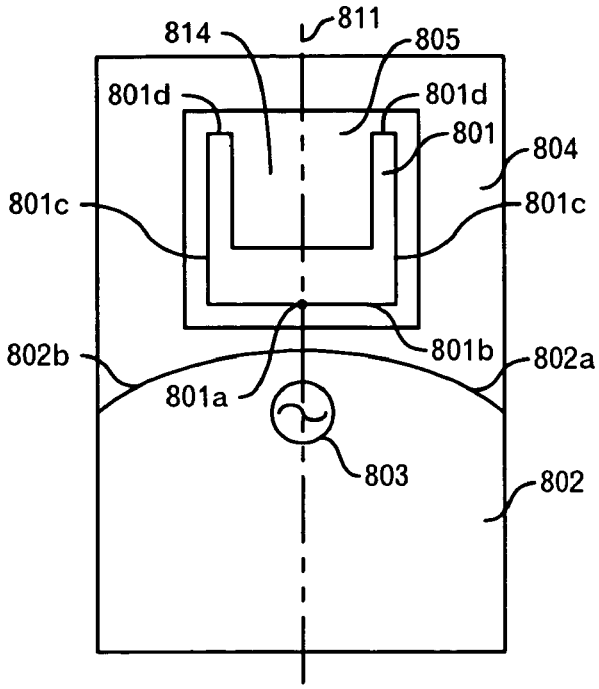
FIG. 15 is a diagram showing the structure of an antenna according to an eighth embodiment.

An antenna according to an eighth embodiment of the present invention comprises a dielectric substrate 805 that contains a planar element 801 therein and has a dielectric constant of about 20, a ground pattern 802 that is juxtaposed with the dielectric substrate 805 and has upper edge portions 802*a* and 802*b* that are upwardly convex curved lines, a board 804 such as a printed circuit board or the like, and a high-frequency power source 803 connected to a feed point 801*a* of the planar element 801 as shown in FIG. 15. The size of the dielectric substrate 805 is about 8 mm×10 mm×1 mm. In addition, the bottom side 801*b* of the planar element 801 is vertical to a line 811 passing through the feed point 801*a*, and lateral sides 801*c* connected to the bottom side 801*b* are parallel to the line 811. Moreover, a cut-out portion 814 is provided at the top portion 801*d* of the planar element 801. The cut-out portion 814 is formed by concaving the top in a rectangular shape from the top portion 801*d* toward the ground pattern 802 side. The feed point 801*a* is provided at the intermediate point of the bottom side 801*b*. Incidentally, the difference between the planar element 701 of the dielectric substrate 705 according to the seventh embodiment and the planar element 801 of the dielectric substrate 805 in this embodiment exists in that the corners of the bottom side are splayed or not splayed.

The planar element 801 and the ground pattern 802 are designed symmetrically with respect to the line 811 passing through the feed point 801*a*. Furthermore, the length (hereinafter referred to as "distance") of a line segment extending from any point on the bottom side 801*b* of the planar element 801 to the ground pattern 802 in parallel to the line 811 is also symmetric with respect to the line 811.

Since the upper edge portion 802*a* and 802*b* of the ground pattern 802 is designed to be an upwardly convex curved line (for example, arc), the distance between the planar element 801 and the ground pattern 802 is gradually increased as approaching to the side edge portions of the ground pattern 802. In other words, though the angle is not an acute angle, a tapered shape with respect to the feed point 801*a* of the planar element 801 is made to the ground pattern.

Also in this embodiment, the ground pattern 802 is formed without surrounding the dielectric substrate 805 including the planar element 801 so that the antenna is separated into the ground pattern 802 side and the dielectric substrate 805 side up and down. That is, the ground pattern 802 is formed without surrounding the all side surfaces of the dielectric surface 805 so that an opening is formed for at least a part of the side surfaces closed to the edge portion of the planar element 801.

Moreover, the structure of the side is almost the same as shown in FIG. 13B. Namely, a plane of the dielectric substrate 805 including the planar element 801 and a plane of the ground pattern 802 are disposed in parallel or substantially in parallel with each other.

A desired impedance characteristic can be achieved in a desired frequency range by adjusting the curvature of the curved line of the upper edge portions 802*a* and 802*b* of the ground pattern 802.

[Embodiment 9]

Figure 16:
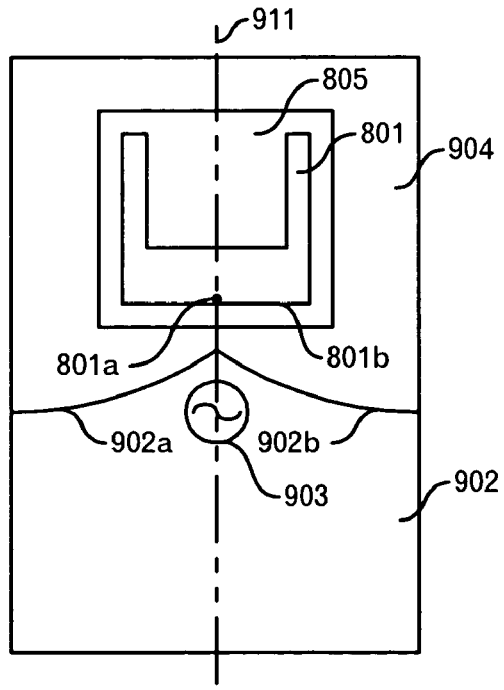
FIG. 16 is a diagram showing the structure of an antenna according to a ninth embodiment.

As shown in FIG. 16, an antenna according to a ninth embodiment of the present invention comprises a dielectric substrate 805 containing a planar element 801 having the same shape as the eighth embodiment, a ground pattern 902 that is juxtaposed with the dielectric substrate 805 and has upper edge portions 902*a* and 902*b* which draw downward saturation curves, a board 904 such as a printed circuit board or the like on which the dielectric substrate 805 and the ground pattern 902 are mounted, and a high-frequency power source 903 connected to a feed point 801*a* of the planar element 801.

The planar element 801 and the ground pattern 902 are designed to be symmetric with respect to a line 911 passing through the feed point 801*a*. The length (hereinafter referred to as "distance") of a line segment extending from any point on the bottom side 801*b* of the planar element 801 to the ground pattern 902 in parallel to the line 911 is also symmetric with respect to the line 911.

Since the upper edge portions 902*a* and 902*b* of the ground pattern 902 are downwardly saturated curves starting from the cross-point between each saturated curve and the line 911, that is, downwardly convex curved lines, the distance between the planar element 801 and the ground pattern 902 asymptotically approaches a predetermined value as approaching to the side edge portions of the grand pattern 902. In other words, the tapered shape with respect to the dielectric substrate 805 is formed to the ground pattern 902.

Also in this embodiment, the ground pattern 902 is formed without surrounding the dielectric substrate 805 including the planar element 801 so that the antenna is separated into the ground pattern 902 side and the dielectric substrate 805 side up and down. That is, the ground pattern 902 is formed without surrounding the entire edge portion of the planar element 801 so that an opening is formed with respect to at least a part of the edge portion of the planar element 801, which includes the cut-out portion.

Moreover, the structure of the side is almost the same as shown in FIG. 13B. Namely, a plane of the dielectric substrate 805 including the planar element 801 and a plane of the ground pattern 902 are disposed in parallel or substantially in parallel with each other.

A desired impedance characteristic can be achieved in a desired frequency range by adjusting the curvature of each of the curved lines of the upper edge portions 902*a* and 902*b* of the ground pattern 902.

[Embodiment 10]

Figure 17A:
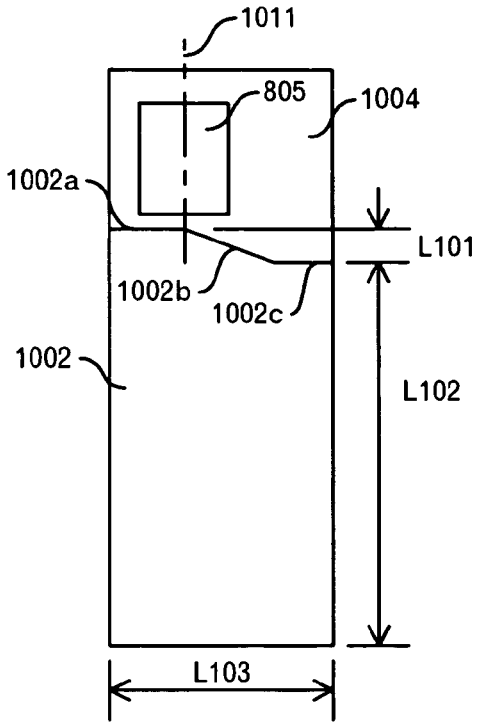
FIG. 17A is a diagram showing the structure of a first antenna according to a tenth embodiment.

Though there is no problem in a case where the ground pattern 802 can be formed to be symmetric with respect to the straight line 811 passing through the feed point 801*a* like the antenna according to the eighth embodiment of the present invention, there is a case where the ground pattern cannot be formed to be symmetric when the dielectric substrate 805 is mounted on the corner of the board 804, for example. Here, an optimum example is shown in a case where the ground pattern cannot be formed to be symmetric as described above. As shown in FIG. 17A, when the dielectric substrate 805 must be disposed on the left corner of the board 1004, the ground pattern 1002 has such a shape that a side 1002*a*, which is disposed at the left portion from a center line 1011 of the dielectric substrate 805, is horizontal, a side 1002*b*, which is disposed on the right portion, is declined, and a side 1002*c* extending from a position, which falls down by L101 (=3 mm) from the side 1002*a*, is horizontal. However, the ground pattern 1002 has a tapered shape with respect to the dielectric substrate 805. Incidentally, the width L103 of the ground pattern 1002 is 20 mm, and the length L102 of the right lateral side edge is 35 mm. Moreover, the size of the dielectric substrate 805 is the same as the eighth embodiment, that is, 8 mm×10 mm×1 mm.

Also in this embodiment, the ground pattern 1002 is formed without surrounding the dielectric substrate 805 including the planar element so that the antenna is separated into the ground pattern 1002 side and the dielectric substrate 805 side up and down. That is, the ground pattern 1002 is formed without surrounding the entire edge portion of the planar element to form an opening with respect to at least a part of the edge portion of the planar element, which includes the cut-out portion.

By forming such the ground pattern 1002, it becomes possible to obtain the impedance characteristic, which is almost similar to the structure having the symmetrical ground pattern.

Figure 17B:
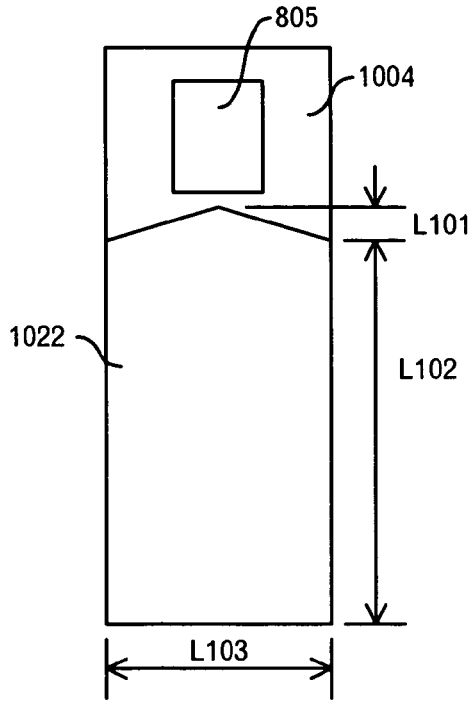
FIG. 17B is a diagram showing the structure of a second antenna according to the tenth element.

Incidentally, the antenna structure to be compared is shown in FIG. 17B. In an example of FIG. 17B, the dielectric substrate 805 is the same, the length of the lateral side edge is 35 mm (=L102), and the width is 20 mm (=L103). In addition, the upper edge portion of the ground pattern 1022 is composed of two segments, which form the tapered shape. The height from the highest point of the upper edge portion of the ground pattern 1022 to the lowest point thereof is 3 mm (=L3).

Figure 18:
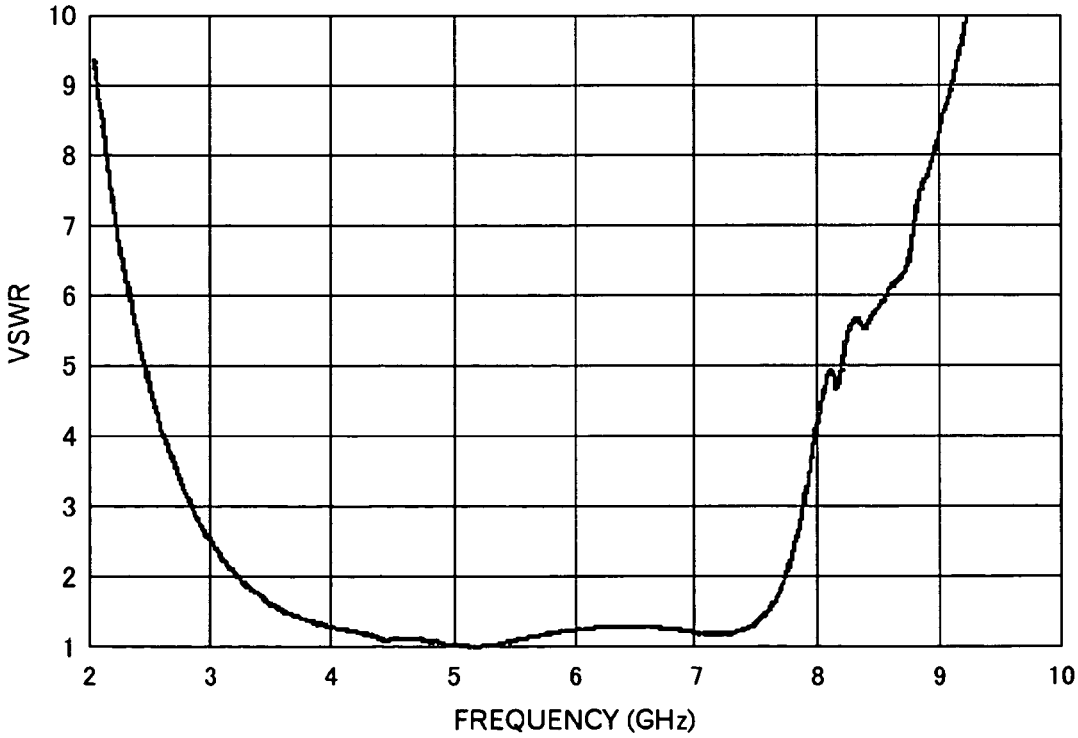
FIG. 18 is a diagram showing the impedance characteristic of the first antenna in the tenth embodiment.
Figure 19:
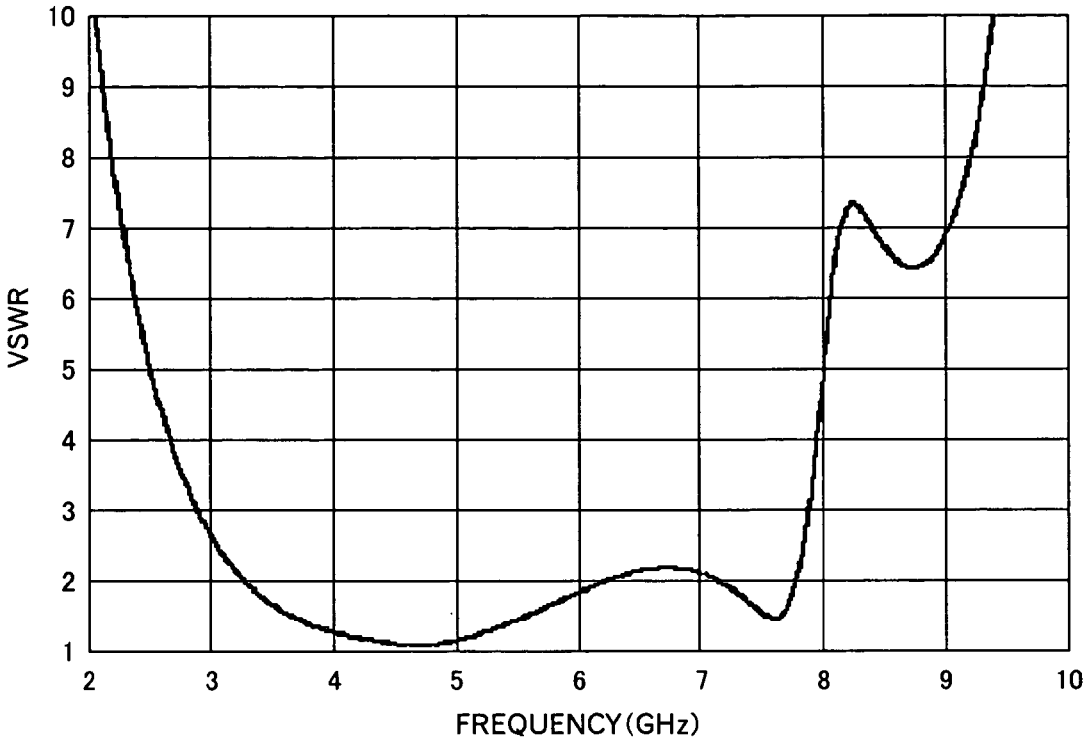
FIG. 19 is a diagram showing the impedance characteristic of the second antenna in the tenth embodiment.

The impedance characteristic of the antenna of FIG. 17A is shown in FIG. 18. In the graph of FIG. 18, the axis of ordinate represents VSWR, and the axis of abscissa represents the frequency (GHz). For example, the frequency range in which VSWR is not more than 2.5 approximately extends from about 3 GHz to about 7.8 GHz. Namely, the wide bandwidth is achieved. On the other hand, the impedance characteristic of the antenna of FIG. 17B is shown in FIG. 19. In the graph of FIG. 19, the axis of ordinate represents VSWR, and the axis of abscissa represents the frequency (GHz). For example, the frequency range in which VSWR is not more than 2.5 approximately extends from about 3.1 GHz to about 7.8 GHz. As shown in FIG. 18 and FIG. 19, the almost similar impedance characteristic can be obtained.

[Embodiment 11]

Figure 20:
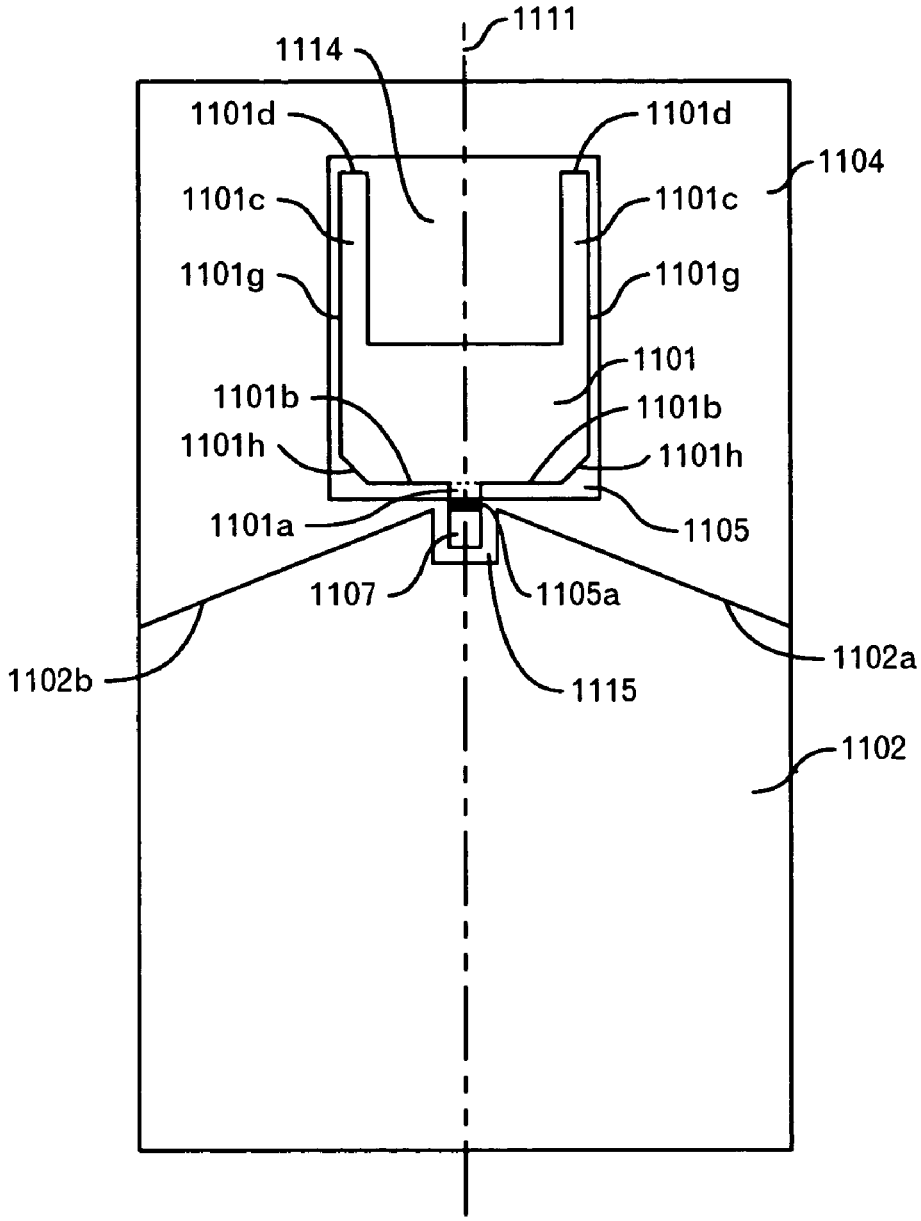
FIG. 20 is a diagram showing the structure of an antenna according to an eleventh embodiment.

The structure of an antenna according to an eleventh embodiment of the present invention is shown in FIG. 20. In this embodiment, an example will be explained in which a planar element 1101 that is formed of a rectangular conductive flat plate and has a cut-out portion 1114 is formed in a dielectric substrate 1105 having a dielectric constant of about 20. The antenna according to this embodiment comprises the dielectric substrate 1105 that contains the planar element 1101 therein and has an external electrode 1105*a* at the outside thereof, a feed portion 1107 that is connected to a high-frequency power source (not shown) to supply power to the planar element 1101 and connected to the external electrode 1105*a* of the dielectric substrate 1105, and a ground pattern 1102 that has a recess 1115 for accommodating the feed portion 1107 and has a tapered shape with respect to the feed position of the planar element 1101. Incidentally, the dielectric substrate 1105 is mounted on a board 1104 such as a printed circuit board, and the ground pattern 1102 is formed in the board 1104 or on the surface of the board 1104.

The external electrode 1105*a* is connected to a projecting portion 1101*a* of the planar element 1101, and extends to the back surface (dotted line portion) of the dielectric substrate 1105. The feed portion 1107 contacts with the external electrode 1105*a* that is provided on the end portion of the side surface and the back surface of the dielectric substrate 1105, and the feed portion 1107 and the external electrode 1105*a* are overlapped in the dotted line portion.

The planar element 1101 is equipped with a projecting portion 1101*a* connected to the external electrode 1105*a*, a side 1101*b* opposite to sides 1102*a* and 1102*b* of the ground pattern 1102, arm portions 1101*c* for securing current paths for low frequencies, and a rectangular cut-out portion 1114 formed so as to concave from the top portion 1101*d* toward the ground pattern 1102. The side 1101*b* and the lateral side portions 1101*g* are connected to each other through sides 1101*h* formed by splaying the side 1101*b*. The dielectric substrate 1105 containing the planar element 1101 is juxtaposed with the ground pattern 1102.

Incidentally, in this embodiment, the planar element 1101 is formed inside the dielectric substrate 1105. That is, the dielectric substrate 1105 is formed by laminating ceramic sheets, and the conductive planar element 1101 is formed as one layer of the laminate. Accordingly, when viewed from the upper side, the planar element 1101 is not actually viewed like FIG. 20. However, the planar element 1101 may be formed on the surface of the dielectric substrate 1105.

Since the recess 1115 for accommodating the feed portion 1107 is provided to the tip having the tapered shape and composed of the sides 1102*a* and 1102*b* in the ground pattern 1102, the edge portion of the ground pattern 1102 opposite to the planar element 1101 is not straight, and are divided into two sides 1102*a* and 1102*b*. Incidentally, the antenna according to this embodiment is symmetric with respect to a line 1111 passing through the center of the feed portion 1107, which is the feed position. The rectangular cut-out portion 1114 and the tapered shape of the ground pattern 1102 are also symmetrical. The sides 1102*a* and 1102*b* are inclined so that the distance between the side 1101*b* of the planar element 1101 and the sides 1102*a* or 1102*b* of the ground pattern 1102 is linearly increased as being farther away from the line 1111.

Also in this embodiment, the ground pattern 1102 is formed without surrounding the dielectric substrate 1105 including the planar element 1101 so that the antenna is separated into the ground pattern 1102 side and the dielectric substrate 1105 side up and down. That is, the ground pattern 1102 is formed without surrounding the entire edge portion of the planar element 1101 so that an opening is formed with respect to at least a part of the edge portion of the planar element 1101, which includes the cut-out portion 1114.

Incidentally, the structure of the side surface is almost the same as FIG. 13B except for the portions of the feed portion 1107 and the external electrode 1105*a*. That is, a plane of the dielectric substrate 1105 including the planar element 1101 and a plane of the ground pattern 1102 is disposed in parallel or substantially in parallel.

Figure 21:
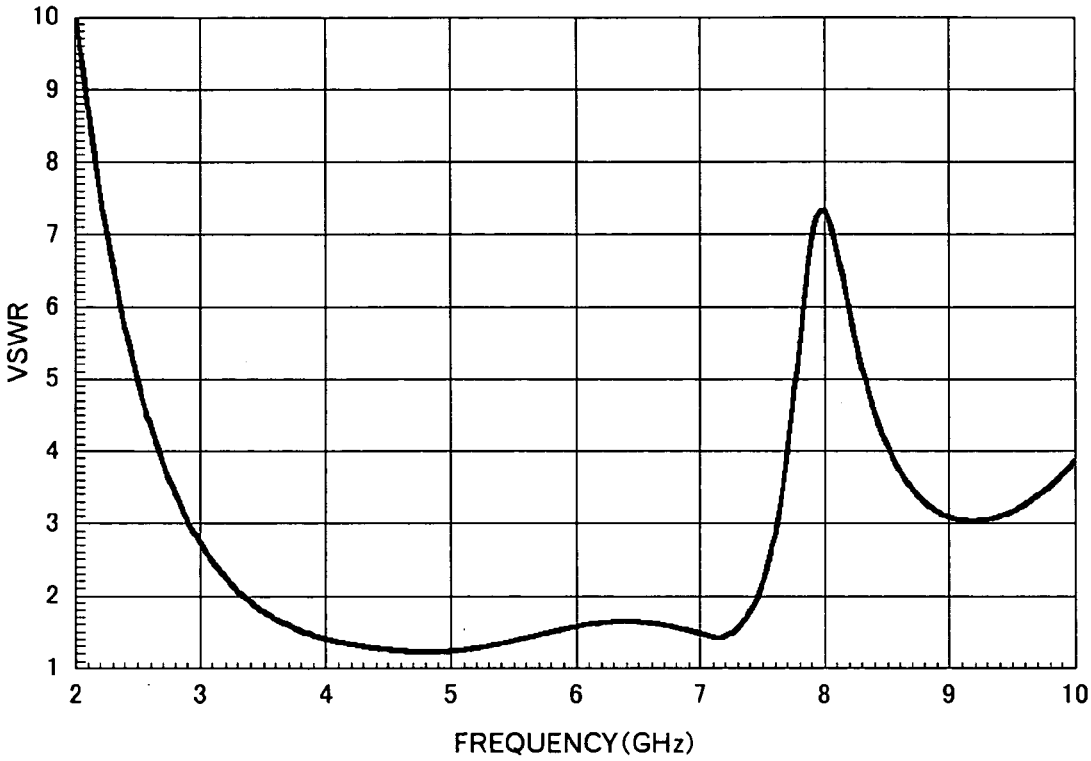
FIG. 21 is a diagram showing the impedance characteristic of the antenna according to the eleventh embodiment.

FIG. 21 shows the impedance characteristic of the antenna according to this embodiment. In FIG. 21, the axis of ordinate represents VSWR, and the axis of abscissa represents the frequency (GHz). The frequency range in which VSWR is not more than 2.5 extends from about 3.1 GHz to about 7.6 GHz. Though a range where the value of VSWR is greatly varied exists in the high-frequency range, the range at the low-frequency side is widened so that VSWR is equal to 2.5 at about 3.1 GHz. As described above, the impedance characteristic at the low-frequency side is improved by the planar element having the cut-out portion.

[Embodiment 12]

Figure 22:
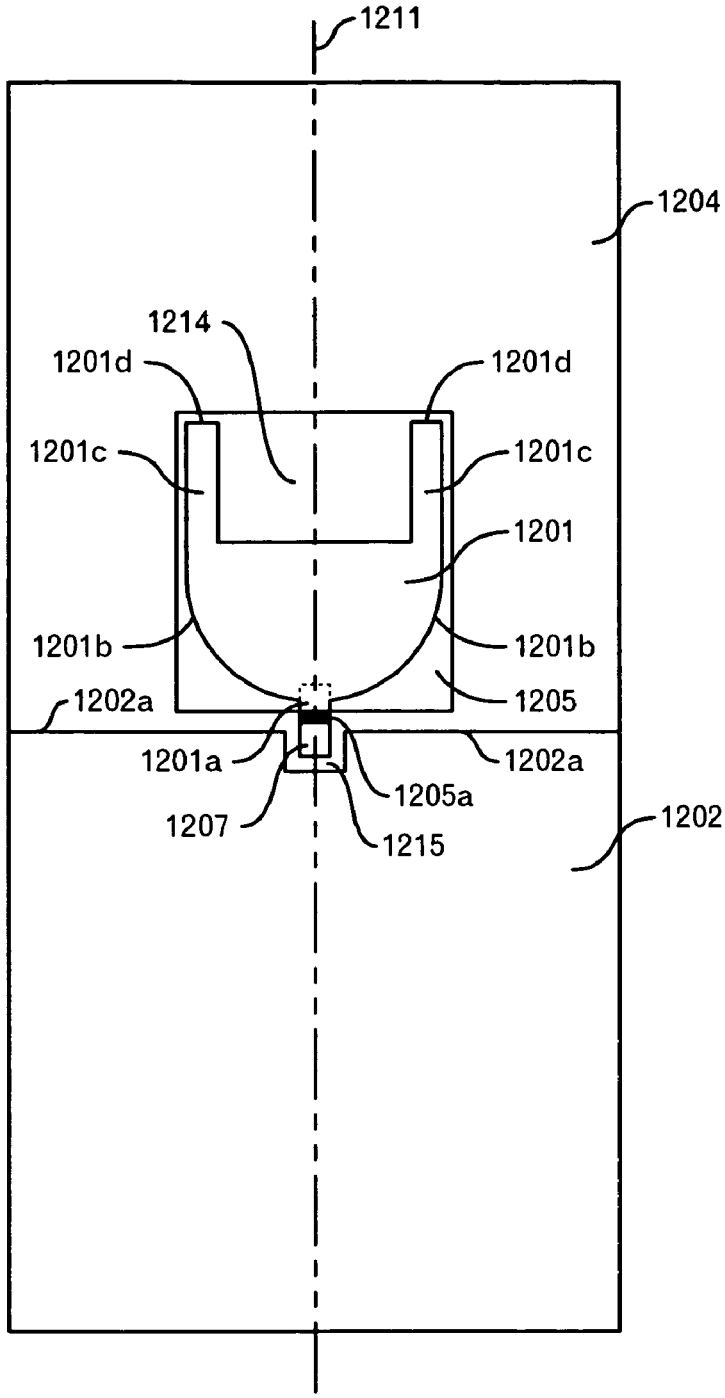
FIG. 22 is a diagram showing the structure of an antenna according to a twelfth embodiment.

FIG. 22 shows the structure of an antenna according to a twelfth embodiment of the present invention. In this embodiment, an example will be explained where a planar element 1201 having an arc edge portion opposite to a ground pattern 1202 is formed in a dielectric substrate 1205 having a dielectric constant of about 20. The antenna according to the twelfth embodiment comprises a dielectric substrate 1205 that contains a conductive planar element 1201 and equipped with an external electrode 1205*a* at the outside thereof, a feed portion 1207 that is connected to a high-frequency power source (not shown) to supply power to the planar element 1201 and connected to the external electrode 1205*a* of the dielectric substrate 1205, and a ground pattern 1202 that has a recess 1215 for accommodating the feed portion 1207 therein and is formed in or on a board 1204 such as a printed circuit board or the like. The external electrode 1205*a* is connected to a projecting portion 1201*a* of the planar element 1201, and extends to the back surface (dotted line portion) of the dielectric substrate 1205. The feed portion 1207 contacts with the external electrode 1205*a* provided on the edge portion of the side surface of the dielectric substrate 1205 and the back surface thereof, and the feed portion 1207 and the external electrode 1205*a* are overlapped at the dotted line portion.

The planar element 1201 is equipped with the projecting portion 1201*a* connected to the external electrode 1205*a*, a curved line portion 1201*b* opposite to a side 1202*a* of the ground pattern 1202, arm portions 1201*c* for securing current paths for low frequencies, and a rectangular cut-out portion 1214 formed so as to concave from the top portion 1201*d* toward the ground pattern 1202. The dielectric substrate 1205 containing the planar element 1201 is juxtaposed with the ground pattern 1202.

Incidentally, in this embodiment, the planar element 1201 is formed inside the dielectric substrate 1205. That is, the dielectric substrate 1205 is formed by laminating ceramic sheets, and the conductive planar element 1201 is formed as one layer of the laminate. Accordingly, when viewed from the upper side, it is not actually viewed like FIG. 22. If the planar element 1201 is formed inside the dielectric substrate 1205, the effect of the dielectric material is slightly stronger as compared with the case where it is exposed, so that the miniaturization can be more enhanced and reliability to such as rust or the like can be enhanced. However, the planar element 1201 may be formed on the surface of the dielectric substrate 1205.

The ground pattern 1202 is provided with the recess 1215 for accommodating the feed portion 1207. Therefore, the sides 1202*a* opposite to the planar element 1201 are not straight, but divided into two segments. Incidentally, the antenna according to this embodiment is symmetrical with respect to a line 1211 passing through the center of the feed portion 1207. The rectangular cut-out portion 1214 is also symmetrical. The distance between the curved lines 1201*b* of the planar element 1201 and the sides 1202*a* of the ground pattern 1202 is gradually increased as being farther away from the line 1211 along with the curved line 1201*b*, and it is symmetric with respect to the line 1211. Incidentally, the structure of the side surface is almost the same as FIG. 13B except for the portions of the feed portion 1207 and the external electrode 1205*a*. That is, the plane of the dielectric substrate 1205 including the planar element 1201 is disposed to be parallel or substantially parallel to the plane of the ground pattern 1202.

Also in this embodiment, the ground pattern 1202 is formed without surrounding the dielectric substrate 1205 including the planar element 1201 so that the antenna is separated into the ground pattern 1202 side and the dielectric substrate 1205 side up and down. That is, the ground pattern 1202 is formed without surrounding the entire edge portion of the planar element 1201 so that an opening is formed with respect to at least a part of the edge portion of the planar element 1201, which includes the cut-out portion 1214.

Figure 23:
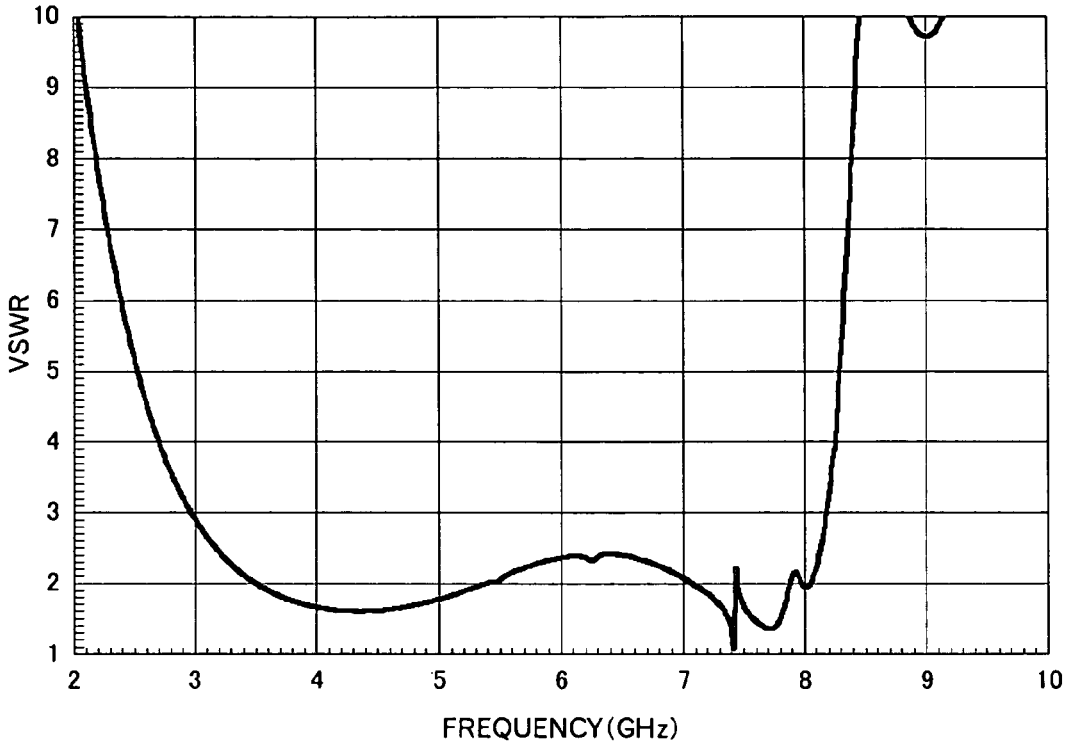
FIG. 23 is a diagram showing the impedance characteristic of the antenna according to the twelfth embodiment.

FIG. 23 shows the impedance characteristic of the antenna according to this embodiment. In FIG. 23, the axis of ordinate represents VSWR and the axis of abscissa represents the frequency (GHz) The frequency range in which VSWR is not more than 2.5 extends from about 3.2 GHz to about 8.2 GHz. Comparing the impedance characteristic of the eleventh embodiment (FIG. 21) and the impedance characteristic of this embodiment (FIG. 23), these characteristics in the low frequency range are substantially the same, however, they are greatly different in the high-frequency range. Comparing the shape of the planar element 1101 of the eleventh embodiment and the shape of the planar element 1201 of this embodiment, the same shape is used at the portion where the rectangular cut-out portion exists. Therefore, also from the comparison between FIGS. 21 and 23, it is apparent that the rectangular cut-out portion contributes to the improvement of the characteristic in the low frequency range. On the other hand, comparing the shape of the planar element 1101 of the eleventh embodiment and the shape of the planar element 1201 of this embodiment, they are different in the distance between the planar element and the ground pattern, and it is apparent from the comparison between FIGS. 21 and 23 that this different portion affects the overall characteristic, especially the characteristic in the high-frequency range.

[Embodiment 13]

From a thirteenth embodiment to a sixteenth embodiment, optimization examples of the ground shape and application examples to the wireless communication card will be shown. Basically, the dielectric substrate 1105 and planar element 1101, and the shape of the ground pattern 1102, which were shown in the eleventh embodiment (FIG. 20), are used. By adopting such elements, an ultra wide bandwidth antenna, whose frequency range extends from about 3 GHz to 12 GHz, can be achieved. Especially, since the tapered shape with respect to the feed point 1101*a* of the planar element 1101 is formed to the ground pattern 1102, it is possible to appropriately adjust the coupling degree between the planar element 1101 and the ground pattern 1102, thereby a desired impedance characteristic can be obtained. Incidentally, the sides 1101*h*, which are provided at the bottom side of the planar element 1101 shown in FIG. 20, are not necessarily provided.

Figure 24:
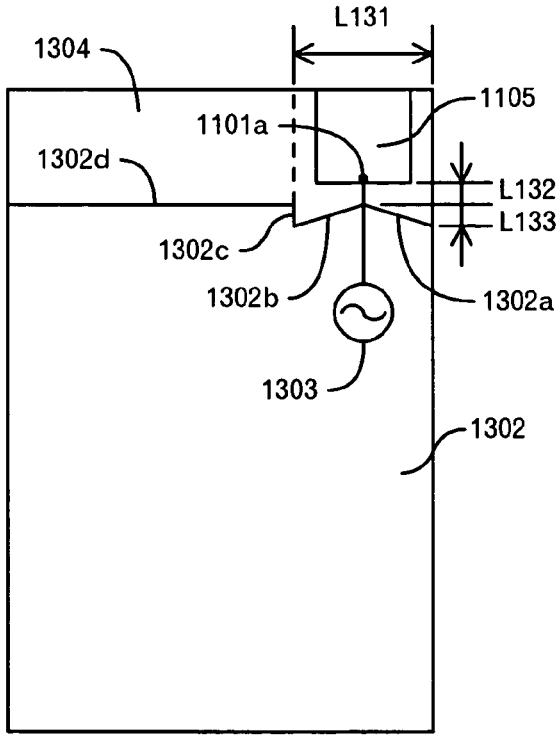
FIG. 24 is a diagram showing the structure of an antenna according to a thirteenth embodiment.

In this embodiment, FIG. 24 shows an example in which this invention is applied to a wireless communication card, such as a PC card, compact flash (CF, registered trade mark) card or the like, which is used by inserting a slot of a personal computer, personal digital assistant (PDA), or the like. FIG. 24 shows a dielectric substrate 1105 that is the same as the dielectric substrate according to the eleventh embodiment, a high frequency power source 1303 connected to the feed point 1101*a*, and a printed circuit board 1304 having the ground pattern 1302. The dielectric substrate 1105 is disposed on a right or left upper end portion of the printed circuit board 1304 and away from the ground pattern 1302 by L132 (=1 mm). The tapered shape with respect to the feed point 1101*a* is formed by sides 1302*a* and 1302*b* facing the dielectric substrate 1105. Though the difference L133 of the height between a point of the ground pattern 1302, which is nearest to the feed point 1101*a*, and an intersecting point of the right lateral edge portion of the printed circuit board 1304 and the side 1302*a* is 2 to 3 mm, the characteristics in a case where the this length is changed will be explained later when comparing the impedance characteristics. The tapered shape is symmetric with respect to the straight line passing through the feed point 1101*a*, but the side 1302*b* is connected with a vertical side 1302*c* having the length L133, and the side 1302*c* is connected with a horizontal side 1302*d*. In FIG. 24, the side 1302*d* is horizontal, and the region of the dielectric substrate 1105 and the region of the ground pattern 1302 are separated up and down. That is, the ground pattern 1302 is formed without surrounding the entire edge portion of the planar element included in the dielectric substrate 1105 so that an opening is formed with respect to at least a part of the edge portion of the planar element, which includes the cut-out portion. Incidentally, the length L131 is 10 mm.

[Embodiment 14]

Figure 25:
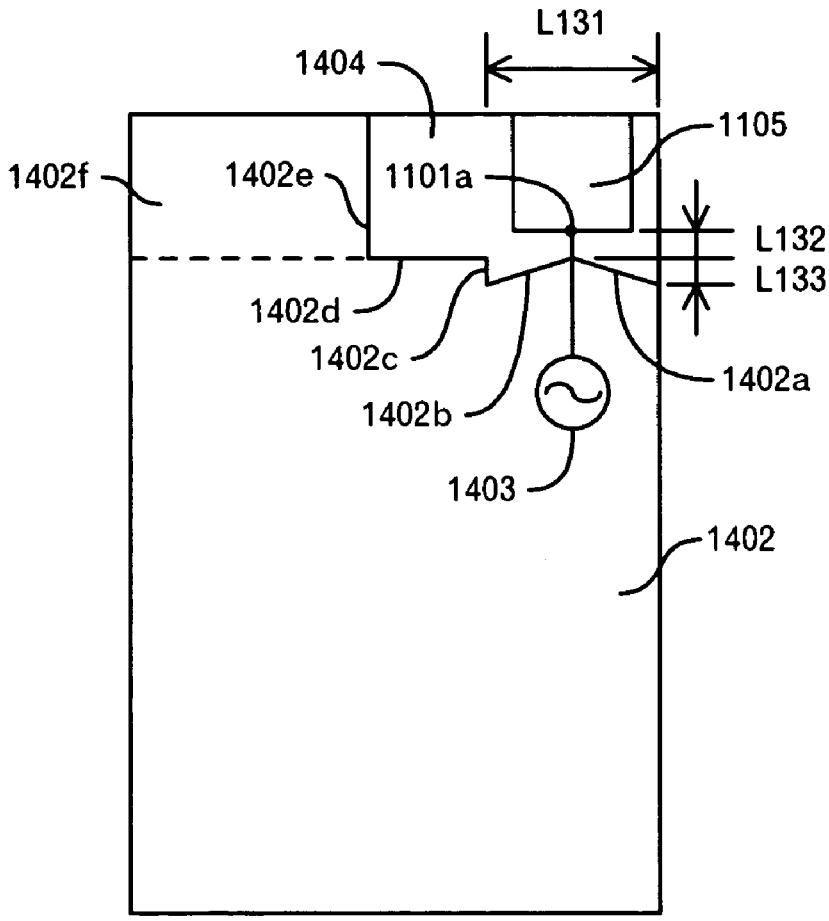
FIG. 25 is a diagram showing the structure of an antenna according to a fourteenth embodiment.

FIG. 25 shows a printed circuit board 1404 of a wireless communication card according to this embodiment. The printed circuit board 1404 according to this embodiment comprises the dielectric substrate 1105, which is the same as the dielectric substrate according to the eleventh embodiment, a high frequency power source 1403 connected with the feed point 1101*a*, and a ground pattern 1402. The dielectric substrate 1105 is disposed on the right upper end portion of the printed circuit board 1404 and apart from the ground pattern 1402 by L132 (=1 mm). The tapered shape with respect to the feed point 1101*a* of the planar element 1101 is formed by the sides 1402*a* and 1402*b* opposite to the dielectric substrate 1105. The shortest distance between the ground pattern 1402 and the dielectric substrate 1105 is L132. The difference L133 of the height between a point of the ground pattern 1402, which is nearest to the feed point 1101*a*, and an intersecting point of the right lateral side portion of the printed circuit board 1404 and the side 1402*a* is 2 to 3 mm. Though the tapered shape composed of the sides 1402*a* and 1402*b* is symmetric with respect to the straight line passing through the feed point 1101*a*, the side 1402*b* is connected with a vertical side 1402*c* of the length L133, and the side 1402*c* is connected with a horizontal side 1402*d*. In this embodiment, the side 1402*d* is further connected with a vertical side 1402*e*. Thus, the ground pattern 1402 is formed so as to partially surround the dielectric substrate 1105 by the sides 1402*e*, 1402*d*, 1402*c*, 1402*b* and 1402*a*. That is, the ground pattern 1402 is formed so as not to fully surround the entire edge portion of the planar element 1101 and so as to provide an opening for at least a part, which includes the cut-out portion 1114, of the edge portion of the planar element 1101. In this embodiment, since the ground pattern 1402 opposite to the top edge portion including the cut-out portion 1114 and the right side edge portion of the planar element 1101 is not provided, it can be said that there is an opening if a cover for the printed circuit board 1404 is not considered. Incidentally, L131 is 10 mm. In addition, though FIG. 25 shows an example in which the dielectric substrate 1105 is disposed on the right upper edge, the dielectric substrate 1105 may be disposed on the left upper edge. At that time, an area of the ground pattern 1402 extends to the right side of the dielectric substrate 1105.

Figure 26:
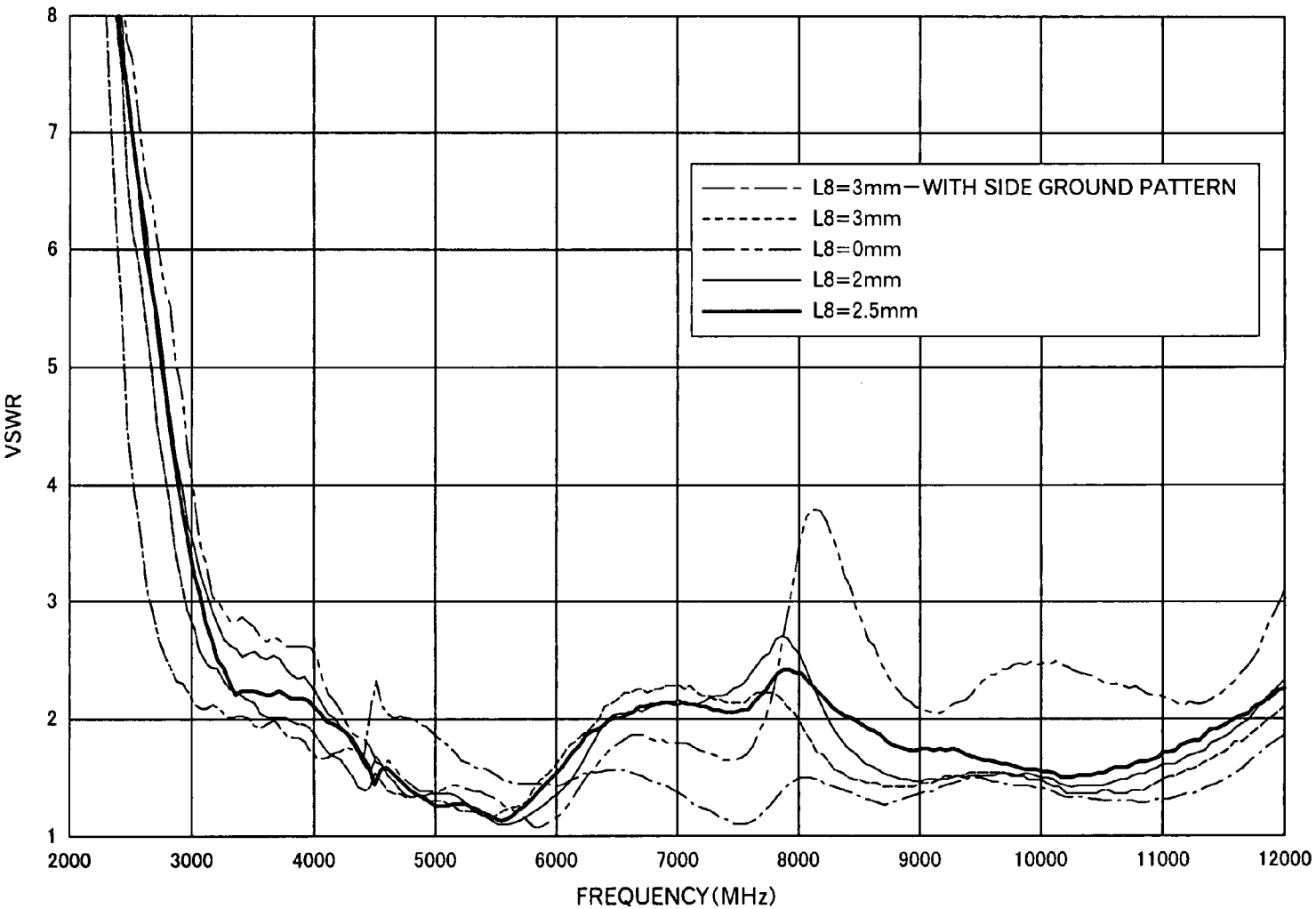
FIG. 26 is a diagram showing change of the impedance characteristics according to the thirteenth embodiment and the fourteenth embodiment.

FIG. 26 shows a drawing to compare differences in the impedance characteristic, which are based on the length of L133 and existence or absence of a ground region 1402*f* that is disposed on the left of the dielectric substrate 1105. In FIG. 26, the axis of ordinate represents VSWR, and the axis of abscissa represents the frequency (MHz). The one dotted dash rule represents the characteristic in a case where L133 is set to 3 mm and the ground region 1402*f* is provided, the dotted line represents the characteristic in a case where L133 is set to 3 mm, the two dotted dash rule represents the characteristic in a case where L133 is set to 0, the solid line represents the characteristic in a case where L133 is set to 2 mm, and the thick line represents the characteristic in a case where L133 is set to 2.5 mm. The two dotted dash rule representing the characteristic of L133=0 mm indicates that the characteristic at frequencies more than about 7700 MHz is bad. In addition, the solid line representing the characteristic of L133=2 mm has a relatively large peak at a frequency of about 7800 MHz. The thick line representing the characteristic of L133=2.5 mm has a lower peak than the solid line at a frequency of about 7900 MHz. As for the dotted line representing the characteristic of L133=3 mm, though the value of the VSWR is more than 2 at frequencies of about 6400 MHz to about 8000 MHz, the peak is low, and the characteristic more than about 8000 MHz is good until the value of the VSWR exceeds 2 again at frequencies near about 12000 MHz. In addition, in the low frequency range, the value of the VSWR is lower than that of L133=2.5 mm or shorter. As for the one dotted dash rule representing the characteristic in the case where the L133=3 mm and the ground region 1402*f* is added, except that a low peak occurs at a frequency of about 4500 MHz, the value of VSWR is kept not more than 2 at frequencies of about 3500 MHz or more. If the threshold value of VSWR is set to about 2.4, an ultra wide bandwidth from about 3000 MHz to 12000 MHz is achieved. Thus, by adding the ground region 1402*f* on the left of the dielectric substrate 1105, the effect to improve the value of VSWR from about 6000 MHz to about 9000 MHz and in the low frequency range from about 3000 MHz to about 4000 MHz can be obtained.

[Embodiment 15]

Figure 27:
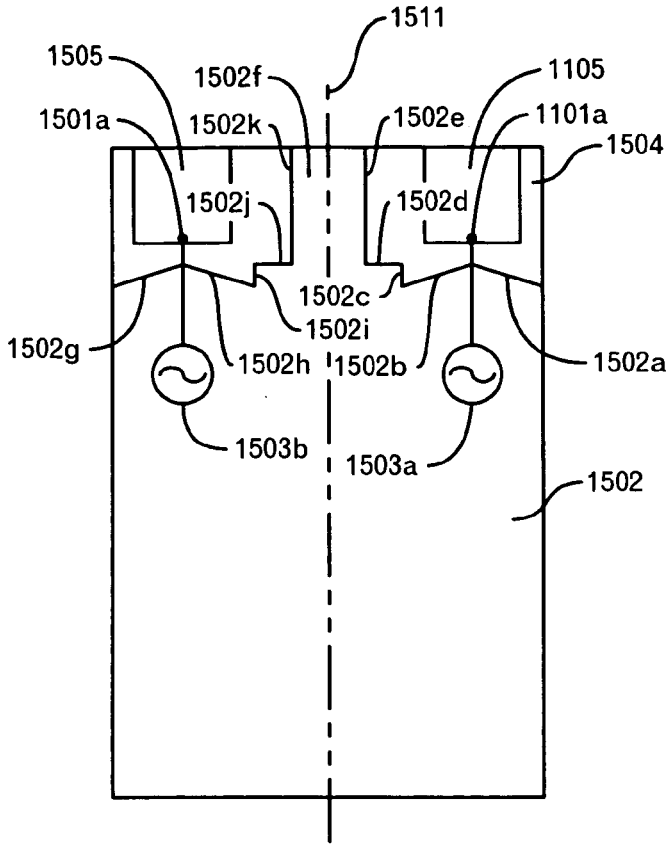
FIG. 27 is a diagram showing the structure of a space diversity antenna according to a fifteenth embodiment.

In this embodiment, an example is explained in which the fourteenth embodiment is applied to a diversity antenna. Normally, the space diversity antenna is used by switching two antennas, which are disposed apart from each other by a quarter wavelength. Accordingly, as shown in FIG. 27, two dielectric substrates are disposed on the right and left upper end of the printed circuit board 1504.

A first antenna includes a dielectric substrate 1105, which is the same as the dielectric substrate in the eleventh embodiment, a high frequency power source 1503*a* connected with the feed point 1101*a*, and a ground pattern 1502. The dielectric substrate 1105 is provided on the right upper end of the printed circuit board 1504 and vertically apart from the ground pattern 1502 by 1 mm. By the sides 1502*a* and 1502*b* of the ground pattern 1502, the tapered shape is formed with respect to the feed point 1101*a* of the planar element 1101. The difference of the height between a point of the ground pattern 1502, which is nearest to the feed point 1101*a*, and an intersecting point of the right lateral edge portion of the printed circuit board 1504 and the side 1502*a* is 2 to 3 mm. Though the tapered shape formed by the sides 1502*a* and 1502*b* is symmetric with respect to the straight line passing through the feed point 1101*a*, the side 1502*b* is connected to a vertical side 1502*c*, and the side 1502*c* is connected to a horizontal side 1502*d*. The side 1502*d* is further connected to a vertical side 1502*e*. That is, a region 1502*f* opposite to the left side surface of the dielectric substrate 1105 and provided to separate the dielectric substrate 1105 from a second antenna is added to the ground pattern 1502. Thus, the ground pattern 1502 has a shape partially surrounding the dielectric substrate 1105 by the sides 1502*e*, 1502*d*, 1502*c*, 1502*b* and 1502*a*. That is, the ground pattern 1502 is formed so as not to fully surround all the edge portions of the planar element 1101 and so as to provide an opening to at least a part, which includes the cut-out portion 1114, of the edge portion of the planar element 1101. In this embodiment, since the ground pattern 1502 opposite to the top portion including the cut-out portion 1114 and the right side edge portion of the planar element 1101 is not provided, it can be said that there is an opening if a cover for the printed circuit board 1504 is not considered.

A second antenna includes a dielectric substrate 1505, which is the same as the dielectric substrate 1105, a high frequency power source 1503*b* connected with the feed point 1501*a*, and a ground pattern 1502. The dielectric substrate 1505 is provided on the left upper end of the printed circuit board 1504 and vertically apart from the ground pattern 1502 by 1 mm. By the sides 1502*g* and 1502*h* of the ground pattern 1502, the tapered shape is formed with respect to the feed point 1501*a* of the planar element included in the dielectric substrate 1505. The difference of the height between a point of the ground pattern 1502, which is nearest to the feed point 1501*a*, and an intersecting point of the left lateral edge portion of the printed circuit board 1504 and the side 1502*g* is 2 to 3 mm. Though the tapered shape formed by the sides 1502*g* and 1502*h* is symmetric with respect to the straight line passing through the feed point 1501*a*, the side 1502*h* is connected to a vertical side 1502*i*, and the side 1502*i* is connected to a horizontal side 1502*j*. The side 1502*j* is further connected to a vertical side 1502*k*. The region 1502*f* opposite to the right side surface of the dielectric substrate 1505 and provided to separate the dielectric substrate 1505 from the first antenna is added to the ground pattern 1502. Thus, the ground pattern 1502 has a shape partially surrounding the dielectric substrate 1505 by the sides 1502*g*, 1502*h*, 1502*i*, 1502*j* and 1502*k*. That is, the ground pattern 1502 is formed so as not to fully surround all the edge portions of the planar element 1101 included in the dielectric substrate 1505 and so as to provide an opening to at least a part, which includes the cut-out portion 1114, of the edge portion of the planar element 1101. In this embodiment, since the ground pattern 1502 opposite to the top portion including the cut-out portion 1114 and the left side edge portion of the planar element 1101 is not provided, it can be said that there is an opening if a cover for the printed circuit board 1504 is not considered. Basically, the printed circuit board 1504 of this wireless communication card is symmetric with respect to the straight line 1511.

Thus, the space diversity antenna can be implemented in the wireless communication card.

[Embodiment 16]

Figure 28:
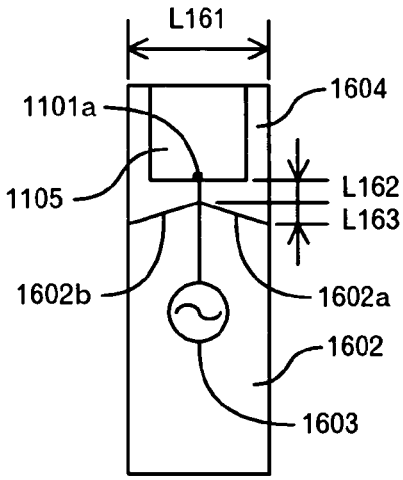
FIG. 28 is a diagram showing the shape of an antenna in a stick-type wireless communication card according to a sixteenth embodiment.

FIG. 28 shows an embodiment in which the antenna according to the eleventh embodiment is applied to a stick type wireless communication card. A printed circuit board 1604 according to this embodiment has the dielectric substrate 1105 that is the same as that in the eleventh embodiment, a high frequency power source 1603 connected to the feed point 1101*a*, and a ground pattern 1602. The dielectric substrate 1105 is mounted on the upper end of the printed circuit board 1604 and disposed away from the ground pattern 1602 by L162 (=1 mm). The ground pattern 1602 is formed to have a tapered shape with respect to the feed point 1101*a* of the dielectric substrate 1105 by sides 1602*a* and 1602*b*. The difference L163 of the height between a point of the ground pattern 1602, which is nearest to the feed point 1101*a*, and an intersecting point of the lateral side edge of the printed circuit board 1604 and the side 1602*a* or 1602*b* is 2 to 3 mm. In addition, the ground pattern 1602 having the tapered shape is symmetric with respect to the straight line passing the feed point 1101*a*. Incidentally, L161 is 10 mm.

Also in this embodiment, the ground pattern 1602 is formed so as not to surround the dielectric substrate 1105 including the planar element 1101 and so as to separate the antenna into the ground pattern 1602 side and the dielectric substrate 1105 side. That is, the ground pattern 1602 is formed so as not to fully surround all the edge portions of the planar element 1101 and so as to provide an opening to at least a part, which includes the cut-out portion 1114, of the edge portion of the planar element 1101.

Thus, if the dielectric substrate 1105 is used, it is possible to implement it inside the small stick type wireless communication card.

[Embodiment 17]

Figures 29A, 29B:
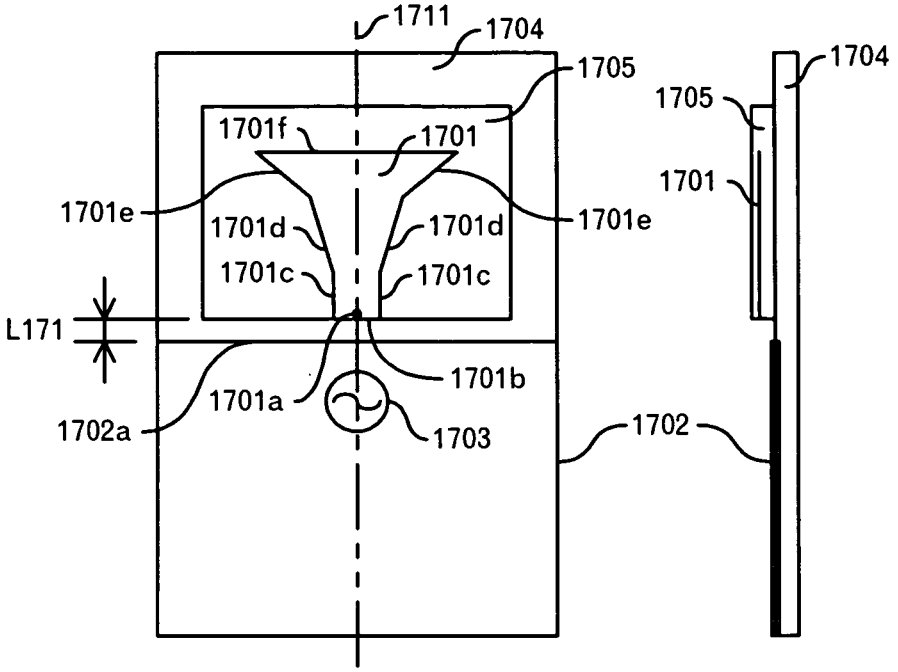
FIG. 29A is a front view showing the structure of an antenna according to a seventeenth embodiment.
FIG. 29B is a side view of the antenna.

FIGS. 29A and 29B show the structure of an antenna according to a seventeenth embodiment of this invention. As shown in FIG. 29A, the antenna of this embodiment is constituted by a dielectric substrate 1705 including a planar element 1701 in the inside thereof and having a dielectric constant of about 20, a ground pattern 1702 juxtaposed with the dielectric substrate 1705, a board 1704, for example, a printed circuit board (more specifically, a resin board made of FR-4, Teflon (registered trademark) or the like) and a high frequency power source 1703 connected to a feed point 1701*a* of the planar element 1701. The planar element 1701 has a shape similar to a T shape, and is constituted by a bottom side 1701*b* along an end portion of the dielectric substrate 1705, sides 1701*c* extending upward, sides 1701*d* having a first inclination angle from the sides 1701*c*, sides 1701*e* having an inclination angle larger than the first inclination angle from the sides 1701*c*, and a top portion 1701*f*. The feed point 1701*a* is provided at the middle point of the bottom side 1701*b* along the end portion of the dielectric substrate 1705. In this embodiment, a distance L171 between the dielectric substrate 1705 and the ground pattern 1702 is 1.5 mm. Besides, the width of the ground pattern 1702 is 20 mm.

Besides, the planar element 1701 and the ground pattern 1702 are symmetrical with respect to a straight line 1711 passing through the feed point 1701*a*. Besides, a length (hereinafter referred to as a distance) of a line segment extending from a point on the sides 1701*c*, 1701*d* and 1701*e* of the planar element 1701 to the ground pattern 1702 in parallel to the straight line 1711 is symmetrical with respect to the straight line 1711. That is, when lengths from the straight line 1711 are identical, the distances become identical.

In this embodiment, a side 1702*a* of the ground pattern 1702 facing the dielectric substrate 1705 is a straight line. Accordingly, the distance is gradually increased as an arbitrary point on the sides 1701*c*, 1701*d* and 1701*e* moves on the sides 1701*c*, 1701*d* and 1701*e*. That is, as the arbitrary point moves away from the straight line 1711, the distance is increased.

Although a polygonal line constituted by connecting the sides 1701*c*, 1701*d* and 1701*e* is not a curved line, the inclination of each side is changed stepwise so that the distance is increased to become saturated. In other words, when the point moves away from the straight line 1711 along the polygonal line, although the distance is rapidly increased at first, the increase rate is gradually decreased. That is, the shape is such that shaving is performed inward from a straight line connecting an end point of the top portion 1701*f* and an end point of the bottom side 1701*b*, which are positioned at the same side when viewed from the straight line 1711.

In this embodiment, the side edge portion of the planar element 1701 opposite to the side 1702*a* of the ground pattern 1702 is constituted by the three line segments 1701*c*, 1701*d* and 1701*e*. However, as long as the condition that the distance is increased to become saturated is satisfied, the shape of the inclined sides is not limited to this. Instead of the sides 1701*c*, 1701*d* and 1701*e*, a polygonal line constituted by an arbitrary number of line segments not less than two may be adopted. Besides, instead of the sides 1701*c*, 1701*d* and 1701*e*, the side edge portion may be a curved line convex upwardly with respect to the straight line 1711 connecting the end point of the top portion 1701*f* and the end point of the bottom side 1701*b*, which are positioned at the same side when viewed from the straight line 1711. That is, when viewed from the planar element 1701, the curved line is convex inwardly.

Even when any shape is adopted, as the point moves away from the straight line 1711, the distance continuously varies, and by the existence of the continuous varying portion, a continuous resonance characteristic can be obtained at the lower limit frequency or higher. Incidentally, the lower limit frequency is adjusted by changing the height of the planar element 1701. However, it can also be controlled by the length of the top portion 1701*f*, and/or the shape and length of the side edge portions with the reverse arc shape.

Also in this embodiment, the ground pattern 1702 is formed so as not to surround the dielectric substrate 1705 including the planar element 1701 and so as to separate the antenna into the ground pattern 1702 side and the dielectric substrate 1705 side. That is, the ground pattern 1702 is formed so as not to fully surround all the edge portions of the planar element 1701 and so as to provide an opening to at least a part of the edge portion of the planar element 1701.

FIG. 29B is a side view in which the ground pattern 1702 and the dielectric substrate 1705 are provided on the substrate 1704. There is also a case where the substrate 1704 and the ground pattern 1702 are integrally formed. Incidentally, in this embodiment, the planar element 1701 is formed in the inside of the dielectric substrate 1705. That is, the dielectric substrate 1705 is formed by laminating ceramic sheets, and the conductive planar element 1701 is also formed as one layer of them. Accordingly, actually, even if viewed from the above, it cannot be viewed as in FIG. 29A. When the planar element 1701 is constructed in the inside of the dielectric substrate 1705, as compared with a case of exposure, an effect of the dielectric is slightly enhanced, and therefore, the miniaturization can be achieved, and the reliability against rust or the like is also increased. However, the planar element 1701 may be formed on the surface of the dielectric substrate 1705. Besides, the dielectric constant can also be changed, and either of a single layer substrate and a multiplayer substrate may be used. In the case of the single layer substrate, the planar element 1701 is formed on the dielectric substrate 1705. Incidentally, in this embodiment, the plane of the dielectric substrate 1705 is disposed to be parallel to or substantially parallel to the plane of the ground pattern 1702. By this arrangement, the plane of the planar element 1701 included in the one layer of the dielectric substrate 1705 also becomes parallel to or substantially parallel to the plane of the ground pattern 1702.

As stated above, when the planar element 1701 is formed so as to be covered with the dielectric substrate 1705, the state of an electromagnetic field around the planar element 1701 is changed by the dielectric. Specifically, since an effect of increasing the density of the electric field in the dielectric and a wavelength shortening effect can be obtained, the planar element 1701 can be miniaturized. Besides, by these effects, a lift-off angle of a current path is changed, and an inductance component L and a capacitance component C in an impedance equivalent circuit of the antenna are changed. That is, a great influence occurs on the impedance characteristic. When the shape is optimized so as to obtain a desired impedance characteristic in the bandwidth from 4.9 GHz to 5.8 GHz in consideration of the influence on this impedance characteristic, the shape as shown in FIG. 29A has been obtained. This bandwidth is very wide as compared with the background art.

[Embodiment 18]

Figure 30:
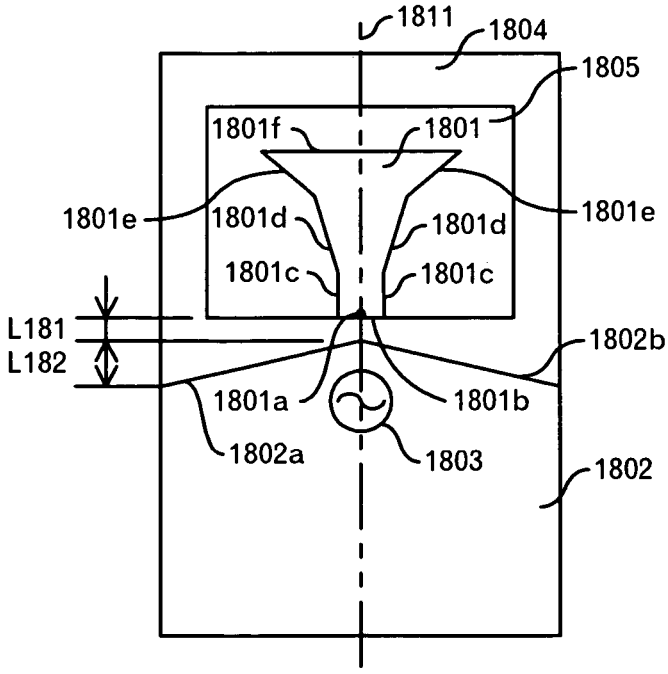
FIG. 30 is a diagram showing the structure of an antenna according to an eighteenth embodiment.

FIG. 30 shows a structure of an antenna of an eighteenth embodiment of this invention. As shown in FIG. 30, the antenna of this embodiment is constituted by a dielectric substrate 1805 including a planar element 1801 in the inside thereof and having a dielectric constant of about 20, a ground pattern 1802 juxtaposed with the dielectric substrate 1805, a substrate 1804, for example, a printed circuit board, and a high frequency power source 1803 connected to a feed point 1801*a* of the planar element 1801. The planar element 1801 and the dielectric substrate 1805 are the same as the planar element 1701 and the dielectric substrate 1705 of the seventeenth embodiment. In this embodiment, a distance L181 between the dielectric substrate 1805 and the ground pattern 1802 is 1.5 mm. Besides, the width of the ground pattern 1802 is 20 mm.

Besides, the planar element 1801 and the ground pattern 1802 are symmetrical with respect to a straight line 1811 passing through the feed point 1801*a*. Besides, a length (hereinafter referred to as a distance) of a line segment extending from a point on sides 1801*c*, 1801*d* and 1801*e* of the planar element 1801 to the ground pattern 1802 in parallel to the straight line 1811 is also symmetrical with respect to the straight line 1811. That is, when intervals between the points on the sides 1801*c*, 1801*d* and 1801*e* and the straight line 1811 are identical, the distances become identical.

In this embodiment, sides 1802*a* and 1802*b* of the ground pattern 1802 facing the dielectric substrate 1805 are inclined so that as the point moves away from the straight line 1811 along the sides 1801*c*, 1801*d* and 1801*e*, the distance between the planar element 1801 and the ground pattern 1802 becomes long. In this embodiment, the height at the side edge portion is lower than the height of a cross point of the ground pattern 1802 and the straight line 1811 by a length L182 (=2 to 3 mm). That is, the ground pattern 1802 has a tapered shape formed of the upper edge portions 1802*a* and 1802*b* with respect to the dielectric substrate 1805.

Also in this embodiment, the ground pattern 1802 is formed so as not to surround the dielectric substrate 1805 including the planar element 1801 and so as to separate the antenna into the ground pattern 1802 side and the dielectric substrate 1805 side. That is, the ground pattern 1802 is formed so as not to fully surround all the edge portions of the planar element 1801 and so as to provide an opening to at least a part of the edge portion of the planar element 1801.

In addition, the structure of the side surface is similar to FIG. 29B. That is a plane of the dielectric substrate 1805 including the planar element 1801 and a plane of the ground pattern 1802 are disposed to be in parallel or substantially in parallel.

It is confirmed that when the sides 1802*a* and 1802*b* of the ground pattern 1802 are inclined as in this embodiment, in the range from 4.9 GHz to 5.8 GHz, the impedance characteristic is better than the antenna of the seventeenth embodiment.

[Embodiment 19]

Figure 31:
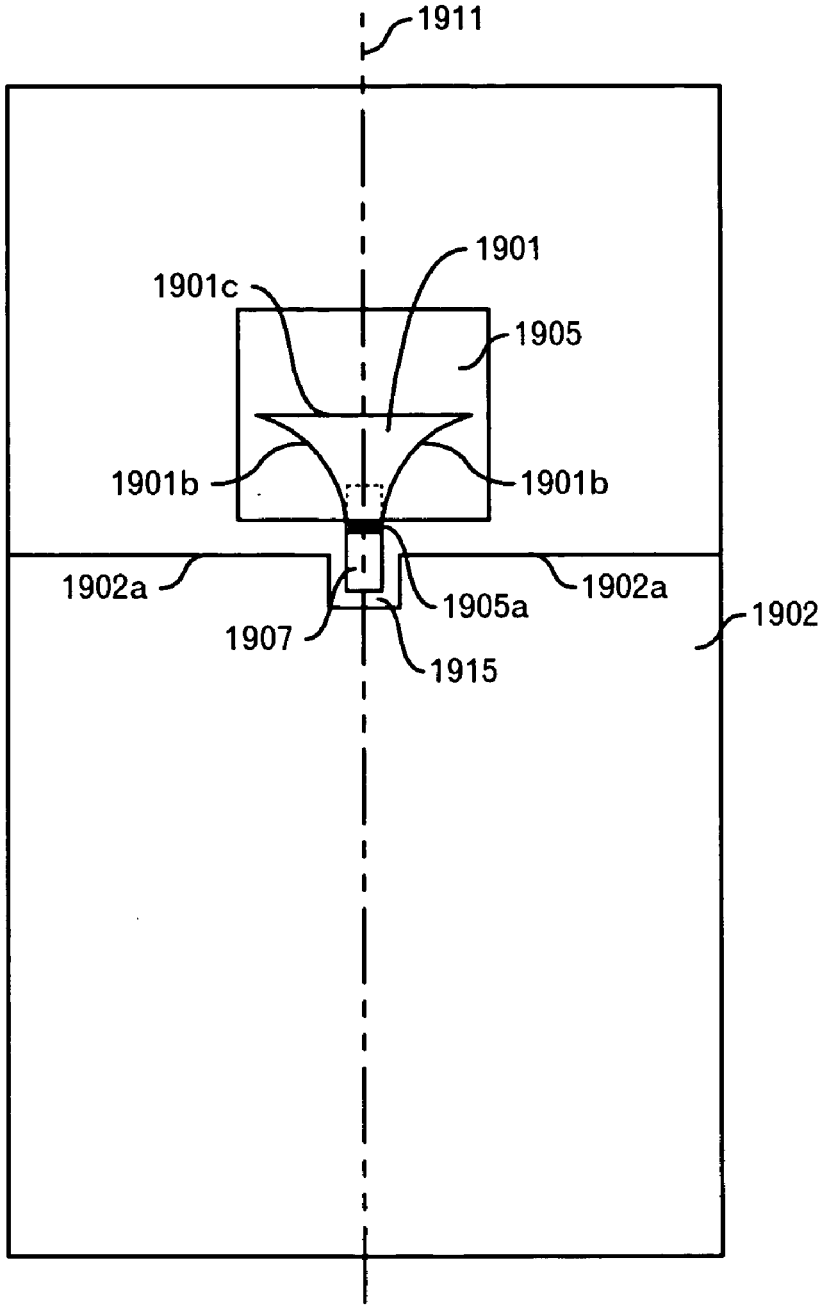
FIG. 31 is a diagram showing the structure of an antenna according to a nineteenth embodiment.

The structure of an antenna according to the nineteenth embodiment of the invention is shown in FIG. 31. In this embodiment, an example of a wide bandwidth antenna in the 5 GHz range is explained. The antenna according to the nineteenth embodiment is composed of a dielectric substrate 1905, which includes a planar element 1901 having a shape similar to a T-type shape inside, and to which an outside electrode 1905*a* is provided outside, a feeding portion 1907 to connect with the outside electrode 1905*a* of the dielectric substrate 1905 and to connect with a high frequency power source (not shown), to feed power to the planar element 1901, and a ground pattern 1902 that has a recess 1915 accommodating the feed portion 1907 and is formed on a printed circuit board or the like. The outside electrode 1905*a* is connected with a lower portion of the planar element 1901 and extends to the back surface (dotted line portion of the back surface) of the dielectric substrate 1905. The feed portion 1907 contacts with the external electrode 1905*a* that is provided on the end portion of the side surface and the back surface of the dielectric substrate 1905, and the feed portion 1907 and the external electrode 1905*a* are overlapped in the dotted line portion.

The planar element 1901 has an edge portion connected with the external electrode 1905*a*, a curved line 1901*b* opposite to the side 1902*a* of the ground pattern 1902, and a top portion 1901*c*. Incidentally, the dielectric substrate 1905 including the planar element 1901 is juxtaposed with the ground pattern 1902.

Incidentally, in this embodiment, the planar element 1901 is formed inside the dielectric substrate 1905. That is, the dielectric substrate 1905 is formed by laminating ceramic sheets, and the conductive planar element 1901 is formed as one layer of the laminate. Accordingly, when the antenna is viewed from the upper side, it is not actually viewed like FIG. 31. However, the planar element 1901 may be formed on the surface of the dielectric substrate 1905.

Since the recess 1915 for accommodating the feed portion 1907 is provided for the ground pattern 1902, the side 1902*a* opposite to the planar element 1901 is not straight, and is divided into two sides. Incidentally, the antenna according to this embodiment is symmetric with respect to a straight line 1911 passing through the center of the feed portion 1907. The distance between sides 1901*b* of the planar element 1901 and the sides 1902*a* of the ground pattern 1902 becomes longer as being farther away along the curved lines of the sides 1901*b* from the straight line 1911. This distance is also symmetric with respect to the straight line 1911. However, since the side 1901*b* is convex inwardly toward the planar element 1901, the distance becomes saturated as being farther away from the straight line 1911. In other words, as being farther away from the straight line 1911, although the distance rapidly increases at first, the increase rate is gradually decreased. Incidentally, the structure of the side surface is almost similar to that shown in FIG. 29B except for the external electrode 1905*a* and portions of the recess 1915 and the feed portion 1907. That is, the plane of the dielectric substrate 1905 including the planar element 1901 is disposed to be parallel or substantially parallel to the plane of the ground pattern 1902. That is, the ground pattern 1902 and the planar element 1901 are not completely overlapped, and both the planes thereof are parallel or substantially parallel to each other.

Also in this embodiment, the ground pattern 1902 does not surround the dielectric substrate 1905 including the planar element 1901, and the ground pattern 1902 side and the dielectric substrate 1905 side are separated form each other up and down. That is, the ground pattern 1902 is formed without surrounding the entire edge portion of the planar element 1901 so as to provide an opening with respect to at least a part of the edge portion of the planar element 1901.

[Embodiment 20]

Figure 32:
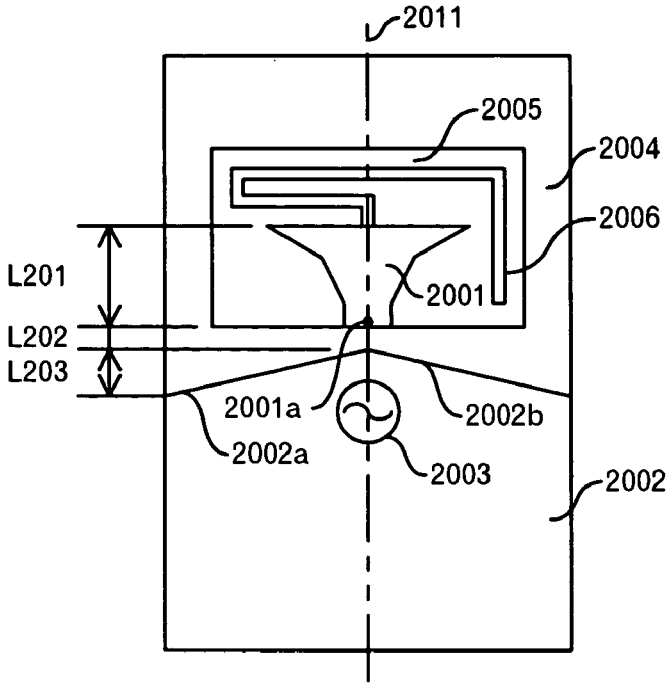
FIG. 32 is a diagram showing the structure of an antenna of a 20th embodiment of this invention.

An antenna according to a 20th embodiment of this invention is a dual band antenna for a 2.4 GHz band and a 5 GHz band. As shown in FIG. 32, the dual band antenna is constituted by a dielectric substrate 2005 including in the inside thereof a planar conductive first element 2001 and a second element 2006 as a resonant element extending from a center of a top of the first element 2001, a ground pattern 2002 juxtaposed with the dielectric substrate 2005, disposed there from by an interval L202 (=1.5 mm) and having an upper edge portion of a tapered shape with respect to the dielectric substrate 2005, a substrate 2004 on which the dielectric substrate 2005 and the ground pattern 2002 are mounted, and a high frequency power source 2003 connected to a feed point 2001*a* provided at the central portion of a bottom of the first element 2001. The size of the dielectric substrate 2005 is, for example, 8 mm×4.5 mm×1 mm.

The first element 2001 has a shape similar to a T shape, and specifically, has a shape similar to the planar element 1701 shown in FIG. 29A. Bandwidth control of the 5 GHz band is performed by a height L201 of this first element 2001. However, the bandwidth can also be controlled by the length of a side of a top portion and/or the shape and length of side edge portions with a reverse arc shape.

The ground pattern 2002 has a width of 20 mm, and the height at both side edge portions of the ground pattern 2002 is lower than the height of a cross point of the ground pattern 2002 and a straight line 2011 passing through the feed point 2001*a* by L203 (=2 to 3 mm). That is, the ground pattern 2002 has a tapered shape formed of upper edge portions 2002*a* and 2002*b* with respect to the dielectric substrate 2005.

Incidentally, the structure of the side surface is almost similar to FIG. 29B except for the portion of the second element 2006. That is, a plane of the dielectric substrate 2005 including the first element 2001 and the second element 2006 and a plane of the ground pattern 2002 is disposed to be in parallel or substantially in parallel. However, the second element 2006 is provided in the same layer as the first element 2001.

The first element 2001 and the ground pattern 2002 are symmetrical with respect to the straight line 2011. Besides, a length (hereinafter referred to as a distance) of a line segment extending from a point on the side edge portions of the first element 2001 to the ground pattern 2002 in parallel to the straight line 2011 is also symmetrical with respect to the straight line 2011. Further, the distance is gradually increased as the point on the side edge portions of the first element 2001 moves away from the straight line 2011.

The impedance characteristic is controlled by the shapes of the first element 2001 and the ground pattern 2002 as stated above. Besides, the resonant frequency of the 2.4 GHz band is controlled by adjusting the length of the second element 2006 from a connected portion with the first element 2001 to an open end. Incidentally, the second element 2006 has a bent shape so that miniaturization is achieved without exerting a bad influence on the characteristic of the first element 2001.

By adopting the shapes as stated above, the electric characteristics of the 5 GHz band and the 2.4 GHz band can be separately controlled. The 5 GHz band and the 2.4 GHz band are bandwidths used in the standard of wireless LAN (Local Area Network), and this embodiment capable of supporting both the frequency bandwidths is very useful.

[Embodiment 21]

Figure 33:
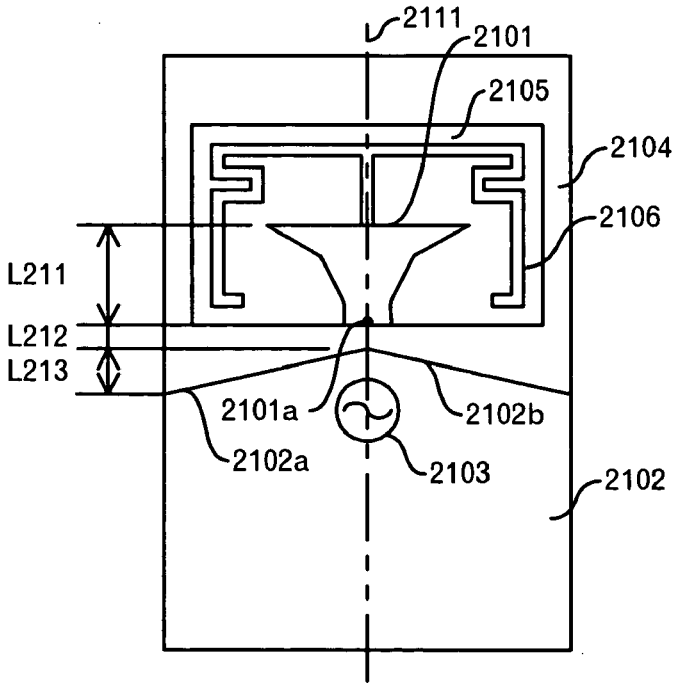
FIG. 33 is a diagram showing the structure of an antenna of a 21st embodiment of the invention.

An antenna of a 21st embodiment of this invention is a dual band antenna for a 2.4 GHz band and a 5 GHz band. This dual band antenna is constituted by, as shown in FIG. 33, a dielectric substrate 2105 including in the inside thereof a conductive planar first element 2101 and a second element 2106 as a resonant element extending from a center of a top of the first element 2101, a ground pattern 2102 juxtaposed with the dielectric substrate 2105, disposed there from by an interval L212 (=1.5 mm) and having an upper edge portion of a tapered shape with respect to the dielectric substrate 2105, a substrate 2104 on which the dielectric substrate 2105 and the ground pattern 2102 are placed, and a high frequency power source 2103 connected to a feed point 2101*a* provided at the central portion of a bottom of the first element 2101. The size of the dielectric substrate 2105 is, for example, 10 mm×5 mm×1 mm.

The first element 2101 has a shape similar to a T shape, and specifically, has a shape similar to the planar element 1701 shown in FIG. 29A. Bandwidth control of the 5 GHz band is performed by a height L211 of this first element 2101. However, the bandwidth can also be controlled by the length of a side of a top portion and/or the shape and length of side edge portions with a reverse arc shape.

The ground pattern 2102 has a width of 20 mm, and the height of the side edge portions of the ground pattern 2102 are lower than the height of a cross point of the ground pattern and a straight line 2111 passing through the feed point 2101*a* by L213 (=2 to 3 mm). That is, the ground pattern 2102 has a tapered shape formed of upper edge portions 2102*a* and 2102*b* with respect to the dielectric substrate 2105. The structure of the side surface is almost same as that shown in FIG. 29B except for the portion of the second element 2106. That is, a plane of the first element 2101 and the second element 2106 and a plane of the ground pattern 2102 are disposed to be in parallel or substantially in parallel. However, the second element 2106 is provided in the same layer as the first element 2101.

The first element 2101, the second element 2106, and the ground pattern 2102 are symmetrical with respect to the straight line 2111. Besides, a length (hereinafter referred to as a distance) of a line segment extending from a point on the side edge portion of the first element 2101 to the ground pattern 2102 in parallel to the straight line 2111 is also symmetrical with respect to the straight line 2111. Further, the distance is gradually increased as the point on the side edge portions of the first element 2101 moves away from the straight line 2111.

Figures 34, 39:
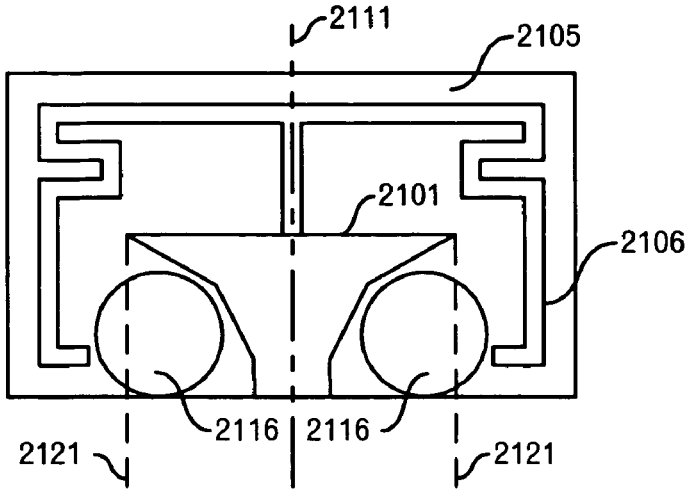
FIG. 34 is a diagram for explaining a region where a second element exerts an influence on a first element.
FIG. 39 is a diagram showing a gain characteristic in the 21st embodiment of this invention.

The impedance characteristic is controlled by the shapes of the first element 2101 and the ground pattern 2102 as set forth above. The resonant frequency of the 2.4 GHz band is controlled by adjusting the length of the second element 2106 from a connected portion with the first element 2101 to an open end. Incidentally, a meander portion of the second element 2106 is formed at upper side of the dielectric substrate. This is for carrying out an efficient arrangement in a limited space while a bad influence is not exerted on the characteristic of the first element 2101. As shown in FIG. 34, a space 2116 is a portion where a bad influence is exerted on the characteristic of the first element 2101, and the second element 2106 is not disposed in this portion. Besides, the second element 2106 is not disposed in at least a region closer to the first element 2101 than a dotted line 2121. This dotted line 2121 is a half line extending in parallel to the straight line 2111 toward the feed point 2101*a* from a start point that is an end point of the side edge portion of the first element 2101 and is remoter from the feed point 2101*a*.

By adopting the shape as stated above, the electrical characteristics of the 5 GHz band and the 2.4 GHz band can be separately controlled. The 5 GHz band and the 2.4 GHz band are bandwidths used in the standard of wireless LAN, and this embodiment capable of supporting both the frequency bands is very useful.

Figures 35A, 35B:
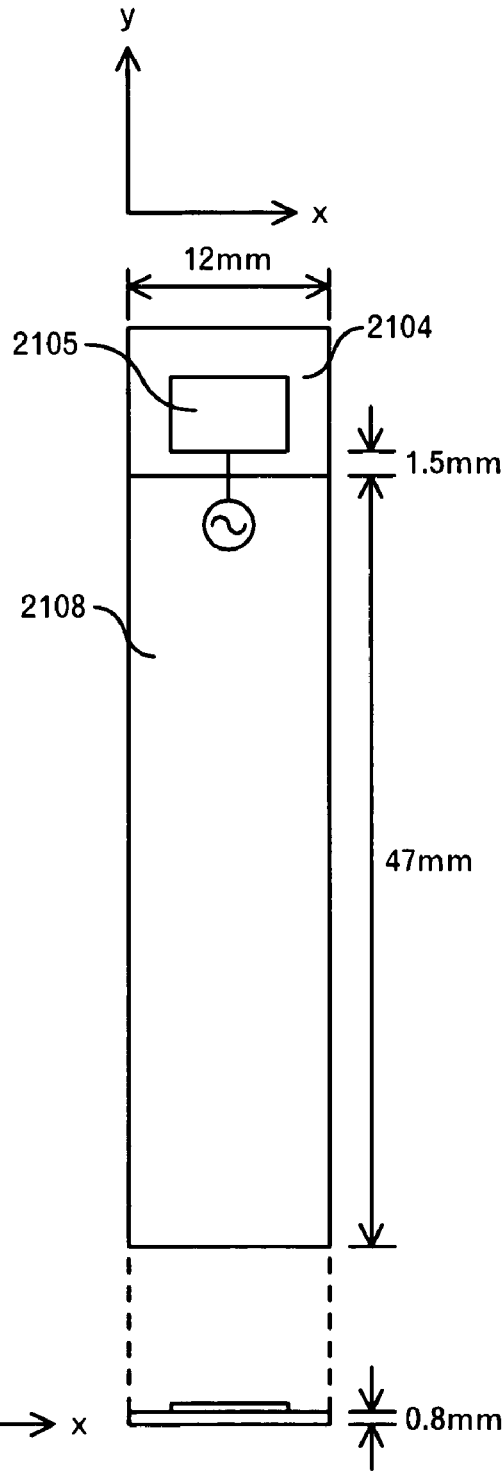
FIG. 35A is a front view showing a mounting example in the 21st embodiment of this invention.
FIG. 35B is a bottom view thereof.

Antenna characteristics in a case where for example, an implementation form as shown in FIGS. 35A and 35B is adopted will be given. As shown in FIGS. 35A and 35B, the dielectric substrate 2105, which is the same as that shown in FIG. 33, is juxtaposed with a ground pattern 2108 whose upper edge portion is horizontal and is disposed there from by an interval of 1.5 mm. As shown in FIG. 33, the size of the dielectric substrate 2105 is 10 mm×5 mm×1 mm, and includes the first element 2101 and the second element 2106. On the other hand, as for the size of the ground pattern 2108, the height is 47 mm and the width is 12 mm. The thickness of the substrate 2104 is 0.8 mm. Incidentally, it is assumed that the drawing shown in FIG. 35A is an XY plane, and the drawing shown in FIG. 35B is an XZ plane.

Figure 36:
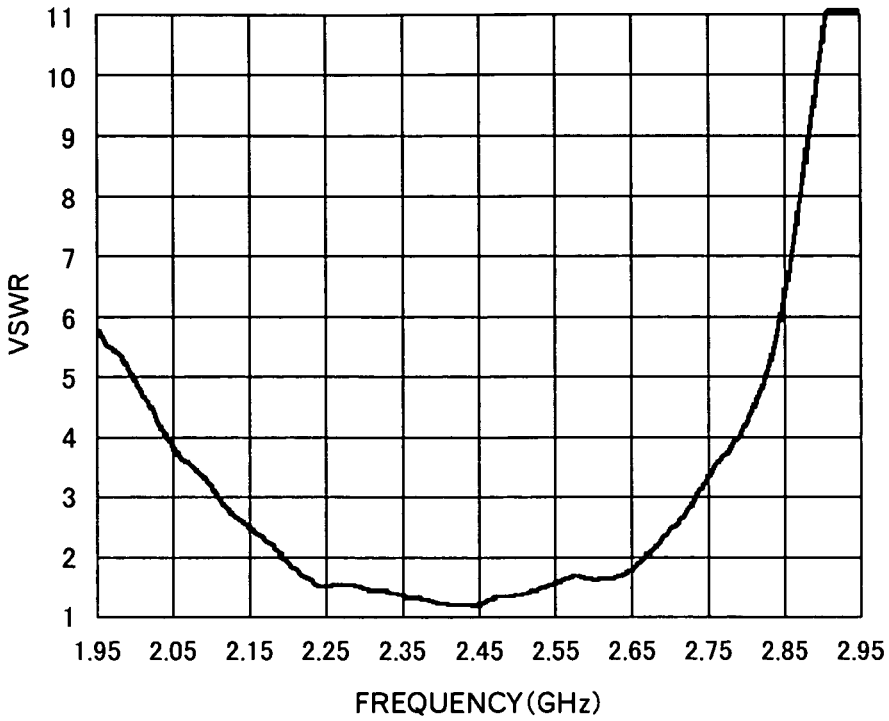
FIG. 36 is a diagram showing an impedance characteristic of a 2.4 GHz band in the 21st embodiment of this invention.
Figure 37:
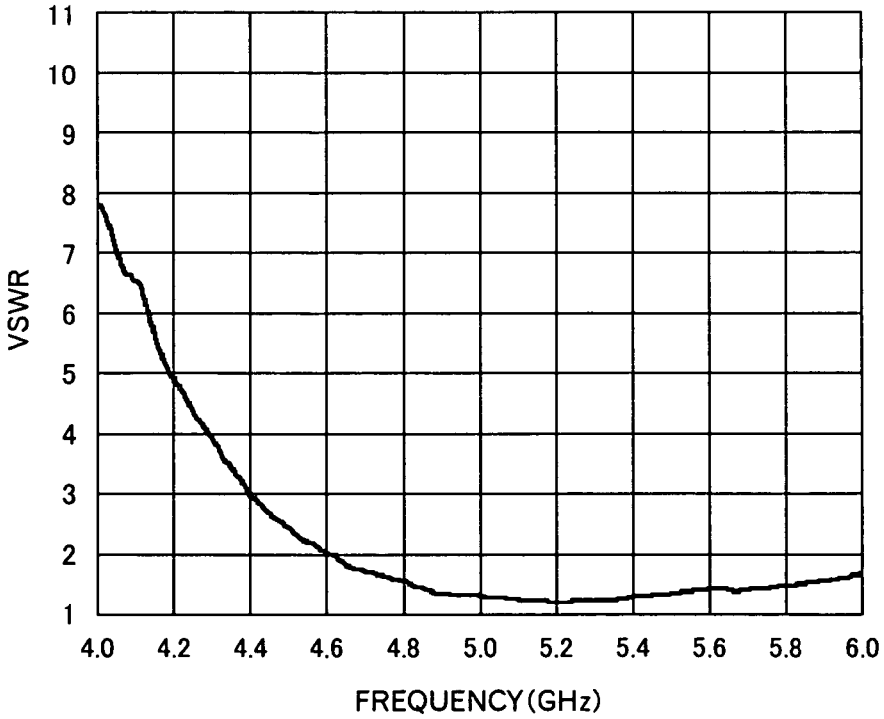
FIG. 37 is a diagram showing an impedance characteristic of a 5 GHz band in the 21st embodiment of this invention.

At this time, the impedance characteristic of the second element 2106 is as shown in FIG. 36. In FIG. 36, the axis of ordinate indicates the VSWR, and the axis of abscissa indicates the frequency (GHz). The frequency at which the VSWR is smallest is about 2.45 GHz, and the frequency range in which the VSWR is 2 or less is from about 2.20 GHz to 2.67 GHz, so that about 470 MHz is secured. On the other hand, the impedance characteristic of the first element 2101 is as shown in FIG. 37. The frequency at which the VSWR is smallest is about 5.2 GHz, and the frequency range in which the VSWR is 2 or less is about 4.6 GHz to 6 GHz or more, so that at least 1.4 GHz is secured. As stated above, the wide bandwidth is realized for both the second element 2106 and the first element 2101. That is, it is indicated that the antenna of the embodiment has a sufficient function as the dual band antenna. Incidentally, the ground pattern 2108 may be tapered toward the dielectric substrate 2105.

Figure 38A:
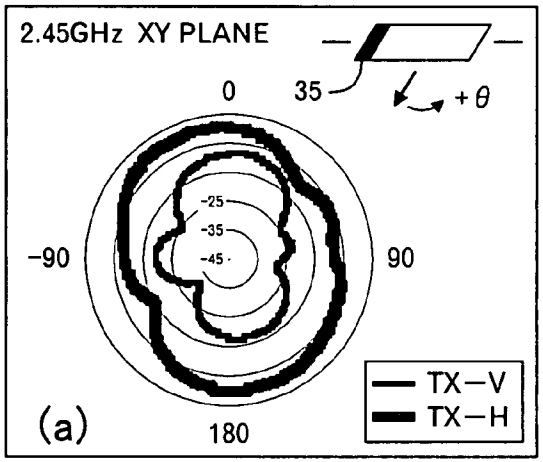
FIGS. 38A, 38B and 38C are diagrams showing radiation patterns with respect to the electric wave of 2.45 GHz.

Besides, the directivity of the antenna shown in FIGS. 35A and 35B will be shown in FIGS. 38A to 38F. FIG. 38A shows radiation patterns when electric waves of 2.45 GHz are transmitted from a transmission side antenna, and the reception side antenna shown in FIGS. 35A and 27B is rotated while a measurement plane is set to the XY plane. Incidentally, with respect to concentric circles, the center indicates −45 dBi, the outermost circle indicates 5 dBi, and an interval between the respective circles is 10 dBi. Here, an inside solid line indicates the radiation pattern of the reception side antenna in the case where the electric wave of the vertical polarization is transmitted from the transmission side antenna, and an outside thick line indicates the radiation pattern of the reception side antenna in the case where the electric wave of the horizontal polarization is transmitted from the transmission side antenna. It is understood that the radiation pattern for the horizontally polarized wave shows larger gain in all directions. Besides, in the case of the vertically polarized wave, it appears that there is directivity in directions of 0 degree, −90 degrees and 180 degrees. Incidentally, an upper right picture shows the antenna of FIGS. 35A and 35B. A blackened portion is a position where the dielectric substrate 2105 is placed. A vertical arrow indicates a direction of 0 degree, and an angle is increased in a direction of + theta.

Figure 38B:
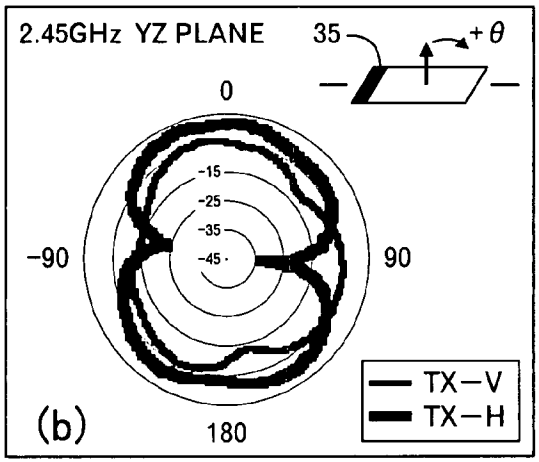

Similarly, FIG. 38B shows radiation patterns when electric waves of 2.45 GHz are transmitted from the transmission side antenna, and the reception side antenna shown in FIGS. 35A and 35B is rotated while the YZ plane is set to a measurement plane. Similarly to the above, a solid line indicates the radiation pattern of the reception side antenna in the case where the electric wave of the vertically polarization is transmitted from the transmission side antenna, and a thick line indicates the radiation pattern of the reception side antenna in the case where the electric wave of the horizontal polarization is transmitted from the transmission side antenna. It appears that the radiation pattern for the horizontally polarized wave has directivity in directions of 0 degree and 180 degrees. Besides, it appears that the radiation pattern for the vertically polarized wave has directivity in directions of 0 degree, 90 degrees and 180 degrees. Incidentally, the meaning of an upper right picture is the same as in FIG. 38A.

Figure 38C:
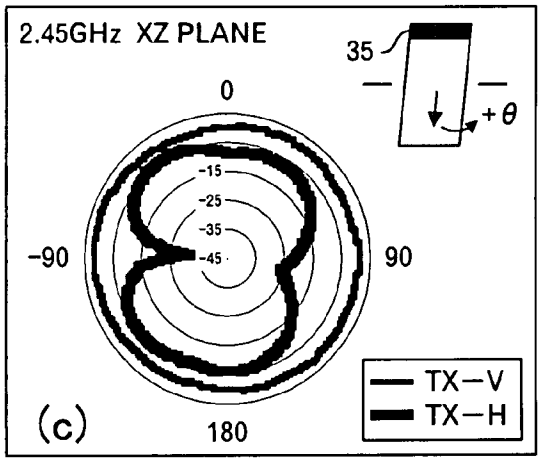

FIG. 38C shows radiation patterns when electric waves of 2.45 GHz are transmitted from the transmission side antenna, and the reception side antenna shown in FIGS. 35A and 35B is rotated while the measurement plane is set to the XZ plane. Similarly to the above, a solid line indicates the radiation pattern of the reception side antenna in the case where the electric wave of the vertical polarization is transmitted from the transmission side antenna, and a thick line indicates the radiation pattern of the reception side antenna in the case where the electric wave of the horizontal polarization is transmitted from the transmission side antenna. It appears that the radiation pattern for the horizontally polarized wave has directivity in directions of 0 degree and 180 degrees. Besides, the radiation pattern for the vertically polarized wave has non-directivity. Incidentally, the meaning of an upper right picture is the same as in FIG. 38A.

Figure 38D:
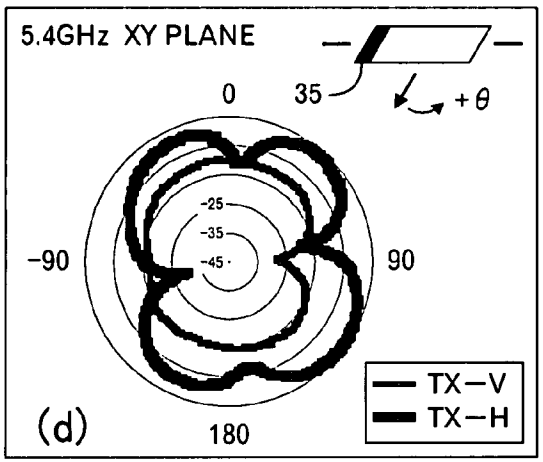
FIGS. 38D, 38E and 38F are diagrams showing radiation patterns with respect to the electric wave of 5.4 GHz in the 21st embodiment of this invention.

FIG. 38D shows radiation patterns when electric waves of 5.4 GHz are transmitted from the transmission side antenna, and the reception side antenna shown in FIGS. 35A and 35B is rotated while the measurement plane is set to the XY plane. Similarly to the above, a solid line indicates the radiation pattern of the reception side antenna in the case where the electric wave of the vertical polarization is transmitted from the transmission side antenna, and a thick line indicates the radiation pattern of the reception side antenna in the case where the electric wave of the horizontal polarization is transmitted from the transmission side antenna. It appears that the radiation pattern for the horizontally polarized wave has directivity in directions of 45 degrees, 135 degrees, −45 degrees and −135 degrees. Besides, it appears that the radiation pattern for the vertically polarized wave has non-directivity except for the direction of degrees. Incidentally, the meaning of an upper right picture is the same as in FIG. 38A.

Figure 38E:
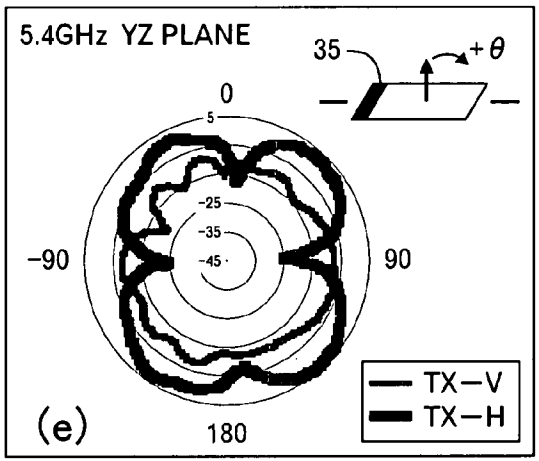

FIG. 38E shows radiation patterns when electric waves of 5.4 GHz are transmitted from the transmission side antenna, and the reception side antenna shown in FIGS. 35A and 35B is rotated while the measurement plane is set to the YZ plane. Similarly to the above, a solid line indicates the radiation pattern of the reception side antenna in the case where the electric wave of the vertical polarization is transmitted from the transmission side antenna, and a thick line indicates the radiation pattern of the reception side antenna in the case where the electric wave of the horizontal polarization is transmitted from the transmission side antenna. It appears that the radiation pattern for the horizontally polarized wave has directivity in directions of 45 degrees, 135 degrees, −45 degrees and −135 degrees. Besides, it appears that the radiation pattern for the vertically polarized wave has directivity with a complicated shape. Incidentally, the meaning of an upper right picture is the same as in FIG. 38A.

Figure 38F:
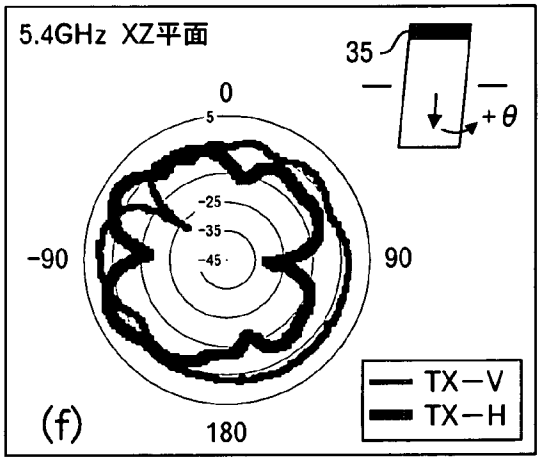

FIG. 38F shows radiation patterns when electric waves of 5.4 GHz are transmitted from the transmission side antenna, and the reception side antenna shown in FIGS. 35A and 35B is rotated while the measurement plane is set to the XZ plane. Similarly to the above, a solid line indicates the radiation pattern of the reception side antenna in the case where the electric wave of the vertical polarization is transmitted from the transmission side antenna, and a thick line indicates the radiation pattern of the reception side antenna in the case where the electric wave of the horizontal polarization is transmitted from the transmission side antenna. It appears that the radiation pattern for the horizontally polarized wave has directivity of a complicated shape. Besides, it appears that the radiation pattern for the vertically polarized wave has non-directivity except for the direction of −45 degrees. Incidentally, the meaning of an upper right picture is the same as in FIG. 38A.

FIG. 39 collectively shows data of average gains. For each of the planes, the average gain of 2.45 GHz and the average gain for 5.4 GHz with respect to the vertically polarized wave (V) and the horizontally polarized wave (H) are indicated. Further, the total average gains for 2.45 GHz and 5.4 GHz are also indicated. From this, with respect to 2.45 GHz, the gain for the vertically polarized wave on the XZ plane is high, and with respect to the horizontally polarized wave, the gain is high on the YZ plane or the XY plane. Besides, with respect to 5.4 GHz, the gain for the horizontally polarized wave on the YZ plane or the XY plane is high, and with respect to the vertically polarized wave, the gain is relatively high on the XZ plane.

[Embodiment 22]

Figure 40A:
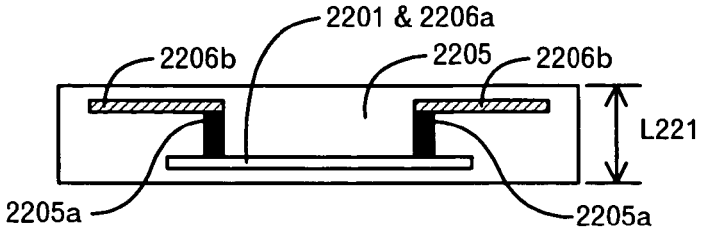
FIGS. 40A, 40B and 40C are diagrams showing a layer structural example of a dielectric substrate for an antenna according to a 22nd embodiment of this invention.
Figure 40B:
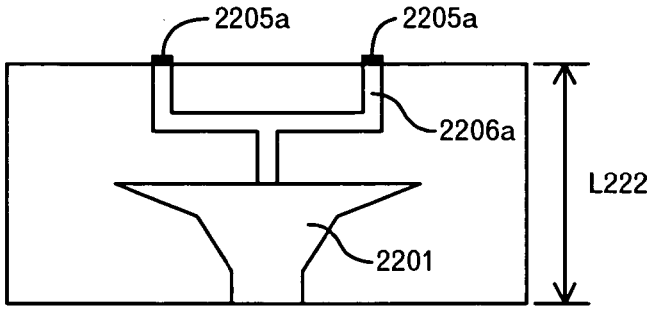
Figure 40C:
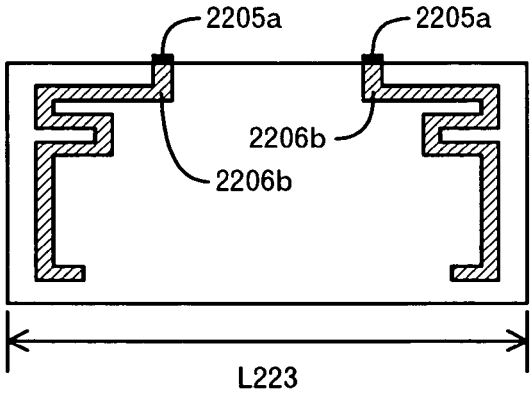

An antenna according to a 22nd embodiment of this invention is a dual band antenna for a 2.4 GHz band and a 5 GHz band, and here, a contrivance to further miniaturize the dielectric substrate 2105 of the 21sth embodiment will be described. The dual band antenna has a structure in which as shown in a side view of FIG. 40A, a planar first element 2201 and a first portion 2206*a* of a second element as a resonant element are formed in a relatively low layer of a dielectric substrate 2205, second portions 2206*b* of the second element are formed in a relatively high layer of the dielectric substrate 2205, and they are connected by two external electrodes 2205*a*. FIG. 40B shows a structure of the layer in which the first element 2201 and the first portion 2206*a* of the second element are formed. The shape of the first element 2201 is the same as that shown in the 21st embodiment. The first portion 2206*a* of the second element extends from the center of the top of the first element 2201, branches out into two directions halfway, and the branch portions are connected to the two external electrodes 2205*a* provided at the upper end portion of the dielectric substrate 2205. FIG. 40C show a structure of the layer in which the second portions 2206*b* of the second element is formed. The second portions 2206*b* of the second element have such structure that after they extend from the external electrode 2205*a* provided at the upper end portion of the dielectric substrate 2205 in the direction toward the lower end portion of the dielectric substrate 2205, they include the meander portions shown in the 21st embodiment (FIG. 33). The second portions 2206*b* of the second element are disposed so as not to overlap with the first element 2201 when viewed from the above though they are provided in the different layers. Similarly to the arrangement shown in FIG. 34 in the 21st embodiment, when viewed from the above, they are disposed so as not to overlap with at least the region where a bad influence is exerted on the first element 2201. That is, when the second portions 2206*b* of the second element and the first element 2201 are projected on a virtual plane parallel to the layers in which they are formed, the second portions 2206*b* of the second element are disposed not to overlap with predetermined regions defined beside the first element projected on the virtual plane. The predetermined regions are portions corresponding to the regions 2116 shown in FIG. 34. Incidentally, as for the size of the dielectric substrate 2205 in this embodiment, L221=1 mm, L222=4 mm, and L223=10 mm.

The resonant frequency of the second element is controlled by adjusting the length of the second element from a connected portion with the first element 2201 to the open ends. When compared with the fourth embodiment, the portions, as the first portions 2206*a* of the second element, extending toward the external electrodes 2205*a*, the portions of the external electrodes 2205*a*, and the portions, as the second portions 2206*b* of the second element, vertically extending from the external electrodes 2205*a* are added as the length of the second element. Thus, even if the second portions 2206*b* of the second element are shortened, the characteristic of the 2.4 GHz band can be kept at the same level as the antenna of the 21st embodiment. By this structure, miniaturization of the dielectric substrate 2205 can be realized.

Figure 41:
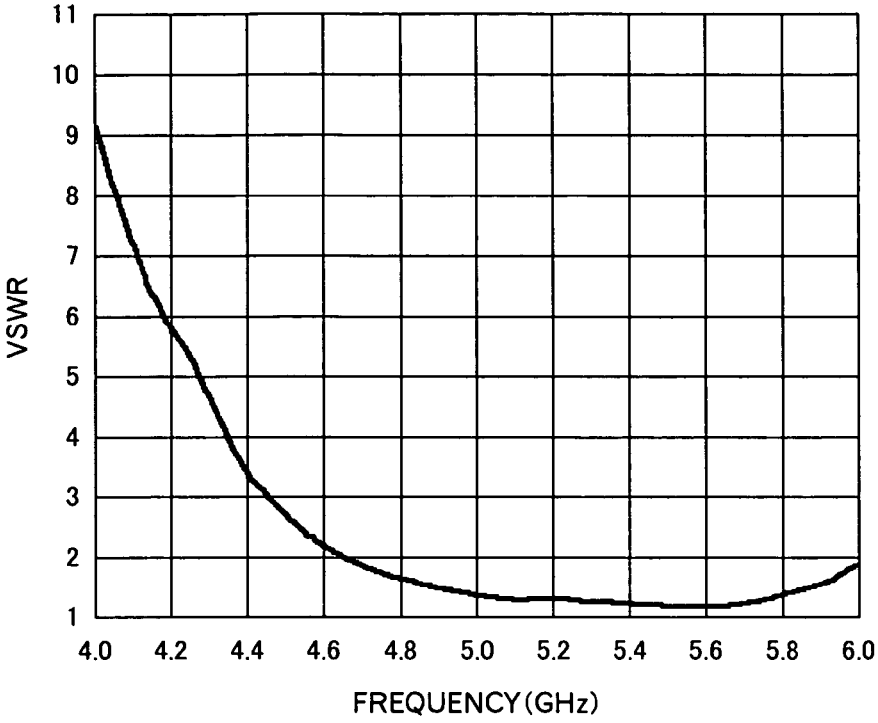
FIG. 41 is a diagram showing an impedance characteristic of a 5 GHz band in the 22nd embodiment of this invention.

FIG. 41 shows the impedance characteristic of the 5 GHz band in this embodiment. In FIG. 41, the axis of ordinate indicates the VSWR, and the axis of abscissa indicates the frequency (GHz). When compared with FIG. 37 showing the impedance characteristic of the 5 GHz band according to the 21st embodiment, although the shape of the curved line is slightly different, the bandwidth in which the VSWR is 2 or less is almost identical.

Figure 42:
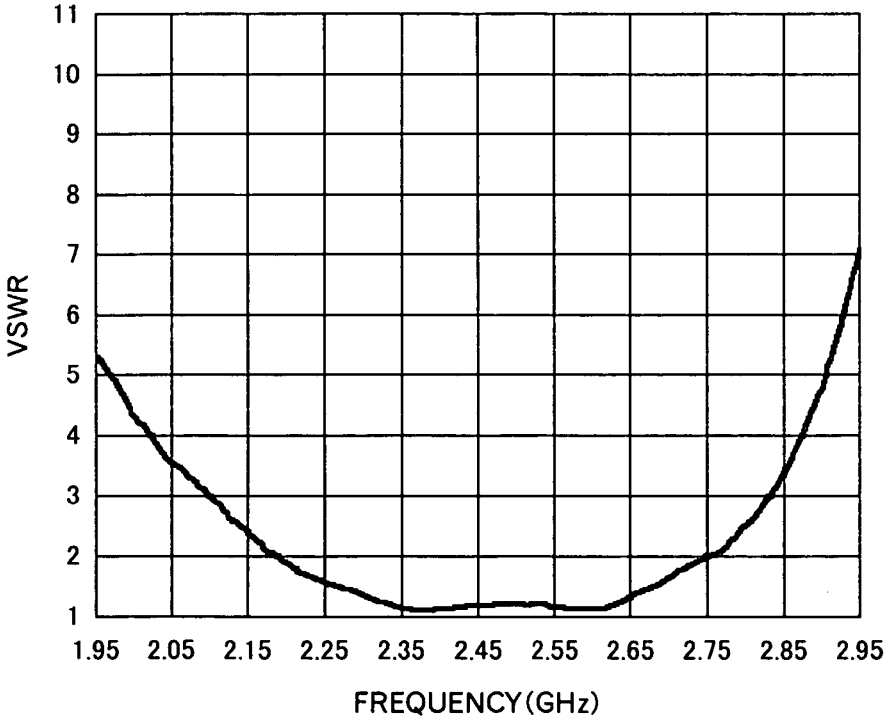
FIG. 42 is a diagram showing an impedance characteristic of a 2.4 GHz band in the 22nd embodiment of this invention.

FIG. 42 shows the impedance characteristic of the 2.4 GHz band in this embodiment. In FIG. 42, the axis of ordinate indicates the VSWR, and the axis of abscissa indicates the frequency (GHz). When compared with FIG. 36 showing the impedance characteristic of the 2.4 GHz band according to the 21st embodiment, the bandwidth in which the VSWR is 2 or less, in FIG. 42 showing the miniaturized case becomes wider at the high frequency side by about 80 MHz. Thus, it is understood that the excellent characteristic is represented as stated above.

[Embodiment 23]

Figure 43A:
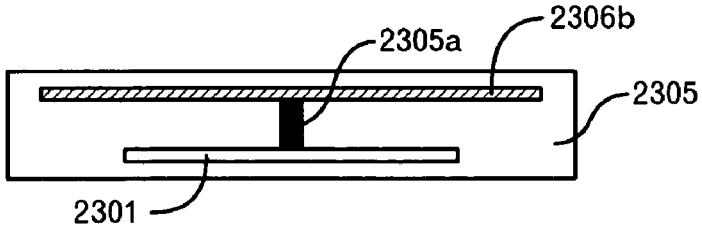
FIGS. 43A, 43B and 43C are diagrams showing a layer structural example of a dielectric substrate for an antenna according to a 23rd embodiment of this invention.
Figure 43B:
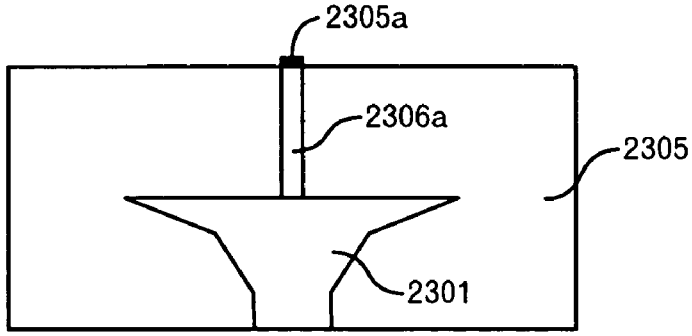
Figure 43C:
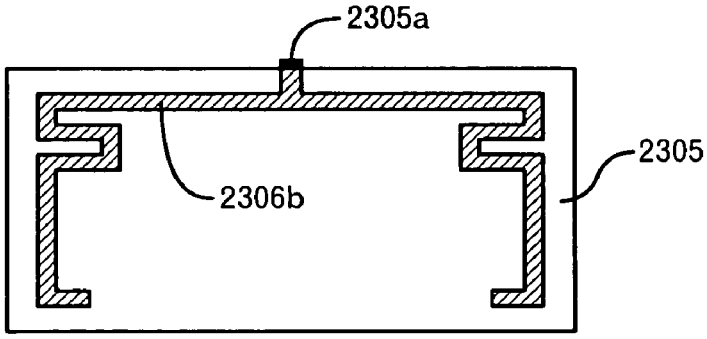

An antenna of a 23rd embodiment of this invention is a dual band antenna for a 2.4 GHz band and a 5 GHz band, and here, a contrivance to further miniaturize the dielectric substrate 2105 of the 21st embodiment will be described. The dual band antenna has a structure in which as shown in a side view of FIG. 43A, a conductive planar first element 2301 and a first portion 2306*a* of a second element as a resonant element are formed in a relatively low layer of a dielectric substrate 2305, a second portion 2306*b* of the second element is formed in a relatively high layer of the dielectric substrate 2305, and they are connected to each other by one external electrode 2305*a*. A FIG. 43B shows a structure of the layer in which the first element 2301 and the first portion 2306*a* of the second element are formed. The shape of the first element 2301 is the same as that shown in the 21st embodiment. The first portion 2306*a* of the second element extends from the center of the top of the first element 2301, and is linearly connected to the external electrode 2305*a* provided at the upper end portion of the dielectric substrate 2305. FIG. 43C shows a structure of the layer in which the second portion 2306*b* of the second element are formed. The second portion 2306*b* of the second element has such a structure that after it extends from the external electrode 2305*a* provided at the upper end portion of the dielectric substrate 2305 in the direction toward the lower end portion of the dielectric substrate 2305, it includes most of the second element 2106 shown in the 21st embodiment (FIG. 33) except for the portion for connection to the first element 2101. The second portion 2306*b* of the second element is disposed so as not to overlap with the first element 2301 when viewed from the above though they are provided in the different layers. Similarly to the arrangement shown in FIG. 34 in the 21st embodiment, when viewed from the above, it is disposed so as not to overlap with at least the region where a bad influence is exerted on the first element 2301.

The resonant frequency of the second element is controlled by adjusting the length of the second element from a connected portion with the first element 2301 to the open ends. When compared with the 21st embodiment, the portion, as the first portion 2306*a* of the second element, extending toward the external electrode 2305*a*, the portion of the external electrode 2305*a*, and the portion, as the second portion 2306*b* of the second element, vertically extending from the external electrode 2305*a* are added as the length of the second element. Thus, even if the second portion 2306*b* of the second element is shortened, the characteristic of the 2.4 GHz band can be kept at the same level as the antenna of the 21st embodiment. By this structure, miniaturization of the dielectric substrate 2305 can be realized.

[Embodiment 24]

Figure 44A:
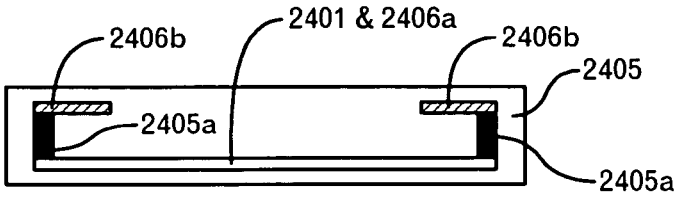
FIGS. 44A, 44B and 44C are diagrams showing a layer structural example of a dielectric substrate for an antenna according to a 24th embodiment of this invention.
Figure 44B:
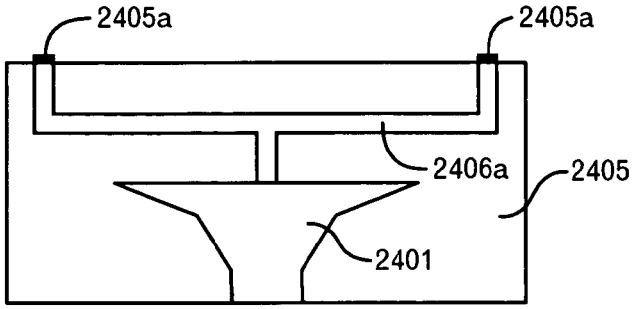
Figure 44C:
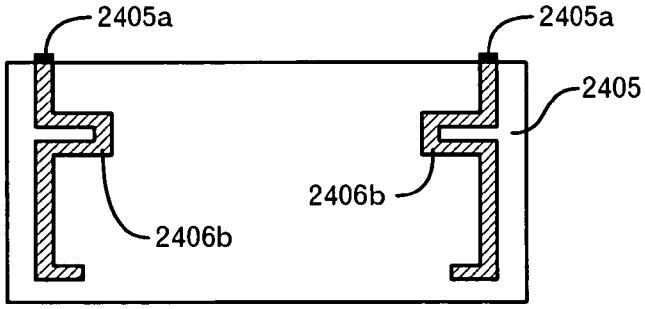
Figure 45A:
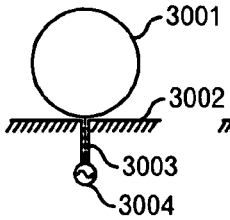
FIGS. 45A to 45H and 45J to 45L are diagrams showing the structures of conventional antennas.
Figure 45B:
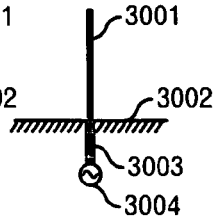
Figure 45C:
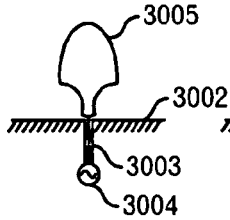
Figure 45D:
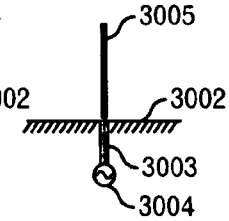
Figure 45E:
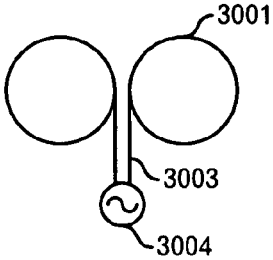
Figure 45F:
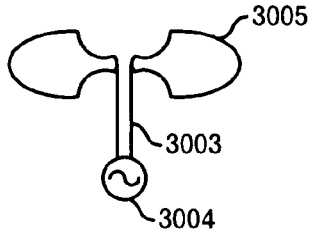
Figure 45G:
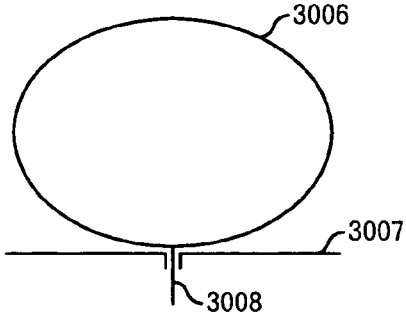
Figure 45H:
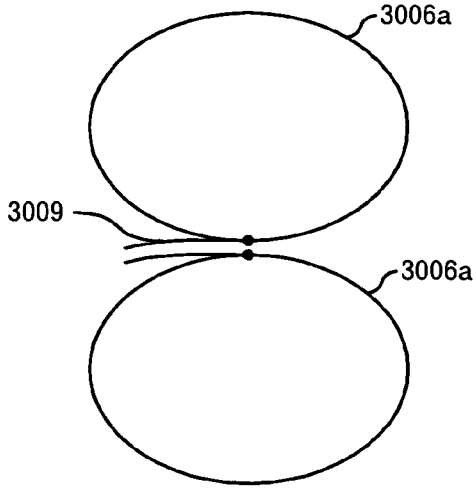
Figure 45J:
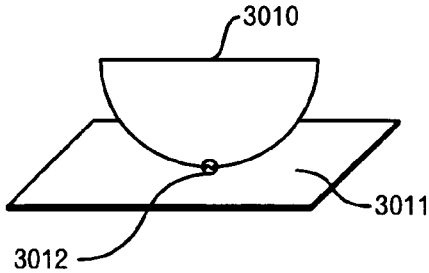
Figure 45K:
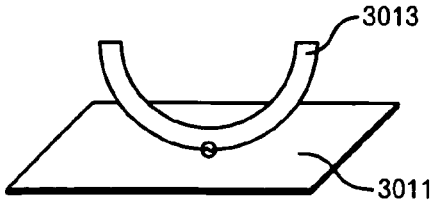
Figure 45L:
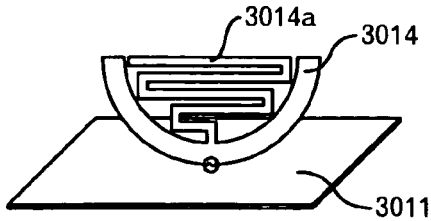
Figure 46:
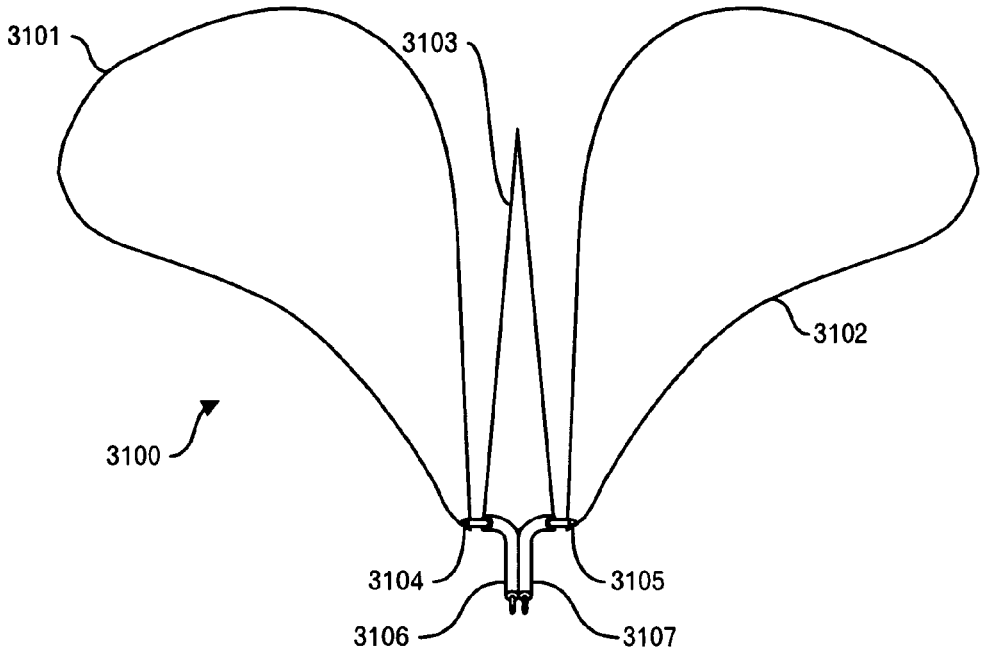
FIG. 46 is a diagram showing the structure of a conventional antenna.
Figure 47:
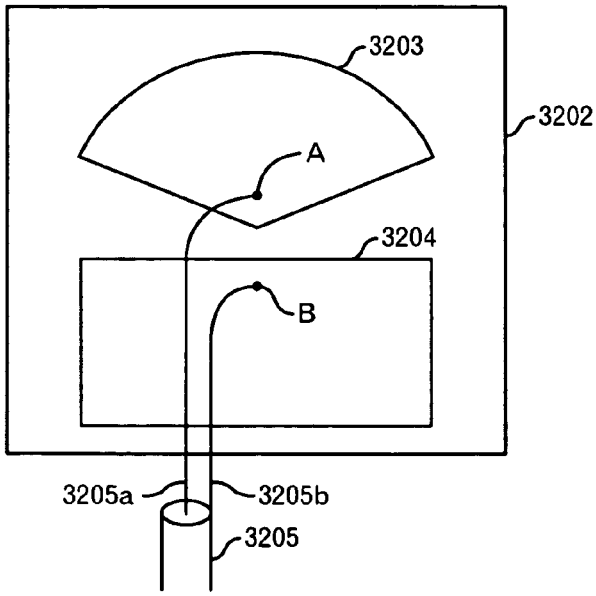
FIG. 47 is a diagram showing the structure of a conventional antenna.
Figure 48:
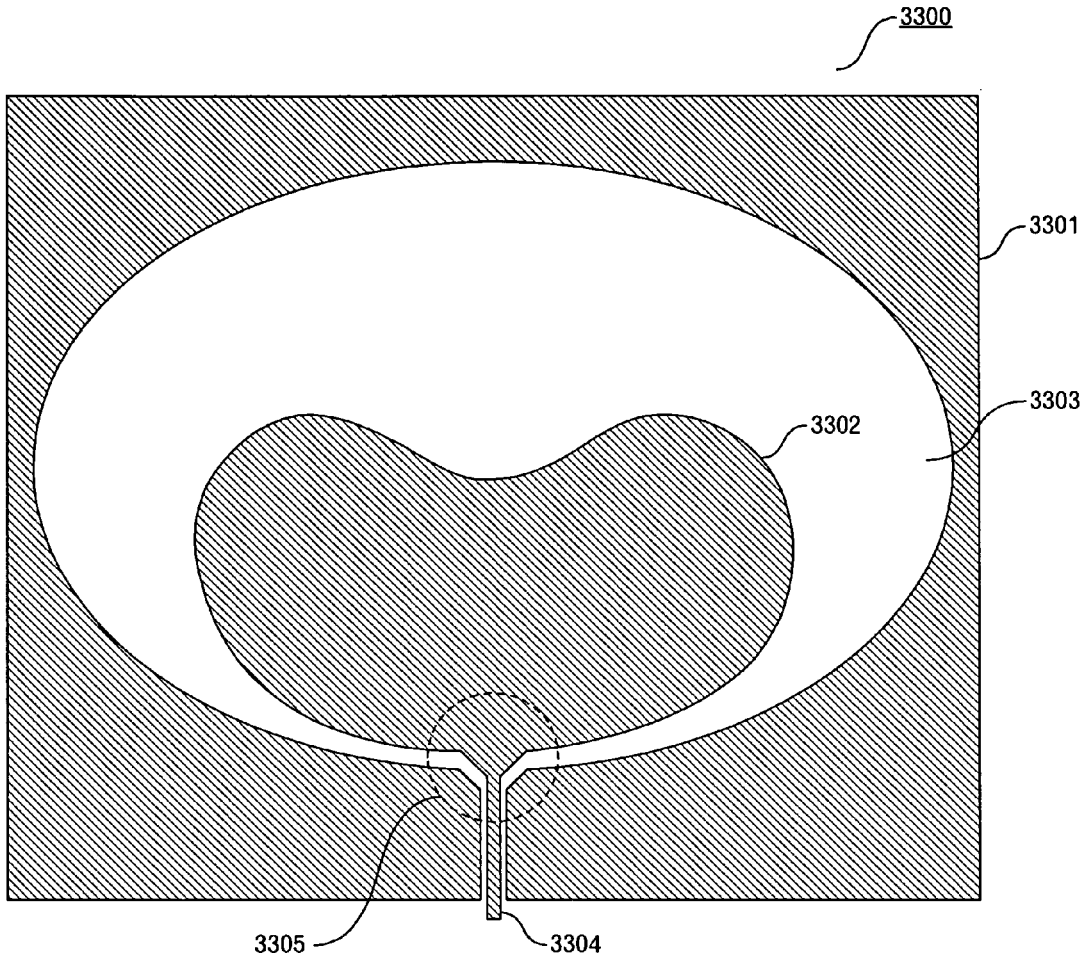
FIG. 48 is a diagram showing the structure of a conventional antenna.
Figure 49:
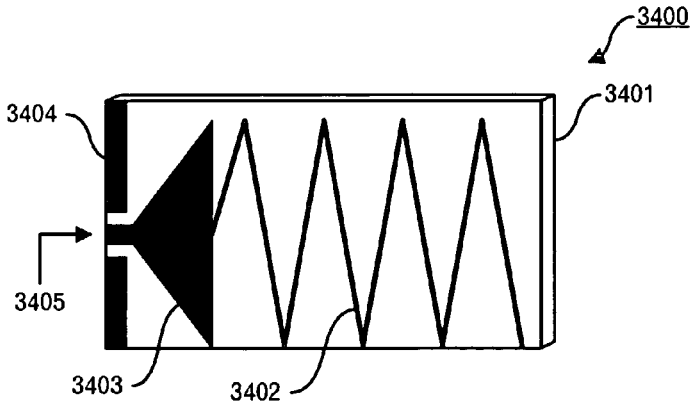
FIG. 49 is a diagram showing the structure of a conventional antenna.

An antenna according to a 24th embodiment of this invention is a dual band antenna for a 2.4 GHz band and a 5 GHz band, and here, a contrivance to further miniaturize the dielectric substrate 2105 of the 24th embodiment will be described. The dual band antenna has a structure in which as shown in a side view of FIG. 44A, a conductive planar first element 2401 and a first portion 2406*a* of a second element as a resonant element are formed in a relatively low layer of a dielectric substrate 2405, second portions 2406*b* of the second element are formed in a relatively high layer of the dielectric substrate 2405, and they are connected via two external electrodes 2405*a*. FIG. 44B shows a structure of the layer in which the first element 2401 and the first portion 2406*a* of the second element are formed. The shape of the first element 2401 is the same as that shown in the 21st embodiment. The first portion 2406*a* of the second element extends from the center of the top of the first element 2401, branches out into two directions halfway, and the branch portions extend beyond the side width of the first element 2401, and then, they are connected to the two external electrodes 2405*a* provided at the upper end portion of the dielectric substrate 2405. FIG. 44C shows a structure of the layer in which the second portions 2406*b* of the second element are formed. The second portions 2406*b* of the second element have such structure that after they extend from the external electrodes 2405*a* provided at the upper end portion of the dielectric substrate 2405 in the direction toward the lower end portion of the dielectric substrate 2405, they include the meander portions. The second portions 2406*b* of the second element are disposed so as not to overlap with the first element 2401 when viewed from the above though they are provided in the different layers. Similarly to the arrangement shown in FIG. 34 in the 21st embodiment, when viewed from the above, they are disposed so as not to overlap with at least the regions where a bad influence is exerted on the first element 2401.

The resonant frequency of the second element is controlled by adjusting the length of the second element from a connected portion with the first element 2401 to the open ends. When compared with the 21st embodiment, the portions, as the first portion 2406*a* of the second element, extending toward the external electrodes 2405*a*, the portions of the external electrodes 2405*a*, and the portions, as the second portions 2406*b* of the second element, vertically extending from the external electrodes 2405*a* are added as the length of the second element. Thus, even if the second portions 2406*b* of the second element are shortened, the characteristic of the 2.4 GHz band can be kept at the same level as the antenna of the 21st embodiment. By this structure, miniaturization of the dielectric substrate 2405 can be realized.

Although the embodiments of the invention have been described, the invention is not limited to these. For example, as the shape of the planar element and the resonant element, a different shape can be adopted as long as a similar antenna characteristic can be obtained. As described above, the shape of the cut-out portion may be a trapezoid or other polygons instead of the rectangle. In addition, rounding the corner of the cut-out portion may be carried out. As for the tapered shape of the ground pattern, it is also possible to construct it by another type of lines other than the line segments. Moreover, although there is an example where a recess for accommodating an electrode for feeding is provided, it is not always necessary that the tip have an acute angle. Furthermore, although the planar element is not covered completely by the ground pattern, there is a case in which they partially overlap.

The inventon claimed is:

1. An antenna, comprising:

a planar ground pattern; and a planar element including a continuous varying portion that causes a distance with the planar ground pattern to vary formed at an edge portion of the ground pattern side of the planar element, wherein the continuous varying portion includes at least one of a curved line and a plurality of line segments which are connected while their inclinations are changed stepwise, wherein at the continuous varying portion, the distance with the planar ground pattern is gradually increased so as to be farther away from a feed position of the planar element, wherein the planar element is symmetric with a line that passes through the feed position, wherein the planar ground pattern and the planar element do not completely cover each other and both planes thereof are parallel or substantially parallel to each other, wherein a first shape of the edge portion of a ground pattern side of the planar element is asymmetric with a second shape of an edge portion of a planar element side of the planar ground pattern, and wherein the planar element includes a rectangular cut-out portion at an edge portion opposite to the ground pattern side of the planar element.

* * * * *